United States Patent [19]

Okamoto

[11] 4,375,776

[45] Mar. 8, 1983

[54] TONE PROPERTY CONTROL DEVICE IN ELECTRONIC MUSICAL INSTRUMENT

[75] Inventor: Eisaku Okamoto, Hamamatsu, Japan

[73] Assignee: Nippon Gakki Seizo Kabushiki Kaisha, Japan

[21] Appl. No.: 928,153

[22] Filed: Jul. 26, 1978

[30] Foreign Application Priority Data

| | | | |
|---|---|---|---|
| Aug. 4, 1977 | [JP] | Japan | 52-93515 |
| Aug. 4, 1977 | [JP] | Japan | 52-93516 |
| Aug. 4, 1977 | [JP] | Japan | 52-93517 |
| Aug. 4, 1977 | [JP] | Japan | 52-93518 |
| Aug. 4, 1977 | [JP] | Japan | 52-93519 |

[51] Int. Cl.[3] ..... G10F 1/00

[52] U.S. Cl. ..... 84/1.03; 84/1.24; 84/345

[58] Field of Search ..... 84/1.01, 1.03, 1.24, 84/1.19, 115, 345

[56] References Cited

U.S. PATENT DOCUMENTS

| | | | |
|---|---|---|---|
| 3,905,267 | 9/1975 | Vincent | 84/1.03 |
| 3,926,087 | 12/1975 | Griffis | 84/345 |
| 3,999,458 | 12/1976 | Suzuki | 84/1.01 |
| 4,056,683 | 11/1977 | Suehiro | 84/1.01 |
| 4,078,465 | 3/1978 | Wheelwright | 84/345 X |
| 4,147,083 | 4/1979 | Woron et al. | 84/1.03 |
| 4,157,049 | 6/1979 | Watanabe | 84/1.24 |
| 4,178,828 | 12/1979 | Henschen | 84/345 X |
| 4,185,531 | 1/1980 | Oberheim et al. | 84/1.24 |

OTHER PUBLICATIONS

Oberheim, "A Programmer for Voltage Controlled Synthesizers," presented at 55th Convention of The Audio Engineering Society, Oct. 29–Nov. 1, 1976.

*Primary Examiner*—J. V. Truhe
*Assistant Examiner*—Forester W. Isen
*Attorney, Agent, or Firm*—Kane, Dalsimer, Kane, Sullivan and Kurucz

[57] ABSTRACT

In an electronic musical instrument, a tone property setting device is provided in association with a musical tone forming circuit. The device delivers analog signals designating properties of the musical tone signals to be produced, which analog signals are converted into time division multiplexed digital signals, then processed through memories, converted back into analog signals, and are applied to the musical tone forming circuit, thereby to determine the tone properties. Digital processing utilizing the memory facilitates a variety of control.

7 Claims, 40 Drawing Figures

(A)

(B)

CK1
CK0
18
19
85
OSC
100KHz
86
FREQUENCY DIVIDER (COUNTER)
390Hz
87
89
88
91
CLOCK PULSE FOR WRITE MODE
CLOCK PULSE FOR READ MODE.
90
92
93
RET
CK12
WT
RD
RS
94
95
96
97
98
99
100
R8
C3
D
Q
S/R
R
INH
PSH0
PSH20
10020
SH20
SH0
10000
SH1
10001
10018
SH18
SH19
10019
PSH19

TONE PROPERTY CONTROL DEVICE IN ELECTRONIC MUSICAL INSTRUMENT

BACKGROUND OF THE INVENTION

(1) Outline of the Invention

This invention relates to electronic musical instruments, and more particularly to a tone property control device in an electronic musical instrument in which a plurality of pieces of tone property control analog information are subjected to digital process and are then converted back into pieces of analog information, and the pieces of analog information are applied to predetermined musical tone forming circuits to control the latter, thereby to provide musical tones having intended tone properties.

(2) Tendency of the Latest Art

Recently, various electronic components, especially integrated circuit components can be manufactured at low cost by virture of the development of semiconductor technology, and therefore a variety of electronic musical instruments utilizing electronic components have been proposed in the field of musical instruments. Typical ones of the electronic musical instruments are electronic organs and music synthesizers. In these musical instruments large scale integrated circuits (LSI) or the like have been employed.

(3) Prior Art

With respect to such an electronic musical instrument as described above, the applicant has proposed an electronic musical instrument as disclosed in the specification of U.S. Pat. No. 3,897,709 "ELECTRONIC MUSICAL INSTRUMENT", publication date Aug. 5, 1975.

(3-1) Description of the Prior Art

The conventional electronic musical instrument comprises: a keyboard circuit for providing tone pitch designating voltages (KV) corresponding to depression of the keys and key depression signals (KON) corresponding to key depression and key release; and a musical tone forming circuits each including a voltage-controlled variable frequency oscillator (referred to as "VCO" when applicable) the oscillation frequency of which is controlled by the tone pitch designating voltage (KV) to provide a tone source signal having a tone pitch corresponding to the depressed key, a voltage-controlled type variable filter (hereinafter referred to as "VCF" when applicable) for subjecting the tone source signal to tone coloring, a voltage-controlled variable gain amplifier (hereinafter referred to as "VCA" when applicable) which subjects the output musical tone signal of the VCF to envelope formation; and envelope generators (hereinafter referred to as "EG" when applicable) controlling the VCO, VCF and VCA, respectively.

These EG's are supplied with a plurality of analog control voltages by a control voltage generating circuit (or a waveform parameter controller) and are triggered by the key depression signal (KON), thereby to provide a control voltage waveform (generally called in this field as an envelope waveform) of a shape as indicated in FIG. 3. The envelope waveform is supplied to the VCO, VCF and VCA, whereby for the period of time from the start of a musical tone till the end of the same, in the VCO the oscillation frequency is slightly varied with respect to time to provide a tone source signal rich in naturalness, in the VCF the frequency characteristic is varied with respect to time to effect tone color modulation, and in the VCA the amplification gain is varied with respect to time to set up the envelope of a musical tone to make it rich in musicality, and the musical tone signal is produced as a musical performance sound through a loudspeaker after being amplified.

The envelope waveform shown in FIG. 3 is a voltage waveform signal whose voltage value is varied with time in such a manner that it is raised from an initial level (IL) to an attack level (AL) in the period of an attach time (AT) from the key depression time instant ($t_1$), it is decayed to a sustain level (SL) in a first decay time period ($DT_1$), the sustain level being maintained until the time instant ($t_2$) of key release, and after the key release it is again decayed from the sustain level (SL) to the initial level (IL) in a second decay time period ($DT_2$).

Such an envelope waveform may be previously formed as desired by the instrument player. In this case, it can be formed by operating a so-called tone property setting board provided in the tone property control device. The tone property setting board is incorporated in a part of the musical instrument which is accessible from outside, or it is exposed on the musical instrument. The tone property setting board is provided with a plurality of variable resistors on a circuit board with an appropriate d.c. power supply so that the parameter controlling voltages for the aforementioned EG's are obtained from the outputs of the variable resistors. Furthermore, the set values of the variable resistors can be stored, in the form of analog data, in a memory means comprising fixed resistors and diodes. Accordingly, if the memory means storing desired information is set in the control device prior to the performance, musical tones are produced being determined by the information.

(3-2) Drawbacks Accompanying the Prior Art

A method in which the parameter controlling voltages in the form of analog data outputted by the tone property setting board is processed as they are is very inconvenient, because an analog information memory is bulkey.

Furthermore, the above-described memory means of the electronic musical instrument is disadvantageous in that a special auxiliary device is necessary for the memory means to store analog information, and it is rather troublesome to keep or carry the memory means because it is relatively heavy and large in size, and that it is impossible to record information in the memory means readily at low cost.

In addition, in the above-described electronic musical instrument, for instance an electronic organ, a plurality of keyboards such as the upper keyboard, the lower keyboard and the pedal keyboard are, in general, provided; and the above-described VCO, VCF, VCA and EG's are provided for each of the keyboards so that a performance can be carried with each keyboard independently of the other keyboards. Accordingly, in order to use the tone property setting board commonly for the plurality of keyboards, it is necessary to distinguish from one another the assignments of the outputs of the tone property setting board to the keyboards. Therefore, if the VCO, VCF, VCA and EG's of each keyboard is referred to as constituting "a musical tone forming channel", it is necessary to assign different channel codes to different channels. In this connection, if the channel code is an 8-bit digital code, the channel code may coincide with the data which is obtained by converting the tone property information into digital data. However, if the channel code coincides with that data, errors may occur because the control device in the electronic musical instrument cannot distinguish them from one another.

Furthermore, in the case where such tone property information and the channel code are recorded in an external memory such as a magnetic card, and the information in the external memory is read out to carry out a performance, it is necessary to distinctively and separately read the tone property information and the channel code.

In the above-described electronic musical instrument, for instance a music synthesizer, tone property information for determining the tone properties of musical tones is formed by operating a number of variable resistors (cf. U.S. Pat. No. 3,897,709) to set the tone properties for the actual performance. In addition, a number of keyboards, such as the upper keyboard, the lower keyboard, and the pedal keyboard, are provided. Accordingly, if it is possible to produce musical tones determined by different pieces of tone property information for different keyboards in a performance, it is very preferable for the performance. For instance, it is preferable that a flute voice (tone color) performance is effected in the upper keyboard, while a trumpet voice (tone color) performance is effected in the lower keyboard. Furthermore, it is more preferable, if pieces of tone property information are not fixedly assigned to the particular keyboards, so that the assignment of the tone property information can be changed easily.

Moreover, the conventional tone property control device in the electronic musical instrument is disadvantageous in that it is bulky because it is made up of the memory means having a number of fixed or variable resistors, and a number of selecting switches for selectively applying the outputs of the memory means to the tone property control circuits.

SUMMARY OF THE INVENTION

Accordingly, a first object of the invention is to provide a tone property control device in an electronic musical instrument in which tone property information in the form of analog data for designating the tone properties (frequency, tone color, amplitude, timewise variations thereof, and so forth) of musical tones is processed after being converted into digital words, and the tone property information thus processed is converted into that in the form of analog data again, thereby to facilitate the control of the musical tones.

A second object of the invention is to provide a tone property control device in an electronic musical instrument, in which analog data for controlling a voltage waveform generator (EG), namely, an envelope generator in the electronic musical instrument is converted into digital data which are recorded in an external memory such as a magnetic card, and a performance can be effected directly with the information recorded in the magnetic card, so that the musical tone information can be readily recorded, kept and carried, thereby to promote the performance.

A third object of the invention is to provide a tone property control device in an electronic musical instrument, in which when the tone property information coincides with the channel codes assigned previously as described before, the coincidence is detected to convert the tone property information into information different from the channel codes, thereby to normally effect the performance.

A fourth object of the invention is to provide a tone property control device in an electronic musical instrument, in which in the case where the tone property information is converted into the information different from the channel code as described above, the conversion is effected so that the tone property information obtained through the conversion is as similar to the tone property information prior to the conversion as possible, whereby the tone property information set up by the tone property setting board is close to the converted tone property information.

A fifth object of the invention is to provide a tone property control device in an electronic musical instrument, in which the above-described tone property information and channel code can be separately and distinctively read out of the external memory such as a magnetic card in which the tone property information and channel code have been recorded, thereby to normally effect the performance.

A sixth object of the invention is to provide a tone property control device in an electronic musical instrument, in which a number of pieces of tone property information can be assigned to any keyboard, so that a performance on desired tone property information can be effected with any keyboard.

A seventh object of the invention is to provide a tone property control device in an electronic musical instrument, which is miniaturized by replacing a conventional memory means with a random access memory (RAM), and in which the tone property information stored in a read only memory is copied into the RAM immediately when the power switch is turned on or upon operation of a separate switch, thereby to smoothly effect the performance.

The manner in which the foregoing objects and other objects are achieved by this invention will become more apparent from the following detailed description and the appended claims when read in conjunction with the accompanying drawings.

DETAILED DESCRIPTION OF THE INVENTION (1) The following is a list of abbreviations to be used in the description of this invention:

| Abbreviation | Word |
|---|---|
| CH | Channel ($U_1$, $U_2$, . . . , $S_2$ or 0–7) |
| AL | All mode designation signal |
| SL | Select mode designation signal |
| PR | Produce mode designation signal |
| RET | Reset signal |
| R/R | ROM to RAM designation signal |
| WT | Write mode designation signal |
| RD | Read mode designation signal |
| EX | Exchange mode designation signal |
| $CK_0$ | System clock (switched in WT, RD and other modes) |
| $CK_1$ | Clock pulse of an oscillator |
| $CK_{12}$ | Clock pulse recorded in a card |
| $cc_{1-3}$ | Channel codes |
| $CH_0(SCH_0)$—$CH_7(SCH_7)$ | Channel timing |
| $SH_0(PSH_0)$—$SH_{20}(PSH_{20})$ | Sampling timing |
| $EX_{1-4}$ | Timing designation signals in exchange mode |
| $D_{0-7}$ | Data code signals |
| $AD_{0-7}$ | Address code signals |
| $O_{0-25}(O_{0-0}$–$O_{7-25})$ | Sampling output signals |
| WPS | Card protection signal |
| SBO | Card loading signal |
| RSS | Reverse switch signal |
| WRC | Write and read control signal |
| RS | Reset signal for a card control device |
| WC | Write control signal |
| $RC_{1-3}$ | Channel code signals |
| FC | Finish code detection signal |
| $O_{A=B}$ | Coincidence signal |

(2) Construction and function of the invention

Figure 1:
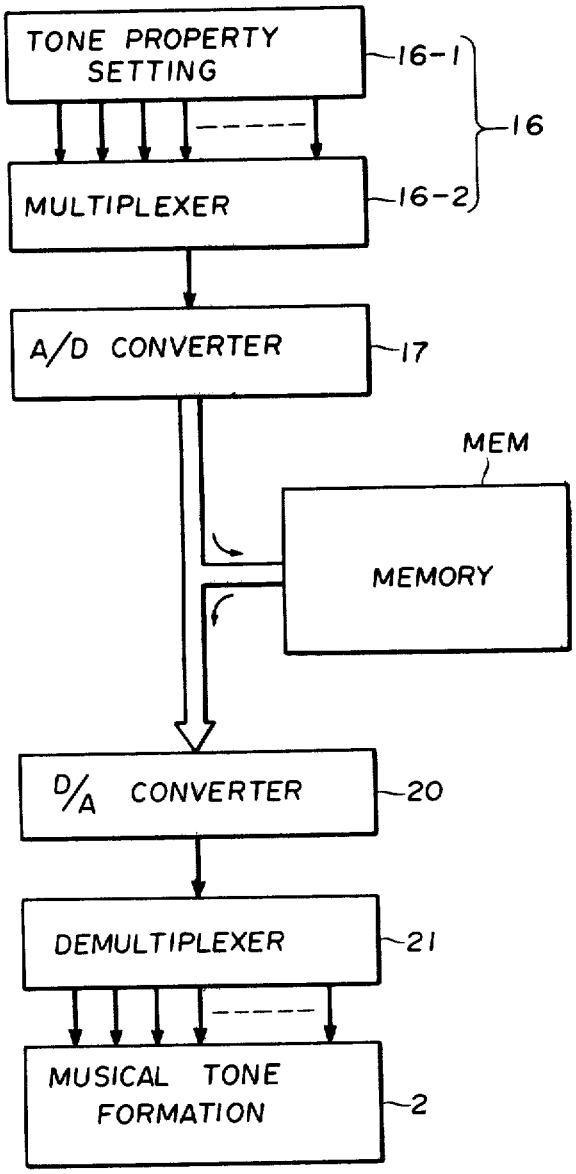
FIG. 1 is a block diagram showing the general arrangement of the present invention.

The general construction of the tone property control device incorporated with an electronic musical instrument is shown in FIG. 1. A plurality of tone property setting elements 16-1 such as potentiometers provide a set of analog signals (d.c. voltages) representing the properties of a musical tone intended by the instrument player. The analog signals are time-division multiplexed in a multiplexer 16-2. The tone property setting elements 16-1 and the multiplexer 16-2 are mounted in a tone property setting board 16. The multiplexed signal is then converted into digital words aligned in a time division multiplexed fashion through an analog-to-digital converter 17. The digital words are processed in a memory section MEM, wherein will be stored plural sets of digital words after plural times of hereinabove-described setting operations to be ready for selective use of the sets of the digital words. The selectively read-out set of digital words are converted into a time-division multiplexed analog signal in a digital-to-analog converter 20, and then demultiplexed into parallel analog signals by a demultiplexer 21. These analog signals are applied to a musical tone forming circuit 2 to determine the properties of the tones to be produced therein.

One embodiment of the invention in which the technical concept of the invention is applied to a music synthesizer will be described with reference to the accompanying drawings.

Figure 2:
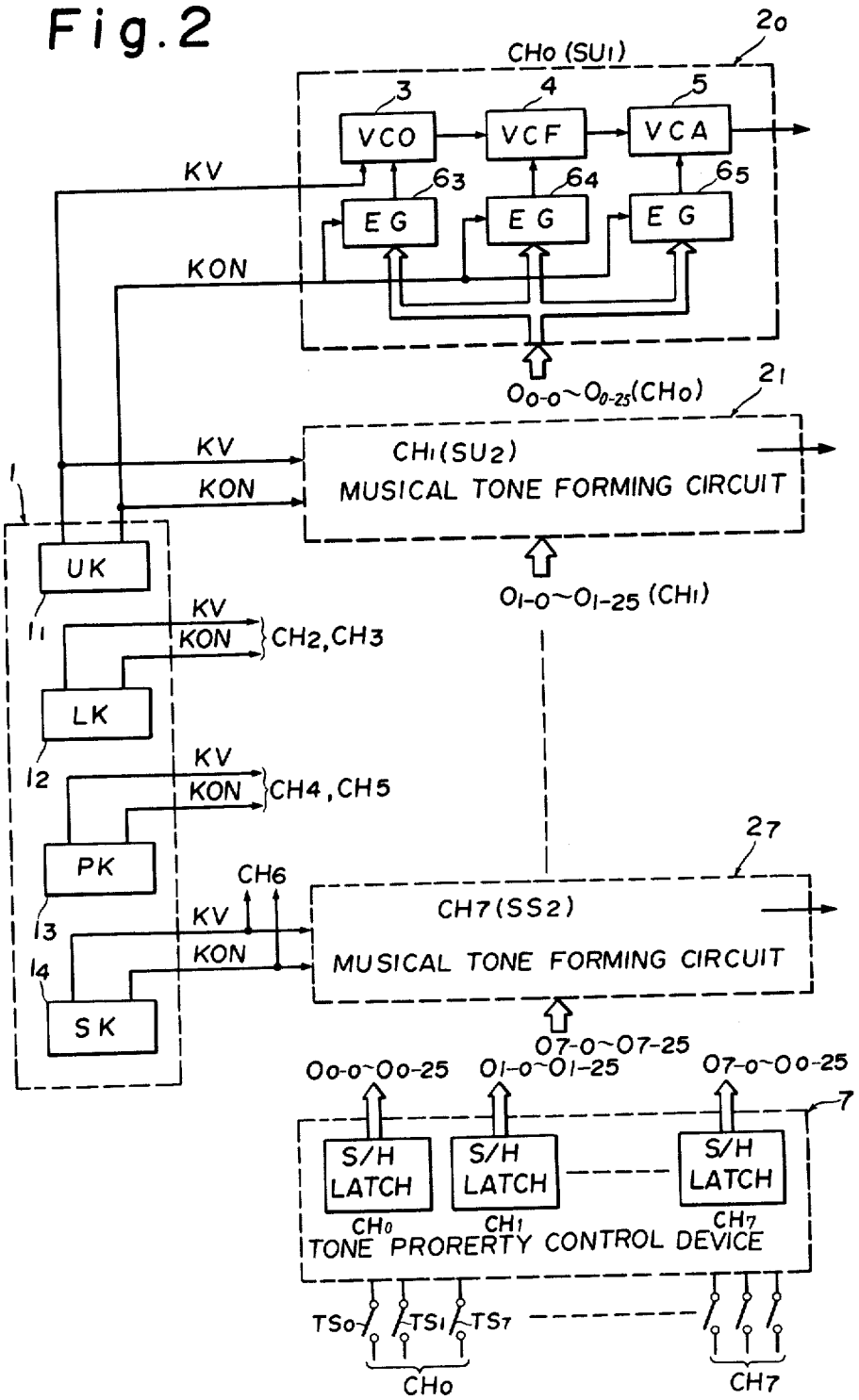
FIG. 2 is a block diagram showing the entire arrangement of an electronic musical instrument having a tone property control device according to this invention.

(2-1) Description of a block diagram (FIG. 2) illustrating essential sections of the music synthesizer FIG. 2 is a block diagram showing essential sections of the aforementioned music synthesizer. Referring to FIG. 2, a keyboard 1 comprises an upper keyboard $1_1$, a lower keyboard $1_2$, a pedal keyboard $1_3$, and a solo keyboard $1_4$, each of which has a plurality of keys (not shown). Two musical tone forming circuits (channels) are provided for each of the keyboards; that is, eight musical tone forming circuits (channels) $2_0$ through $2_7$ are provided in total. More specifically, the musical tone forming circuits $2_0$ and $2_1$ are provided for the upper keyboard $1_1$, and are hereinafter referred to as channel 0 ($CH_0$ or $U_1$) and channel 1 ($CH_1$ or $U_2$) respectively, when applicable. Similarly, the musical tone forming circuits $2_2$($CH_2$ or $L_1$) and $2_3$($CH_3$ or $L_2$); $2_4$($CH_4$ or $P_1$) and $2_5$($CH_5$ or $P_2$); and $2_6$($CH_6$ or $S_1$) and $2_7$($CH_7$ or $S_2$) are provided for the lower keyboard $1_2$, the pedal keyboard $1_3$, and the solo keyboard $1_4$, respective.

As is apparent from FIG. 2, tone pitch designating voltage signals KV and Key depression signals KON which are the output signals of the keyboards $1_1$ through $1_4$ are applied to the respective music tone forming circuits $2_0$ through $2_7$. The voltage signals KV are to cause a voltage-controlled variable frequency oscillator 3 (described later) to generate musical signals having oscillation frequencies (corresponding to tone pitches) which correspond respectively to keys depressed in the keyboards $1_1$ through $1_4$. The key depression signals, or trigger signals, KON are on-off signals which are provided when keys are depressed or released. The trigger signals KON are employed to trigger envelope generators (EG) $6_3$ through $6_5$ (described later). These envelope generators EG can generate envelope waveforms shown in FIG. 3, similarly as in the aforementioned prior art.

The musical tone forming circuits $2_0$ through $2_7$ are equal in construction. Therefore, the construction of the circuit $2_0$ will be described as a typical example. The circuit $2_0$ is made up of a voltage-controlled variable frequency oscillator (VCO) 3, a voltage-controlled variable filter (VCF) 4, and a voltage-controlled variable gain amplifier (VCA) 5 which are connected in series, and the aforementioned envelope generators $6_3$, $6_4$ and $6_5$ which are provided respectively for these elements 4, 5 and 6.

Hereinafter, for convenience in description various components and circuits employed in the invention will be expressed by their abbreviations which are indicated immediately thereafter in parentheses ( ) as above, when applicable.

As described in the foregoing, the VCO generates musical signals with oscillation frequencies corresponding to tone pitch voltage signal KV of depressed key. The musical signals thus generated are applied to the VCF. The VCF picks up signals having specified harmonic components out of the musical signals (i.e. the VCF modifies the musical signals) and sends them to the VCA.

The VCA operates to increase a modified musical tone signal as required (giving an envelope), and to apply its output signal to an amplifier and a loudspeaker (both not shown) which are provided commonly for all the channels so that a tone corresponding to a key depressed is produced by the loudspeaker. The VCO, VCF and VCA are controlled by control voltage waveforms (envelope waveforms) which are outputted by the EG's $6_3$, $6_4$ and $6_5$, respectively, which are triggered by the trigger signal KON outputted by the keyboard and are controlled by control signals $0_0$ through $0_{25}$ which are outputted to the channels $CH_0$ through $CH_7$ by a tone property control device 7.

This invention relates particularly to this tone property control device 7. The control signals $O_0$–$O_{25}$ outputted by the tone property control device 7 are applied to the EG's $6_3$, $6_4$ and $6_5$ to define the envelope waveforms (the shape of the control voltage), as a result of which the VCO, the VCF and the VCA are controlled in accordance with these envelope waveforms. The envelope waveforms outputted by the EG's $6_3$, $6_4$ and $6_5$ are voltage signals including an initial level (IL), an attack level (AL), a sustain level (SL), an attack time (AT), first and second decay times ($DT_1$ and $DT_2$), etc. to modify the musical tone signals which are produced in accordance with the pitch voltage signals KV, and are same as those described with reference to FIG. 3.

Figure 4:
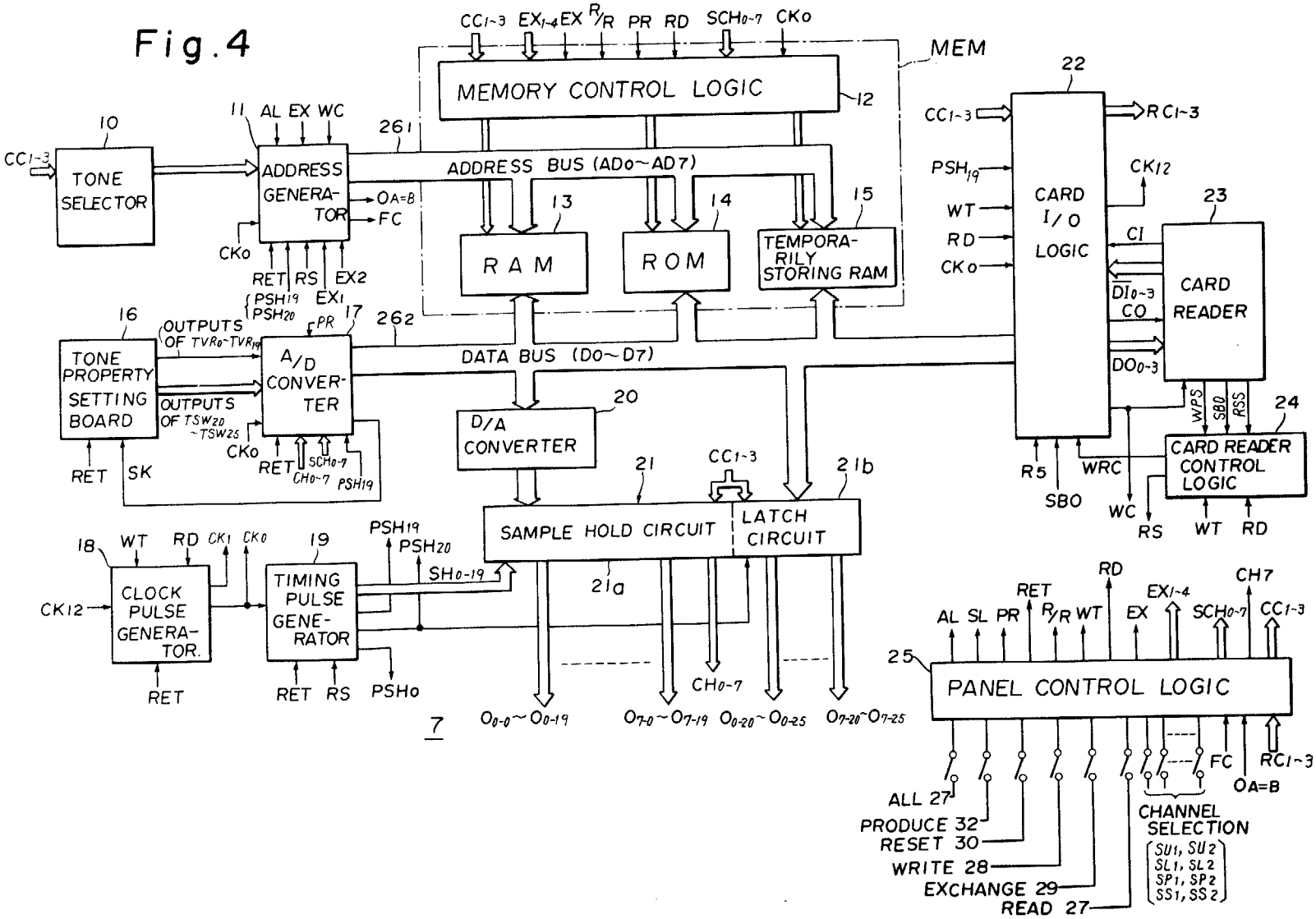
FIG. 4 is a block diagram illustrating the whole arrangement of the tone property control device shown in FIG. 2.

(2-2) Outline of the tone property control device 7 (FIG. 4)

The tone property control device 7 will be described in detail with reference to FIG. 4 and so forth. First of all, the entire construction of control device 7 will be briefly described with reference to FIG. 4. The tone property control device 7 serves to control the operation manner of the music synthesizer in accordance with eight operation modes (described later). In FIG. 4, a tone property setting board (or a tone property setting device 16 is to decide envelope waveforms to be applyed to the aforementioned EG's $6_3$ to $6_5$, and has a plurality of tone property controlling variable resistors (potentiometers) on a board by which the initial level, etc. of an envelope waveform can be set as desired. In addition to these tone property controlling variable resistors, a plurality of tone property effecting switches for giving a vibrato effect characteristic, etc. to a musical tone signal are provided on the tone property setting board 16. Musical tone forming analog information which is determined by the tone property controlling variable resistors on the tone property setting board 16 prior to performance (while the outputs of the tone property effecting switches are of digital information) is converted into digital information (a set of digital words) by an analog-to-digital (A/D) converter 17. The digital words thus obtained are introduced to a data bus $26_2$ connected to the memory section including a random access memory (RAM) 13, a read only memory (ROM) 14, a temporary RAM 15, a card memory in/out (I/O) logic and associated circuits for memory processing. In this example, the digital words are first written in a magnetic card (not shown) to compile plural sets, and then are read out from the magnetic card to be written into a random access memory (RAM) 13 which is an internal memory device. A read only memory (ROM) 14 which is another internal memory device is to store standard tone property information. When the music synthesizer is operated with the standard tone property information stored in the ROM 14, upon turning on of the power switch the standard tone property information in the ROM 14 is copied into the RAM 13 through the data bus $26_2$ being commanded by a memory control logic 12. Then, upon start of the performance, out of the pieces of information stored in the RAM 13, ones to be used as analog information in the musical tone forming circuits $2_0$ through $2_7$ of the channels $CH_0$ through $CH_7$ are delivered through the data bus $26_2$ to a digital-to-analog (D/A) converter 20 where they are converted into analog information. This analog information is held by a sample hold circuit 21*a*. On the other hand, out of the pieces of information stored in the RAM 13, ones to be used as digital information in the musical tone forming circuits $2_0$ through $2_7$ of the channels $CH_0$ through $CH_7$ are delivered through the data bus $26_2$ to a latch circuit 21*b* where they are latched in the form of digital information. Therefore, upon depression of a key in the keyboard 1, information corresponding to the output signal of the key is called from the sample hold circuit 21*a* and the latch circuit 21*b*, and is applied to the musical tone forming circuit ($2_0$–$2_7$) of the respective channel.

In the embodiment of the invention, an operation mode in which the contents of the ROM 14 are copied into the RAM 13 upon start of a performance (play) as described above will be referred to as "a ROM to RAM (R/R) mode", while an operation mode in which the contents of the RAM 13 are delivered to the sample hold circuit 21*a* and the latch circuit 21*b* to be ready for a performance will be referred to as "a performance mode". The aforementioned R/R mode is one of the specific features of this invention. If the power switch is turned on and the reset switch is operated, the R/R mode is switched over to the performance mode. In this performance mode, the on-off operation of a channel switch and a tone selection switch selected as desired will read the standard tone property information corresponding to the tone selection switch out of the RAM 13 for performance. Switching a performance on the standard tone property information over to a performance on tone property information other than the standard tone property information by using the magnetic card or the tone property setting board, or vice versa can be conducted in single-touch operation by operating a produce switch, etc. described later. This is another feature of this invention. The performance mode which is effected on tone property information other than the standard tone property information by using the tone property setting board as described above will be referred to as "a PR.$\overline{WT}$ mode" hereinafter. In this mode, the information which is obtained by operating the tone property controlling variable resistors and the tone property effecting switches on the tone property setting board is delivered directly to the sample-hold circuit 21*a* and the latch circuit 21*b* for performance. The pieces of analog information outputted by the above-described sample hold circuit 21*a*, that is, signals $O_{0\text{-}0}$ through $O_{0\text{-}9}$ are for the 0-th channel. Signals $CH_{0\text{-}7}$ are to specify the channels, and are obtained by decoding with a decoder channel codes $cc_{1\text{-}3}$ (formed by a panel control logic 25 described later). The digital signals outputted by the latch circuit 21*b*, that is, signals $O_{7\text{-}20}$–$O_{7\text{-}25}$ are for the 7th channel.

In order to write information in the RAM 13 or the ROM 14 or to read information out of it by addressing it, a tone selector 10 and an address generator 11 are provided. The tone selector 10 is provided with eight channel selecting switches $SU_1$, $SU_2$, $SL_1$, $SL_2$, $SP_1$, $SP_2$, and $SS_2$ provided in correspondence to the channels $CH_0$ through $CH_7$, and tone selecting switches (referred to as $TS_0$ through $TS_7$) under the control of the channel selecting switches. In this embodiment, the memory region of each of the RAM 13 and the ROM 14 provided for the channels is divided into eight blocks, each block adapted to store information for one set of tone properties defining a tone color in a wide meaning. If an optional tone selecting switch of an optional channel is operated, an address in the RAM 13 or the ROM 14 corresponding to this tone selecting switch is determined, and tone color information is write in or read out of the address as described above. The address signals $AD_0$ through $AD_7$ are delivered through the address bus $26_1$ to the RAM 13 and the ROM 14, and to a RAM 15 provided for an exchange (EX) mode described later.

The aforementioned EX mode, which is one of the specific feature of this invention, will be described. This EX mode is employed where the pieces of information stored in two blocks of the same channel or of different channels in the RAM 13 are exchanged with each other. In this mode, the pieces of information in the blocks are stored in different regions in the temporarily storing RAM 15, and the pieces of information thus stored are successively transferred, respectively, to the opposite side blocks where they have not been stored, whereby the pieces of information are exchanged with each other. The EX mode is effected by operating SELECT switches and EX switches of modes described later, and the relevant channel selecting switch and tone selecting switch. Thus, arrangement of tone property information corresponding to a tone selecting switch can be freely set to a most suitable condition.

In this invention, in order that the tone property information set by the tone property setting board 16 is stored in an external memory such as a magnetic card, or the tone property information thus stored in the magnetic card is read to be stored in the RAM 13 so that it can be used for a performance, or in contrast the information in the RAM 13 is stored in the magnetic card, a card input/output (I/O) logic 22, a card reader 23, and a card reader control logic 24 are provided. In this embodiment, an operation in which tone property information set by the above-described PR.WT mode is delivered through the data bus $26_2$ to the card I/O logic 22 so as to be recorded in a magnetic card, is referred to as "a PR.WT mode". In this embodiment, information for one set of tone properties is recorded in the magnetic card by one PR.$\overline{WT}$ mode operation. Accordingly, in recording information for eight sets of tone properties (corresponding to the information for one channel in the case of the embodiment) in the magnetic card, whenever one recording is completed, the positions of the nobs of the tone property controlling variable resistors and the tone property effecting switches on the tone property setting board 16 are changed to obtain desired tone property information, and then a writing switch (referred to as "a WRITE") is operated to write it in the magnetic card; that is, this operation is repeated eight times. In other words, the PR.WT mode and the PR.$\overline{WT}$ mode are continuously effected eight times. If, in the case where pieces of information for eight tone colors have been recorded in eight magnetic cards by repeating the above-described operation, it is required to record these pieces of information in one magnetic card, the pieces of information in the eight magnetic cards may be written in the RAM 13 once, so that they are recorded in one magnetic card by reading them out of the RAM 13.

Furthermore, in this invention, as was described above, the information in the RAM 13 is recorded in the magnetic card, or the information in the magnetic card is written in the RAM 13. In this connection, this operation is carried out for all the eight blocks of a channel, or it is carried out for only one block of a channel. Therefore, there are three additional operating modes: a WT.AL mode, a RD.SL mode, and a RD.AL mode. In the WT.AL mode, pieces of information for eight tone colors of one channel in the RAM 13 are recorded in one sheet of magnetic card. In the RD.SL mode, the information for one tone color recorded in the magnetic card is written in an optional block of an optional channel. In the RD.AL mode, the pieces of information for eight tone colors are recorded in the magnetic card are written in a channel of the RAM 13.

As was described above, a number of sets of tone property information are recorded in a number of magnetic cards prior to performance. Accordingly, in the performance, if a desired magnetic card is selected to be read by the card reader 23, then the desired tone color information can be quickly set in the RAM 13, and therefore the performance on the tone property information can be effected. Furthermore, in this case, the tone property information which is analog data is converted into the tone property information which is digital data, so as to be stored in a memory such as a magnetic card. Therefore, the record can be readily and accurately maintained when compared with the case where the tone property information which is analog data is stored.

A memory control logic 12 is a circuit which controls writing tone property information in the RAM 13, ROM 14 and RAM 15 and reading tone property information out of these memories. In these writing and reading operations, addresses are specified.

A panel control logic 25 operates to form various instruction signals from signals which are outputted by instruction buttons and switches which are operated in carrying out the above-described R/R mode, performance mode, PR.Wt mode, PR.$\overline{WT}$ mode, EX mode, WT.AL mode, RD.SL mode and RD.AL mode. The instruction signals thus formed are applied to various circuits of the tone properties control device 7 to control the operations of these various circuits.

Furthermore, the operations of the circuits in the tone property control device 7 are controlled by a clock pulse having a reference frequency outputted by a clock pulse generator 18 and by various timing signals which are formed by a timing pulse generator 19 with the aid of the clock pulse outputted by the clock pulse generator 18.

(2-3) Detailed Description of the Various Circuits in the Tone Property Control Device 7

Now, the various circuits in the tone property control device 7 will be described in detail with reference to the accompanying drawings.

Figure 5:
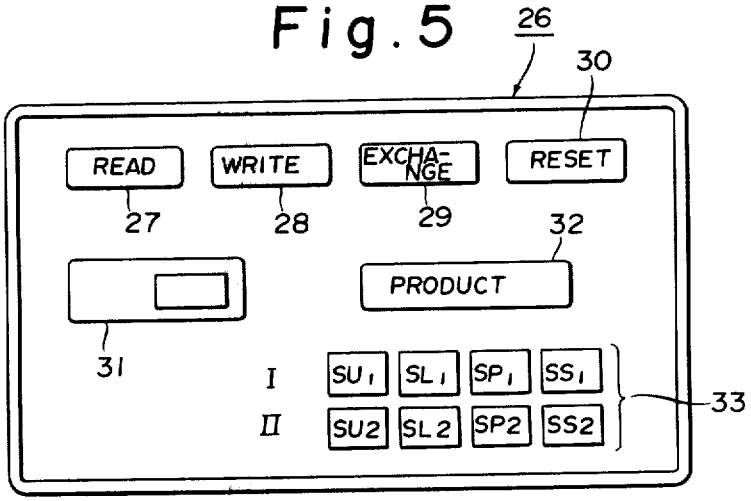
FIG. 5 is a plan view showing an operating panel of the tone property control device.

FIG. 5 is a plan view showing an operating panel 26 provided in the vicinity of the keyboard 1. Provided on the operating panel 26 are various instruction switches which are operated to carry out the above-described eight operation modes. A read switch (READ) 27 is operated in the RD.SL mode or in the RD.AL mode, whereupon the tone property information in a magnetic card is written in the RAM 13. A write switch (WRITE) 28 is operated in the PR.WT mode or in the WT.AL mode, whereupon the tone color information in the RAM 13 is written in a magnetic card. An exchange switch (EXCHANGE) 29 is operated in the EX mode. A reset switch (RESET) 30 is operated when the R/R mode is started. Upon operation of the reset switch 30, a reset signal (RET) is produced to reset the flip-flops or counters in the circuits shown in FIG. 4 whereby the initial states thereof are maintained. An all select switch (ALL SELECT) 31 is a slide switch as shown in FIG. 5. If this switch 31 is slid right, then a select instruction (SL) is provided, and if this switch 31 is slid left, then an all instruction (AL) is provided. Accordingly, the all select switch 31 is operated in the above-described PR.$\overline{WT}$ mode, RD.SL mode, WT.AL mode, RD.AL mode and EX mode. A produce switch (PRODUCE) 32 is operated in the PR.$\overline{WT}$ mode. Two channel selecting switches 33 are provided for every keyboard; that is, eight channel selecting switches 33 are provided in total. In the EX mode, these channel selecting switches $SU_1$, $SU_2$ . . . $SS_2$ are used in such a manner that two switches are simultaneously brought to be in "on" state. The above-described various switches other than the all select switch 31 may be push-on and push-off type switches. The switch of this type is turned on by the initial or first depression, and is turned off by the second depression, and so forth. Especially, the read switch 27, the write switch 28, the exchange switch 29, and the reset switch 30 may be of the self-returning type.

(2-4) Detailed Description of the Panel Control Logic 25

Figure 6:
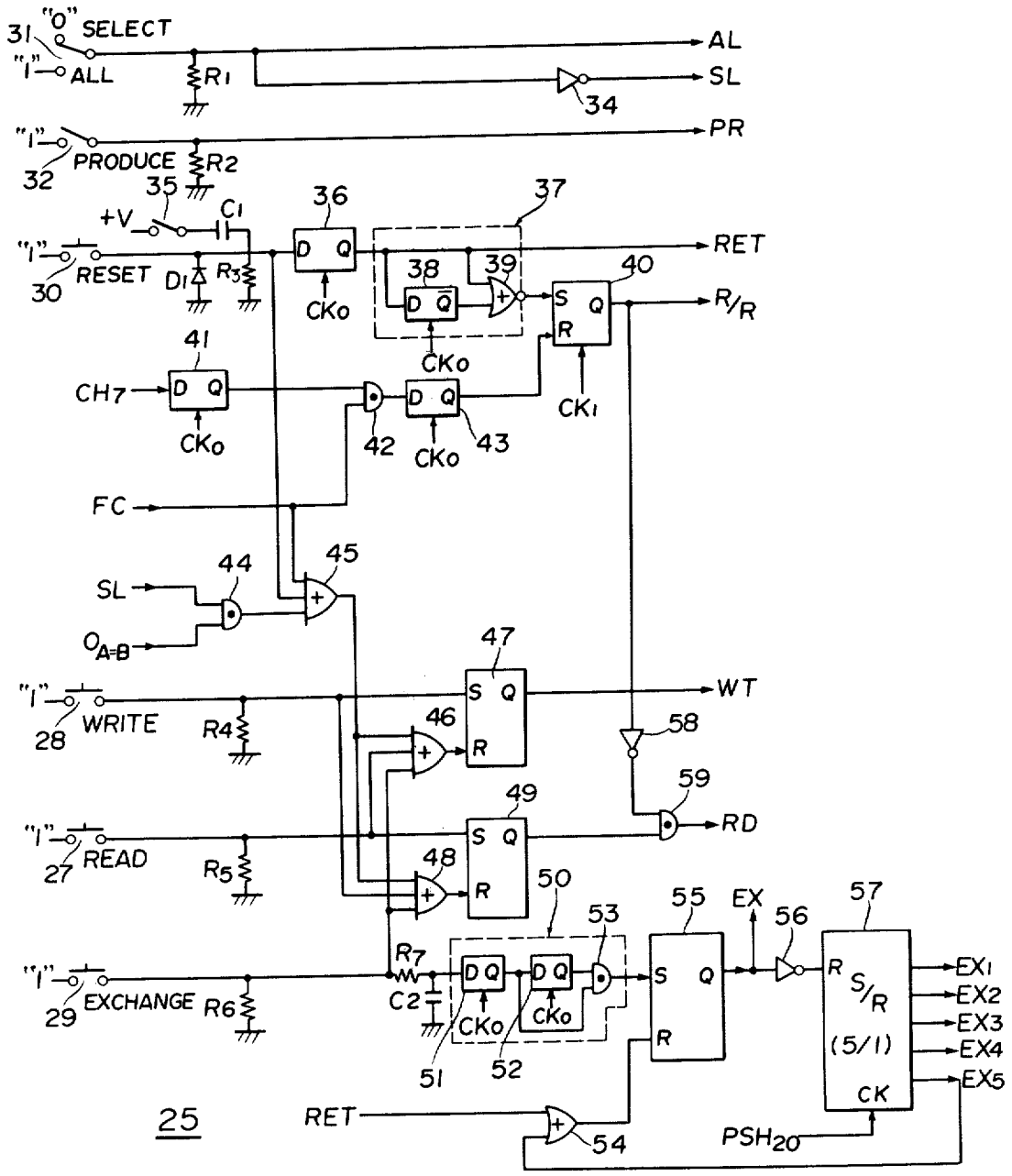
FIG. 6 and FIG. 7 are two part of a panel control logic 25 shown in FIG. 4.

The arrangement of the panel control logic 25 will be described with reference to FIGS. 6 and 7.

First, referring to FIG. 6, an instruction signal forming circuit will be described. The output terminal, on the "all" side, of the all select switch 31 is connected to one terminal of a resistor $R_1$ the other terminal of which is grounded and to the input terminal of an inventer 34. When the "all-select" switch 31 is set to the "all" side, an output voltage at a binary logic "1" is developed across the resistor $R_1$. This signal will be referred to as "AL". When the switch 31 is set to the "select" side, no output voltage is developed across the resistor $R_1$, as a result of which a signal at the "1" level is provided at the output terminal of the inventer 34. This signal will be referred to as "SL". The terminal of a resistor $R_2$ the other terminal of which is grounded. Accordingly, when the produce switch 32 is turned on, a voltage is developed across the resistor $R_2$, which will be referred to as "PR".

Now, the signal RET and R/R forming circuit will be described. The output terminal of a power switch 35 is connected through a capacitor $C_1$ to the input terminal of a Delayed-type (D-type) flip-flop 36. Hereinafter, a flip-flop will be abbreviated into "FF". The output terminal of the reset switch 30 is connected to one terminal of a resistor $R_3$, the cathode of a diode $D_1$ and the input terminal of the D-type FF 36. The supply voltage is a positive DC voltage. The D-type FF 36 is driven by the clock pulse $CK_0$ outputted by the clock pulse generator 18 described later. The set output terminal Q of the FF 36 is connected to the input of a D-type FF 38 and to a first input terminal of a NOR gate 39 which are included in a pulse forming circuit 37. The reset output terminal $\overline{Q}$ of the D-type FF 38 is connected to the second input terminal of the NOR gate 39, while the output terminal of the NOR gate 39 is connected to the set input terminal S of an RS-type FF 40. The FF 38 is driven by the clock pulse $CK_0$, while the FF 40 is driven by the output pulse $CK_1$ of an oscillator in the clock pulse generator 18. (This clock pulse $CK_1$ is applied to various circuits in the device; however, it will not be referred to in the following description.) The timing signal $CH_7$ is applied to a D-type FF 41, the set output terminal Q of which is connected to a first input terminal of an AND gate 42, to the second input terminal of which a signal FC is applied. The output of the AND gate 42 is connected to the input of a D-type FF 43, the output terminal Q of which is connected to the reset input terminal R of the aforementioned RS-type FF 40. The timing signal $CH_7$ is obtained from the channel code signals $cc_1$–$cc_3$ when "1" level outputs are provided by the latter. Furthermore, the channel code signals $cc_1$–$cc_3$ are for timing of the 7th channel. The signal FC (finish code) is outputted immediately before a program counter 169 (described later) of the address generator 11 is periodically reset. Both of the FF's and 41 and 43 are driven by the clock pulse $CK_0$.

Figure 8:
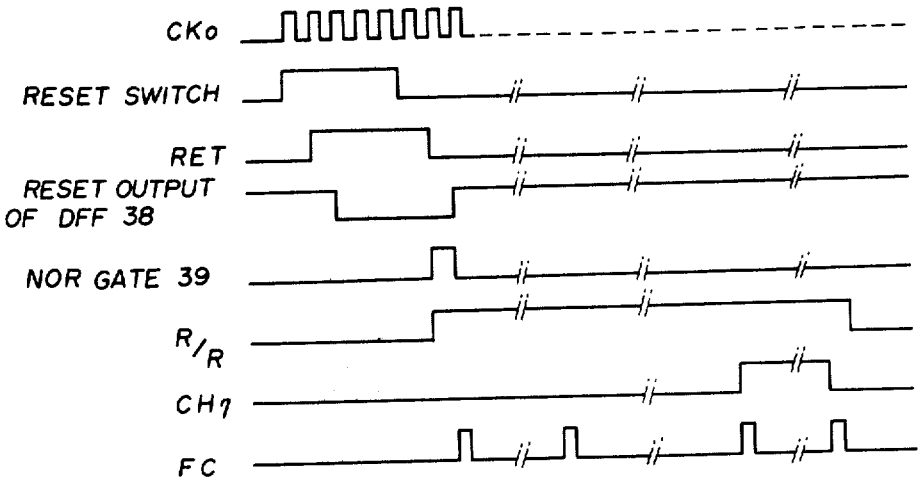
FIG. 8 shows waveforms for a description of the operation of a pulse forming circuit 37 in the panel control logic 25.

The operation of the signal RET and R/R forming circuit will be described with reference to the time chart indicated in FIG. 8. When the power switch 35 is turned on and then the reset switch 30 is depressed once, the signal RET is outputted by the set output terminal Q of the FF 36 slightly later than the output of the reset switch 30 because of a $C_1R_3$ time constant circuit. When the signals at the two input terminals of the NOR gate 39 are at "0" level, the RS-type flip-flop 40 is placed in a set state, the signal R/R is outputted. On the other hand, the timing signal $CH_7$ and the signal FC are as indicated in FIG. 8. Therefore, when both of the signal $CH_7$ and FC are at "1" level, a signal "1" is outputted by the AND gate 42. This output signal is applied to the reset input terminal R of the FF 40 after being delayed by the FF 43. In this case, the signal R/R is inverted to have "1" level.

A signal WT, RD and EX forming circuit will be described. The output terminal of the write switch 28 is connected to one terminal of a resistor $R_4$ the other terminal of which is grounded, to the set input terminal S of an RS-type FF 47, and to a first input terminal of a 3-input OR gate 48. The set output signal of the FF 47 is referred to as "a signal WT". The output terminal of the read switch 27 is connected to one terminal of a resistor $R_5$ the other terminal of which is grounded, to a first input terminal of a 3-input OR gate 46, and to the set input terminal S of an RS-type FF 49. The set output terminal Q of the FF 49 is connected to a first input terminal of an AND gate 59, to the second input terminal of which the set output terminal Q of the aforementioned FF 40 is connected through an inventer 58. The output signal of the AND gate 59 is referred to as "a signal RD". The output terminal of the exchange switch 29 is connected to one terminal of a resistor $R_6$ the other terminal of which is grounded, and to the second input terminals of the OR gates 46 and 48. The output terminal of the switch 29 is further connected through a resistor $R_7$ to one terminal of a capacitor $C_2$ the other terminal of which is grounded, and to the input terminal of a D-type FF 51 included in a pulse forming circuit 50. The set output terminal Q of the FF 51 is connected to the input terminal of another D-type FF 52, and to a first input terminal of an AND gate 53, to the second input terminal of which the reset output terminal $\overline{Q}$ of the FF 52 is connected. The output terminal of the AND gate 53 is connected to the set input terminal S of a RS-type FF 55. Both of the FF's 51 and 52 are driven with the aid of the clock pulse $CK_0$. The set output terminal Q of the FF 55 is connected through an inverter 56 to the reset input terminal R of a 5-stage/1-bit shift register 57, the set output signal of which is referred to as "a signal EX". The shift register 57 is driven by a pulse signal $PSH_{20}$ formed by a timing pulse generator 19 descirbed later, and the initial state of the shift register 57 is such that the first through fifth bits are of "0". When the aforementioned pulse forming circuit 50 outputs a pulse, the FF 55 outputs the signal EX("1") with the aid of this pulse. The signal EX is applied through the inverter 56 to the shift register 57 to reset the latter. Whenever the pulse signal $PSH_{20}$ is applied to the shift register 57, the content "1" of the shift register 57 is shifted to the following bit in the order of the first bit, the second bit, the third bit and so on. When the content of the fifth bit has "1" in this manner, the FF 55 is reset through an OR gate 54, as a result of which the output of the inventer 56 has "1". Thus, the shift register 57 is reset to its initial state. In this connection, the output signals of the first through fifth bits will be referred to as "signals $EX_1$, $EX_2$, $EX_3$, $EX_4$ and $EX_5$", respectively. The output states of the above-described signals EX, $EX_1$ through $EX_5$ and $PSH_{20}$ are as indicated in FIG. 8. The output interval of the signal $PSH_{20}$, that is, the pulse width of each of the signals $EX_1$ through $EX_4$ is equal to the length of information for one tone color (20 bits) i.e. one set of tone properties in this embodiment. The signal $EX_5$ and a reset signal RET are to reset the FF 55.

The FF 47 and the FF 49 can be reset by another reset signal. This will be described more specifically. The output terminal of the reset switch 30 is connected to one input terminal of an OR gate 45. A signal FC is inputted into a second input terminal of the OR gate 45. Signals SL and $O_{A=B}$ are applied to an AND gate 44, and the output $SL.O_{A=B}$ of the AND gate 44 is applied to the OR gate 45. The output of the OR gate 45 is applied through the third input terminals of the OR gate 46 or 48 to the FF 47 or the FF 49, as a result of which the FF 47 or 49 is reset.

The operation obtained when the switches 27 through 29 are operated will be described.

Upon depression of the write switch 28 once, the FF 47 is set by the voltage developed across the resistor $R_4$, as a result of which the set output signal, or a signal WT, of the FF 47 is raised to "1". Even after the depression of the write switch 28 is suspended, the signal WT is maintained at "1". When one of the output of the reset switch 30, the signal FC, the signal $SL.O_{A=B}$, the output of the read switch 27, and the output of the exchange switch 29 is applied to the reset input terminal R of the FF 47, the FF 47 is reset, as a result of which the signal WT is inverted to "0".

In the case of the read switch 27, the FF 49 is set upon depression of the switch 27 once, similarly as in the above-described case, as a result of which the set output thereof is raised to "1". In this embodiment, the generation of the signal RD is inhibited during the provision of the above-described signal R/R. Therefore, even if the read switch 27 is depressed during this period, the AND gate 59 is maintained closed, and no signal RD is outputted. If the signal R/R is not outputted, the AND gate 59 is opened, and the signal RD is raised to "1" with the aid of the set output signal of the FF 49. This state is maintained unchanged until the FF 49 is reset. When one of the output of the reset switch 30, the signal FC, the signal SL.$O_{A=B}$, the output of the write switch 28, and the output of the exchange switch 29 is applied to the reset input terminal R of the FF 49, the latter 49 is reset, and the signal RD is therefore lowered to "0".

When the exchange switch 29 is depressed once, the capacitor is gradually charged as indicated in FIG. 8. When the charge voltage of the capacitor reaches a predetermined value, it is applied as a "1" signal to the FF 51. Then, as soon as the next clock pulse $CK_0$ is applied to the FF 51, a single pulse is outputted by the AND gate 53 and is applied to the set input terminal S of the RS-type FF 55. As a result, the signal EX is outputted through the output terminal Q of the FF 55. Simultaneously, this signal EX is applied, as a "0" signal, to the reset input terminal R of the shift register 57. Therefore, the reset state of the register 57 is released, that is, the operation of the shift register 57 is started. As was described before, the shift register 57 is driven by the pulse signal $PSH_{20}$ to successively output the timing signals $EX_1$ through $EX_5$. These timing signals are utilized in the exchange mode to write the information of two blocks to be exchanged in the memories (RAM 13, and RAM 15) and to read it out of the memories. Upon application of the signal $EX_5$ or the signal RET, the FF 55 is reset, and its reset output is lowered to "0". This "0" output signal is inverted by the inverter 56 and is then applied to the reset input terminal R of the shift register 57. As a result, the shift register 57 is reset, and the initial state is obtained, that is, all of the contents thereof become "0". The above-described signal $O_{A=B}$ is formed by the address generator 11, and it is outputted when the two inputs to a comparator 161 coincide with each other as described later.

Figure 7:
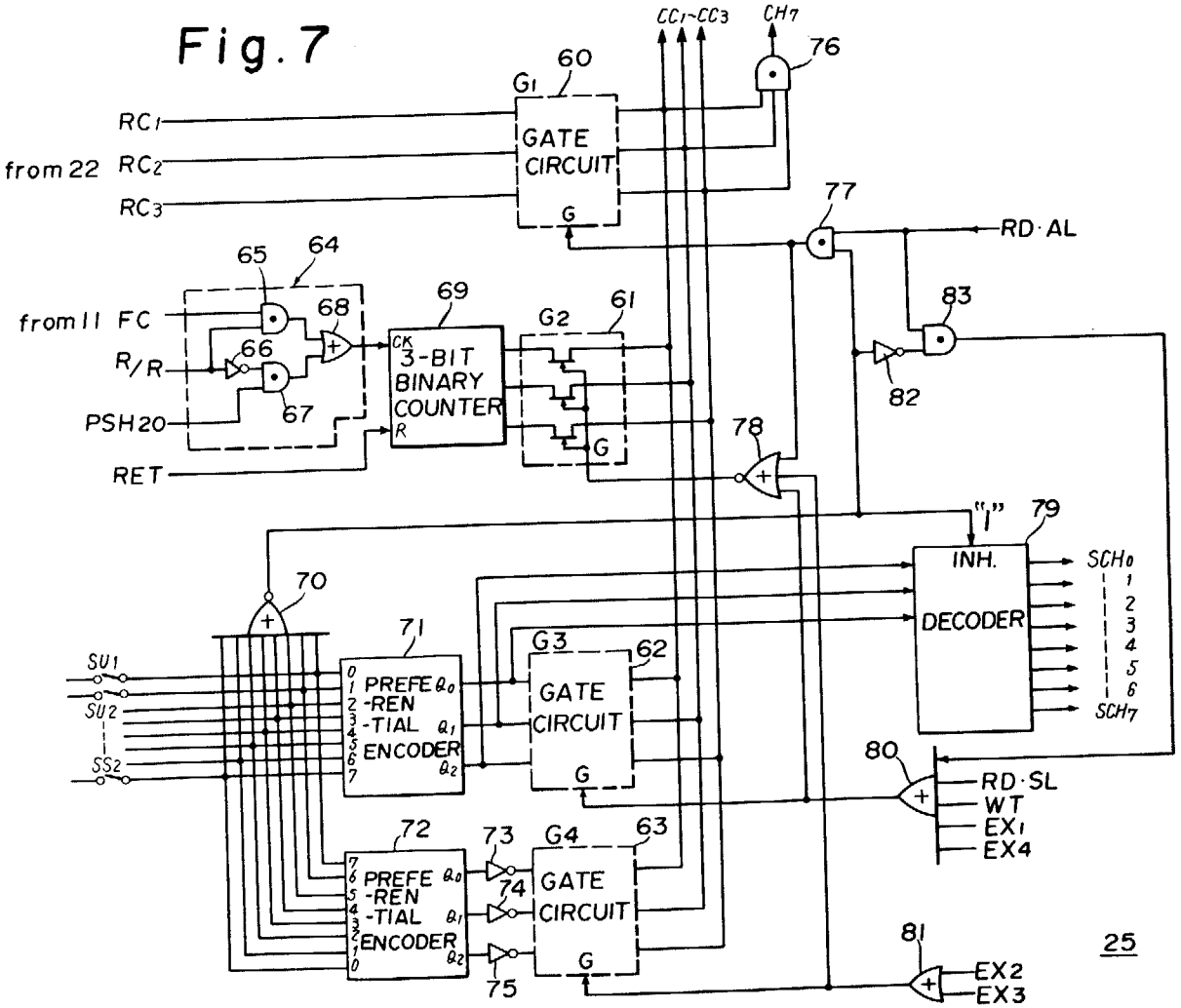

Referring to FIG. 7, a circuit forming the channel codes $CC_1$ through $CC_3$, the channel timing signals $SCH_0$ through $SCH_7$ and the signal $CH_7$ will be described. Four gate circuits 60, 61, 62 and 63 (hereinafter referred to gate circuits $G_1$, $G_2$, $G_3$ and $G_4$ when applicable) are equal in construction to one another. Each gate circuit is made up of three junction type N-channel field-effect transistors (FET's), the gate terminals of which are connected together. Upon application of a signal to these three gate terminals of the FET's, the gate circuits $G_1$, $G_2$, $G_3$ and $G_4$ are opened respectively. The channel codes $RC_1$ through $RC_3$ (which are signals read out of the magnetic card) from the card I/O logic 22 (FIG. 4) are applied to the drain terminals of the respective FET's, and when a signal is applied to the gate G of the gate circuit $G_1$, they are outputted as the channel codes $CC_1$ through $CC_2$ from the respective source terminals. The source terminals of the FET's in the gate circuit $G_1$ are connected to the input terminals of a three-input AND gate 76. Therefore, when all the 3-bit channel codes $RC_1$ through $RC_3$ are at "1" (7th channel), an output signal is produced by the AND gate 76. This output signal is employed as the aforementioned channel signal $CH_7$.

The output of an AND gate 77 is applied to the gate G of the gate circuit $G_1$. The input signals to the AND gate 77 are the signal RD.AL (the logical product of the signals RD and AL) and the output of a NOR gate 70 described later. Applied to the NOR gate 70 are the output signals of the above-described channel selecting switches $SU_1$, $SU_2$, $SL_1$, $SL_2$, $SP_1$, $SP_2$, $SS_1$ and $SS_2$. Therefore, when no channel switch is depressed, a "1" level signal is outputted by the NOR gate 70. When the all select switch 31 is set to the ALL side, and the read switch 27 is depressed, and furthermore no channel switch is depressed, that is, in the RD. AL mode, the output signal of the AND gate 77 is applied to the gate circuit $G_1$, as a result of which the gate circuit $G_1$ is opened and the channel code signals $CC_1$ through $CC_3$ are outputted by the gate circuit $G_1$. When the channel codes $RC_1$–$RC_3$ are for the 7th channel, the channel signal $CH_7$ is outputted.

When the gate circuits $G_1$, $G_3$ and $G_4$ are inoperative state, that is, in the R/R mode, and in the performance state after this R/R mode, the gate circuit $G_2$ is opened to output the channel codes $CC_1$–$CC_3$ and the channel signal $CH_7$. In other words, the signal FC and the signal R/R are applied to an AND gate 65 in a pulse forming circuit 64. The output of the AND gate 65 is introduced through an OR gate 68 to an octal (3-bit binary) counter 69 and it is employed as the clock pulse signal of this counter 69. A signal obtained by inverting the signal R/R by an inverter 66 and the signal $PSH_{20}$ are applied to an AND gate 67. The output of the AND gate 67 is applied through the OR gate 68 to the counter 69, and it is employed as the clock pulse signal of the counter 69. The counter 69 is reset by the reset signal RET. The digit output terminals of the counter 69 are connected to the drain terminals of the respective FET's in a gate circuit 61, and the source terminals of the FET's are connected to the AND gate 76. The gate G of the gate circuit $G_2$ is connected to the output terminal of a NOR gate 78. Applied to the input terminals of the NOR gate 78 are the output of the AND gate 77, the signals $EX_2$ and $EX_3$ through an OR gate 81, the signals RD.SL, WT, $EX_1$ and $EX_4$ through an OR gate 80, and the output of the AND gate 83 through the OR gate 80. The signal RD.AL is applied to the AND gate 83, and the output of the NOR gate 70 is applied through an inverter 82 to the NOR gate 70. Accordingly, the operation is carried out according to the time chart shown in the part (A) of FIG. 10. That is, in the R/R mode, when the reset switch 30 is depressed, the counter 69 is reset to its initial state, the contents of which is lowered to the "0" level.

Hereinafter, the "0" level and the "1" level will be referred to merely as "0" and "1", respectively, for simplification in description.

As soon as the signal RET is lowered to "0" upon release of the reset switch 30, the signal R/R is raised to "1", as a result of which, whenever the signal FC is outputted, a signal in synchronization with the signal FC is outputted by the AND gate 65 and is applied, as a clock pulse, to the counter 69 through the OR gate 68. Therefore, the operation of the counter 69 is started, and the digit outputs of the counter 69 are applied to the gate circuit $G_2$. On the other hand, in this operation, the "1" output of the NOR gate 78 (because all the three inputs of the NOR gate 78 are at "0" in the R/R mode) is applied to the gate G of the gate circuit $G_2$, as result of which the gate $G_2$ is opened. Thus, the outputs of the counter 69 are outputted as the channel codes $CC_1$–$CC_3$. Then, upon completion of the R/R mode, the AND gate 67 is opened, and thereafter the counter 69 is driven by the pulse signal $PSH_{20}$ (refer to FIG. 8, and the part (B) of FIG. 10). It goes without saying that in this case also the gate circuit $G_2$ has been opened, similarly as in the R/R mode the outputs of the counter 69 are outputted as the channel codes $CC_1$–$CC_3$, and therefore the performance can be effected. When the contents of the counter 69 become the digit "7" (1 1 1), the channel signal $CH_7$ is outputted by the AND gate 76.

The gate circuit $G_3$ operates to output the channel codes $CC_1$–$CC_3$ and the channel signal $CH_7$ corresponding to the channel selecting switches $SU_1$–$SS_2$ which are operated when the musical tone information is readed out of the magnetic card (that is, in RD.SL mode and in the RD.AL mode) or when it is written therein (that is, in the WT.SL mode and in the WT.AL mode). Furthermore, the gate circuit $G_3$ together with the gate circuit $G_4$ operates to output the code signals $CC_1$–$CC_3$ and the channel signal $CH_7$ corresponding to the channel selecting switches which are successively operated, in the EX mode. In this embodiment, as was described before, two of the channel selecting switches $SU_1$, $SU_2$ . . . $SS_2$ are operated in the EX mode. Priority encoders 71 and 72 for determining the priority order of the depressed channel selecting switches are provided. Thus, when two channel selecting switches are depressed simultaneously, the channel codes $CC_1$–$CC_3$ corresponding to the switch higher in priority order are outputted by the gate circuit $G_3$, while the channels codes $CC_1$–$CC_3$ corresponding to the switch lower in priority order are outputted by the gate circuit $G_4$.

More specifically, the output signals of the channel selecting switches $SU_1$, $SU_2$ . . . $SS_2$ are applied to the input terminals 0, 1, 2, . . . 7 of the preferential encoder 71, respectively, and to the input terminals 7, 6, . . . 0 (the arrangement order being opposite) of the preferential encoder 72. In the preferential encoder 71, the switch lower in the channel number takes precedence electrically. In the preferential encoder 72, the switch higher in channel number takes precedence electrically. The output signals at the output terminals $Q_0$, $Q_1$ and $Q_2$ of the preferential encoder 71 are applied to the gate circuit $G_3$, while the output signals of the output terminals $Q_0$, $Q_1$ and $Q_2$ of the preferential encoder 72 are applied respectively through interters 73, 74 and 75 to the gate circuit $G_4$. The output signals of the aforementioned OR gates 80 and 81 are applied to the gates of the gate circuits $G_3$ and $G_4$, respectively. The output signals at the output terminals $Q_0$, $Q_1$ and $Q_2$ of the preferential encoder 71 are applied to a decoder 79, where they are decoded to form the respective channel timing signals $SCH_0$–$SCH_7$. The output of the above-described NOR gate 70 is applied to the inhibition input terminal of the decoder 79. Therefore, when no channel selecting switch is operated, the operation of the decoder 79 is inhibited.

When one channel selecting switch, for instance, the switch $SU_2$ (first channel) is depressed, the output signal of the switch $SU_2$ is applied to the input terminal 1 of the preferential encoder 71 and to the input terminal 6 of the priority encoder 72, as a result of which an output signal "0 0 1" (binary number: $Q_0=1$, $Q_1=0$, and $Q_2=0$) is provided by the preferential encoder 71 and is applied to the gate circuit $G_3$. On the other hand, an output signal "1 1 0" is provided by the priority encoder 72. This signal is inverted by the inverters 73, 74 and 75 into "0 1 1" which is applied to the gate circuit $G_4$. As is apparent from the above description, when one channel selecting switch is operated, the same signal is applied to the gate circuits $G_3$ and $G_4$. However, since the gate circuit $G_4$ is opened in the EX mode only (because the signals $EX_2$ and $EX_3$ are applied to the gate G thereof), the channel codes $CC_1$–$CC_3$ are outputted by the gate circuit $G_3$ in modes other than the EX mode. In the above-described case, the output of the NOR gate is at "0" and this "0" signal releases the inhibition of the decoder 79, and therefore the decoder 79 is operated to output the channel timing signal $SCH_1$.

When two channel selecting switches, for instance, the switch $SU_2$ (1st channel) and the switch $SP_1$ (4th channel) are depressed in the EX mode, the output signal of the switch $SP_1$ is applied to the preferential encoder 72. As a result, the output of the preferential encoder 71 is 0 0 1", and this signal "0 0 1" is applied to the gate circuit $G_3$. The output signal of the switch $SP_1$ is applied also to the input terminal 3 of the preferential encoder 72, as a result of which the output of the preferential encoder 72 becomes "O 1 1". This output signal "0 1 1" is inverted by the inverters 73, 74 and 75 into "1 1 0" which is applied to the gate circuit $G_4$. Thus, the switch $SU_2$ (1st channel) is selected in the gate circuit $G_3$, while the switch $SP_1$ (4th channel) is selected in the gate circuit $G_3$. Therefore, when the signals $EX_1$ and $EX_4$ are outputted, the gate circuit $G_3$ is opened, and the channel codes $CC_1$–$CC_3$ corresponding to the first channel are outputted. Similarly, when the signals $EX_2$ and $EX_3$ are outputted, the gate circuit $G_4$ is opened, so that the channel coes $CC_1$–$CC_3$ corresponding to the fourth channel are outputted. Thus, the EX mode is carried out. When two channel selecting switches are simultaneously depressed in a mode other than the EX mode, the output signal of the switch higher in priority order is applied to the gate circuit $G_4$; however, as the gate circuit $G_4$ is closed in a mode other than the EX mode, it is substantially disregarded, that is, this case is equal to the case where the switches are not operated.

(2-5) Detailed Description of the Clock Pulse Generator 18 and the Timing Pulse Generator 19

The arrangement of the clock pulse generator 18 and the timing pulse generator 19 will be described with reference to FIG. 11.

An oscillator 85 outputs a reference pulse (frequency 100 KHz), which is employed, as a clock pulse, for various circuits (such as flip-flops) in this embodiment and is applied to a frequency divider 86 and a NAND gate 87. The frequency divider 86 outputs a pulse signal having a frequency of 390 Hz, which is applied to a NAND gate 88. The output of a NOR gate 92, receiving the signals WT and RD, is applied, as a regulating signal, to the NAND gate 87. The signal WT is applied to the NAND gate 88 as a regulating signal. An AND gate 90 receives the clock pulse $CK_{12}$ read out of the magnetic card, and furthermore receive the signal RD as its regulating signal. The outputs of the NAND gates 87 and 88 are outputted, as a system clock pulse $CK_0$, through a NAND gate 89 and an OR gate 91. The output of the AND gate 90 is outputted, as the system clock pulse $CK_0$, through the OR gate 91. The frequency divider 86 comprises a counter circuit. Upon application of the reset signal RET to the reset terminal R, the frequency divider 86 is reset, whereby the operation thereof is stopped. In the arrangement thus organized, while the signal RD is outputted (in the RD.SL mode, and the RD.AL mode), the regulated state of the AND gate 90 is released, and therefore the clock pulse $CK_{12}$ read out of the magnetic card is outputted as the system clock pulse $CK_0$. While the signal WT is outputted (in the WT.SL mode, and the WT.AL mode), the regulated state of the NAND gate 88 is released, and therefore the 390 Hz pulse signal outputted by the frequency divider 86 is outputted as the system clock pulse $CK_0$. While the signals WT and RD are not outputted (in the R/R mode, the performance mode, the PR.$\overline{WT}$ mode, and the EX mode), the output of the NOR gate 92 is raised to "1", and the output pulse (frequency 100 KHz) of the oscillator 85 is outputted as the system clock pulse $CK_0$. As is apparent from the above description, the system clock pulse $CK_0$ is outputted according to the modes.

Now, a circuit for forming the sampling signals $SH_0$–($PSH_0$)–$SH_{20}$($PSH_{20}$) will be described. The system clock pulse $CK_0$ from the OR gate 91 is applied, as a driving pulse, to a Delayed-type FF 98 and a 20-stage/1-bit shift register 99, and furthermore it is applied to an inhibition signal forming circuit 94. The inhibition signal forming circuit 94 comprises a resistor $R_8$ connected to the output terminal of the OR gate 91, a NAND gate whose first input terminal is connected through an inverter 95 to one terminal of the resistor $R_8$, and a capacitor $C_3$ which is connected to the other terminal of the resistor $R_8$ at one terminal and is grounded at the other terminal. The second input terminal of the NAND gate 96 is connected directly to the output terminal of the OR gate 91. The output (or the inhibition signal INH) of the NAND gate 96 is applied, as a control signal, to AND gates $100_0$ through $100_{20}$ in an AND gate group 100. The contents of the first stage, the second stage, . . . the 20th stage of the 20-stage/1-bit shift register 99 are applied to the AND gates $10_0$ through $100_{19}$, respectively. The reset output signal of the FF 98 is applied to the AND gate $100_{20}$. This reset output signal is referred to as an output signal $PSH_{20}$. The content of the 20th stage in the shift register 99 and the output of the OR gate 93 are applied through the NOR gate 97 to the FF 98, the reset output signal of which is applied to the 1st stage of the shift register 99. The OR gate 93 receives the signals RET and RS. These signals RET and RS are employed also as the reset signal of the shift register 99. The output signals of the AND gates $100_0$ through $100_{20}$ are referred to as sampling timing signals $SH_0$ through $SH_{20}$, respectively. The outputs of the 1st, 2nd, . . . 20th stage of the shift register 99, and the output of the D-type FF 98 are referred to as sampling timing signals $PSH_0$ through $PSH_{20}$, respectively. The reset signal RS is formed by the card control logic 24 (FIG. 4).

Figure 12:
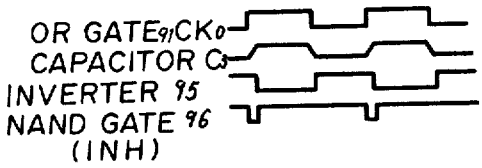
FIG. 12 shows waveforms for a description of the operation of an inhibition signal forming circuit 94 in the timing pulse generator 19 shown in FIG. 10.
Figure 13:
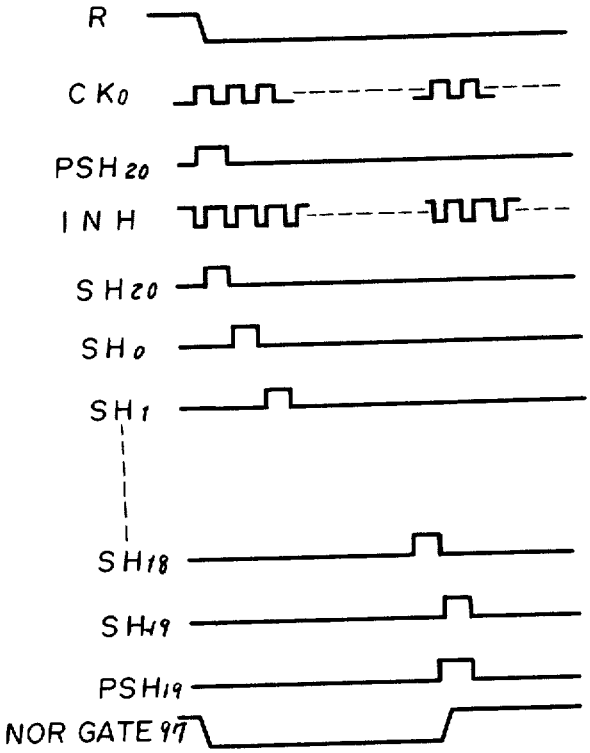
FIG. 13 is a waveform chart indicating sampling timing signals in the tone property control device.

The operation of the above-described circuit will be described with reference to the time charts indicated in FIGS. 12 and 13. The OR gate 91 outputs the system clock pulse $CK_0$ according to one of the operating modes as was described above. If in this case the reset signal RET or RS is outputted, all the contents of the shift register 99 are cleared. When the reset signal RET or RS is climinated, the two inputs to the NOR gate 97 are lowered to "0", as a result of which the "1" output signal of the NOR gate 97 is applied to the FF 98. For the time interval which elapses from the instant that the signal is applied to the FF 98 until the next system clock pulse $CK_0$ is outputted, the reset output of the FF 98 is maintained at "1", and therefore the signal $PSH_{20}$ is maintained outputted. As is apparent from FIG. 12, for the time interval which elapses from the instant that the system clock pulse $CK_0$ is applied to the inhibition signal forming circuit 94 until the potential of the capacitor $C_3$ reaches a predetermined value, the output signal INH of the NAND gate 96 is maintained at "0". When the potential of the capacitor $C_3$ reaches the predetermined value, the signal INH is inverted to "1", which is maintained until the next system clock pulse $CK_0$ is outputted. This operation is repeated. Therefore, while the reset output of the FF 98 is at "1", the signal $SH_{20}$ synchronous with the signal INH is outputted by the AND gate $100_{20}$. Then, upon application of the next system clock pulse $CK_0$, the reset output "1" of the FF 98 is applied to the first stage of the shift register 99, and at the same time the signal $SH_0$ is outputted by the AND gate $100_0$ similarly as in the above-described case. Thus, whenever the system clock pulse $CK_0$ is outputted, and the signal INH is formed, the signals $SH_1$, $SH_2$, . . . $SH_{19}$ are successively outputted. The signal $PSH_{19}$ outputted by the 20th stage of the shift register 99 is outputted for the time interval which elapses from the instant that the signal $SH_{18}$ is eliminated until the signal $SH_{19}$ is eliminated. When this signal $PSH_{19}$ is outputted, the output of the NOR gate 97 is lowered to "0". By the second system clock pulse $CK_0$ after this time instant the reset output of the FF 98 is raised to "1". Thereafter, the above-described operation is repeatedly carried out.

(2-6) Detailed Description of the Tone Color Setting Board 16, and the A/D Converter Device 17

Figure 14:
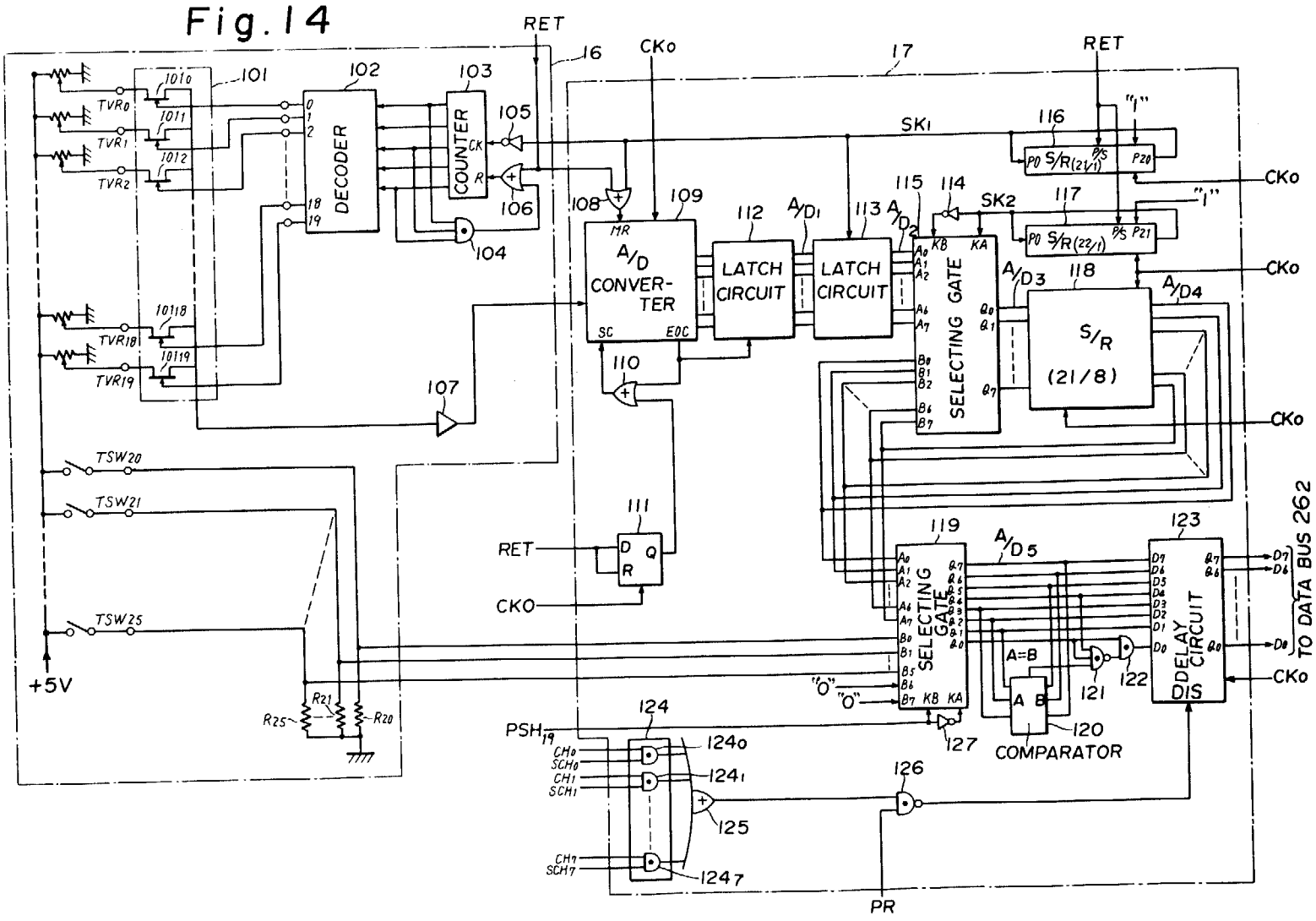
FIG. 14 is a schematic circuit diagram, partly as a block diagram, illustrating a tone property setting board 16 and an A/D conversion device 17 shown in FIG. 4.

The tone color setting board 16 and the A/D converter device 17 will be described in detail with respect to FIG. 14.

The output terminals of twenty tone property controlling variable resistors $TVR_0$ through $TVR_{19}$ are connected to the drain terminals of field-effect transistors (FET's) $101_0$ through $101_{19}$ in a gate group 101, respectively. The source terminals of the FET's $101_0$ through $101_{19}$ are connected together and are connected through a buffer amplifier 107 to the input terminal of an A/D converter 109. The gate terminals of the FET's $101_0$ through $101_{19}$ are connected the terminals 0, 1, 2, . . . 19 of a decoder 102, respectively. A signal representative of the contents of a 21-base counter 103 is applied to the input terminal of the decoder 102. The output signal $SK_1$ of a 21 stage/1-bit parallel/serial shift register 116 is applied through an inverter 105 to the clock terminal of the counter 103, whereby the latter 103 is driven. In order that the counter 103 is reset by the reset signal RET or it is reset when the contents of the counter 103 represent "21", the reset signal RET is applied to the reset terminal R of the counter 103 through an OR gate 106, and on the other hand the outputs of the first, third, and fifth digits of the counter 103 are applied to the reset input terminal R of the counter 103 through an AND gate 104 and an OR gate 106.

The A/D converter 109 is driven by the system clock pulse $CK_0$, and the signals RET and $SK_1$ are applied to the master reset terminal MR thereof through an OR gate 108 to reset the A/D converter 109. Whenever one data conversion is completed, that is, whenever nine system clock pulses $CK_0$ are outputted, a signal EOC is provided at the end-of-convert terminal EOC of the A/D converter 109, and it is applied through an OR gate 110 to the start-convert terminal SC of the A/D converter 109. The reset signal RET is applied to the input terminal D and the reset input terminal R of a Delayed-type FF 111, the set output of which is applied through the OR gate 110 to the terminal SC of the A/D converter 109. The FF 111 is driven by the system clock pulse $CK_0$. Parallel 8 bit digital signals outputted by the A/D converter 109 (that is, pieces of information successively fetched out of the tone property controlling variable resistors $TVR_0$ through $TVR_{19}$) are applied through 2-stage latch circuits 112 and 113 to the input terminals $A_0$, $A_1$ . . . $A_7$ of a select gate 115, respectively. The latch circuit 112 is driven by the aforementioned signal EOC, and the output of the latch circuit 112 will be referred to as A/D1. The latch circuit 113 is driven by the aforementioned signal $SK_1$, and the output of the latch circuit 113 will be referred to as A/D 2. Connected to the output terminals $Q_0$, $Q_1$ . . . $Q_7$ of the select gate 115 are eight shift registers each having a capacity of 21 stages. These eight shift registers will be referred to as a shift register group 118. Whenever the system clock pulse $CK_0$ is applied to the shift register group 118, the output signals of the select gate 115 applied to the shift register group 118 are shifted right, and are outputted as parallel 8 bit data (referred to as A/D 4) by the shift register group 118 when the 22nd system clock pulse $CK_0$ is outputted. The data are applied to the other input terminals $B_0$, $B_1$ . . . $B_7$ of the select gate 115 and to input terminals $A_0$, $A_1$ . . . $A_7$ of another select gate 119.

Now, a circuit for forming the signals $SK_1$ and $SK_2$ will be described. The 21-stage/1-bit (0-th stage–20th stage) parallel/serial shift register 116 is reset by the reset signal RET, and thereafter a "1" level signal is applied to the 21st bit (20th stage) only of the shift register 116. The shift register 116 is driven by the system clock pulse $CK_0$, and therefore the "1" signal inputted to the 21st bit is outputted, as the signal $SK_1$, by the shift register 116 when the next system clock pulse $CK_0$ is outputted. The signal $SK_1$ is delivered to the A/D converter 109 and the latch circuit 103 as was described before, and is applied to the 1st bit (0th stage) of the shift register 116. The signal $SK_1$ ("1") applied to the 1st bit is shifted by one bit right whenever the system clock pulse $CK_0$ is outputted. Thus, the signal $SK_1$ is provided whenever 22 system clock pulses $CK_0$ are produced.

The signal $SK_2$ is outputted by a 22-stage/1-bit (0-th stage–21st stage) parallel/serial shift register 117 which is similar in construction to the above-described shift register 116. When the shift register 117 is reset by the reset signal RET, a "1" level signal is applied only to the 22nd bit (21st stage) thereof. The "1" level signal thus applied is outputted, as the signal $SK_2$, by the shift register 17 upon application of the next system clock pulse $CK_0$. This signal $SK_2$ is applied to the first stage (0-th stage) of the shift register 117 and to the control input terminal KA of the select gate 115, and furthermore it is applied through an inverter 114 to the control input terminal KB of the select gate 115. Thus, the signal $SK_2$ is provided whenever 23 system clock pulses $CK_0$ are outputted. In the select gate 115, when the signal $SK_2$ is applied to the control input terminal KA, the data inputted to the input terminals $A_0$ through $A_7$ are outputted at the output terminals $Q_0$ through $Q_7$. Furthermore, when the signal $SK_2$ is eliminated and a "1" level signal is applied to the input terminal KB, the data inputted to the input terminals $B_0$ through $B_7$ are outputted at the output terminals $Q_0$ through $B_7$ are outputted at the output terminals $Q_0$ through $Q_7$.

The output signals of the aforementioned tone property effecting switches $TSW_{20}$ through $TSW_{25}$ are applied to the input terminals $B_0$ through $B_5$ of the select gate 119, and the input terminals $B_6$ and $B_7$ are not employed, that is, they are maintained at "0" level at all times. The output terminals of the switches $TSW_{20}$ through $TSW_{25}$ are grounded through resistors $R_{20}$ through $R_{25}$, respectively, and are connected to the input terminals $B_0$ through $B_5$ of the select gate 119, respectively. These tone property effecting switches $TSW_{20}$ through $TSW_{25}$ are employed to selectively fetch tone source waveforms to give various effects such as for instance a vibrato effect to the performance, to switch the low-pass filter, the band-pass filter, and the high-pass filter, or to perform the pulse-width modulation, during the performance. The sampling timing signal $PSH_{19}$ is applied through an inverter 127 to the control input terminal KA of the select gate 119 and directly to the control input terminal KB of the select gate 119. According, when the signal $PSH_{19}$ is at "1", the input data (or the on-off signals of the tone property effecting switches $TSW_{20}$–$TSW_{25}$) to the input terminals $B_0$ through $B_7$ are selected, and are outputted from the output terminals $Q_0$ through $Q_7$ of the select gate 119. On the other hand, when the signal $PSH_{19}$ is at "0", the input data to the input terminals $A_0$ through $A_7$ (or the output signals of the tone property controlling variable resistors $TVR_0$ through $TVR_{19}$) are outputted. The output data of the select gate 119 are applied to the input terminals $D_0$ through $D_7$ of a delay circuit 123 (the output data to the input terminal $D_0$ being applied through an AND gate 122), and after being delayed as much as a single system clock pulse $CK_0$, they are outputted, as 8-bit parallel data, from the output terminals $Q_0$ through $Q_7$ of the delay circuit 127 to a data bus 262.

Now, an inhibition circuit which when no signal PR is outputted, the operation of the delay circuit 123 will be described. The channel timing signals $CH_0$ through $CH_7$ obtained by decoding the channel codes $CC_1$–$CC_3$ are applied to first input terminals of AND gate $124_0$ through $124_7$ in and AND gate group 124, while the channel timing signals $SCH_0$ through $SCH_7$ are applied to second input terminals thereof, respectively. The outputs of the AND gates $124_0$ through $124_7$ are applied through an OR gate 125 to one input terminal of a NAND gate 126, to the other terminal of which the signal PR is applied. The output of the NAND gate 126 is applied to the control input terminal DIS of the delay circuit 123. Therefore, when the signal PR is at "0", the output of the NAND gate is raised to "1" to inhibit the operation of the delay circuit 123, whereby the data output of the delay 123 is inhibited. On the other hand, when the signal PR is at "1", since the "1" signal is outputted by at least one of the AND gates in the AND gate group 124, the output of the NAND gate 126 is lowered to "0", as a result of which the delay circuit 123 is operated and formation of the tone color information is carried out by the RAM's (FIG. 4) for the channels.

When the data set by the above-described variable resistors $TVR_0$–$TVR_{19}$ and switches $TSW_{20}$–$TSW_{25}$ coincides with the channel information, the tone property control device may be erroneously operated. In order to prevent such an erroneous operation, in this invention a channel code detecting circuit is provided, as described below. In the embodiment, the channel signals $CH_0$ through $CH_7$ are 8-bit data as indicated in the following Table 1:

TABLE 1

| Channel Signal | $D_7$ | $D_6$ | $D_5$ | $D_4$ | $D_3$ | $D_2$ | $D_1$ | $D_0$ |
|---|---|---|---|---|---|---|---|---|
| $CH_0$ | 0 | 0 | 0 | 1 | 0 | 0 | 0 | 1 |

TABLE 1-continued

| Channel Signal | $D_7$ | $D_6$ | $D_5$ | $D_4$ | $D_3$ | $D_2$ | $D_1$ | $D_0$ |
|---|---|---|---|---|---|---|---|---|
| $CH_1$ | 0 | 0 | 1 | 1 | 0 | 0 | 1 | 1 |
| $CH_2$ | 0 | 1 | 0 | 1 | 0 | 1 | 0 | 1 |
| $CH_3$ | 0 | 1 | 1 | 1 | 0 | 1 | 1 | 1 |
| $CH_4$ | 1 | 0 | 0 | 1 | 1 | 0 | 0 | 1 |
| $CH_5$ | 1 | 0 | 1 | 1 | 1 | 0 | 1 | 1 |
| $CH_6$ | 1 | 1 | 0 | 1 | 1 | 1 | 0 | 1 |
| $CH_7$ | 1 | 1 | 1 | 1 | 1 | 1 | 1 | 1 |

As is apparent from Table 1, in each of the data representative of the channel signals, the first and fifth bits ($D_0$ and $D_4$) are "1", the second bit ($D_1$) is equal to the sixth bit ($D_5$), the third bit ($D_2$) is equal to the seventh bit ($D_6$), and the fourth bit ($D_3$) is equal to the eighth bit ($D_7$): $D_0=D_4=$"1", $D_1=D_5$, $D_2=D_6$, and $D_3=D_7$. Accordingly, data satisfying the above-described relationships are detected from the output data A/D 5 of the select gate 119 so as to be employed as musical tone information. In this embodiment, when such data is detected, its first bit ($D_0$) is forcibly lowered to "0". The output terminals $Q_1$, $Q_2$ and $Q_3$ of the select gate 119 are connected to the A side input terminals of a comparator 120, while the output terminals $Q_5$, $Q_6$ and $Q_7$ are connected to the B side input terminals, so that the outputs from the output terminals $Q_1$ and $Q_5$, the outputs from the output terminals $Q_2$ and $Q_6$, and the outputs from the output terminals $Q_3$ and $Q_7$ are subjected to comparison, respectively. When all the contents of the outputs are coincided with one another, a "1" level coincidence signal A=B is applied from the output terminal of the comparator 120 to a first input terminal of a NAND gate 121. Second and third input terminals of the NAND gate 121 are connected to the output terminals $Q_0$ and $Q_4$ of the select gate 119, and the output terminal of the NAND gate 121 is connected to a first input terminal of an AND gate 122. A second input terminal of the AND gate 122 is connected to the output terminal $Q_0$ of the select gate 119, and the output terminal of the AND gate 122 is connected to the input terminal $D_0$ of the delay circuit 123.

With the channel code detecting circuit thus organized, when the same data as a channel signal indicated in Table 1 is outputted by the select gate 119, the coincidence signal A=B is outputted by the comparator 120, and the signals "1" are outputted from the output terminals $Q_0$ and $Q_4$ of the select gate 119. As a result, all the three inputs of the NAND gate 121 are switched to "1", and therefore the output thereof is raised to "0", and the AND gate 122 is closed. Hence, the "0" signal is applied to the input terminal $D_0$ of the delay circuit 123, and accordingly with respect to the first bit only, data different from the channel signal is inputted to the delay circuit 123 and is outputted to the data bus $26_2$.

On the other hand, in the case where data different from the channel signal is outputted by the select gate 119, it goes without saying that no coincidence signal A=B is outputted by the comparator 120. Therefore, the output of the AND gate 121 is raised to "1", as a result of which the AND gate 122 is opened. Thus, the output data of the select gate 119 is applied to the delay circuit 123 as it is and is outputted to the data bus $26_2$.

Figure 15:
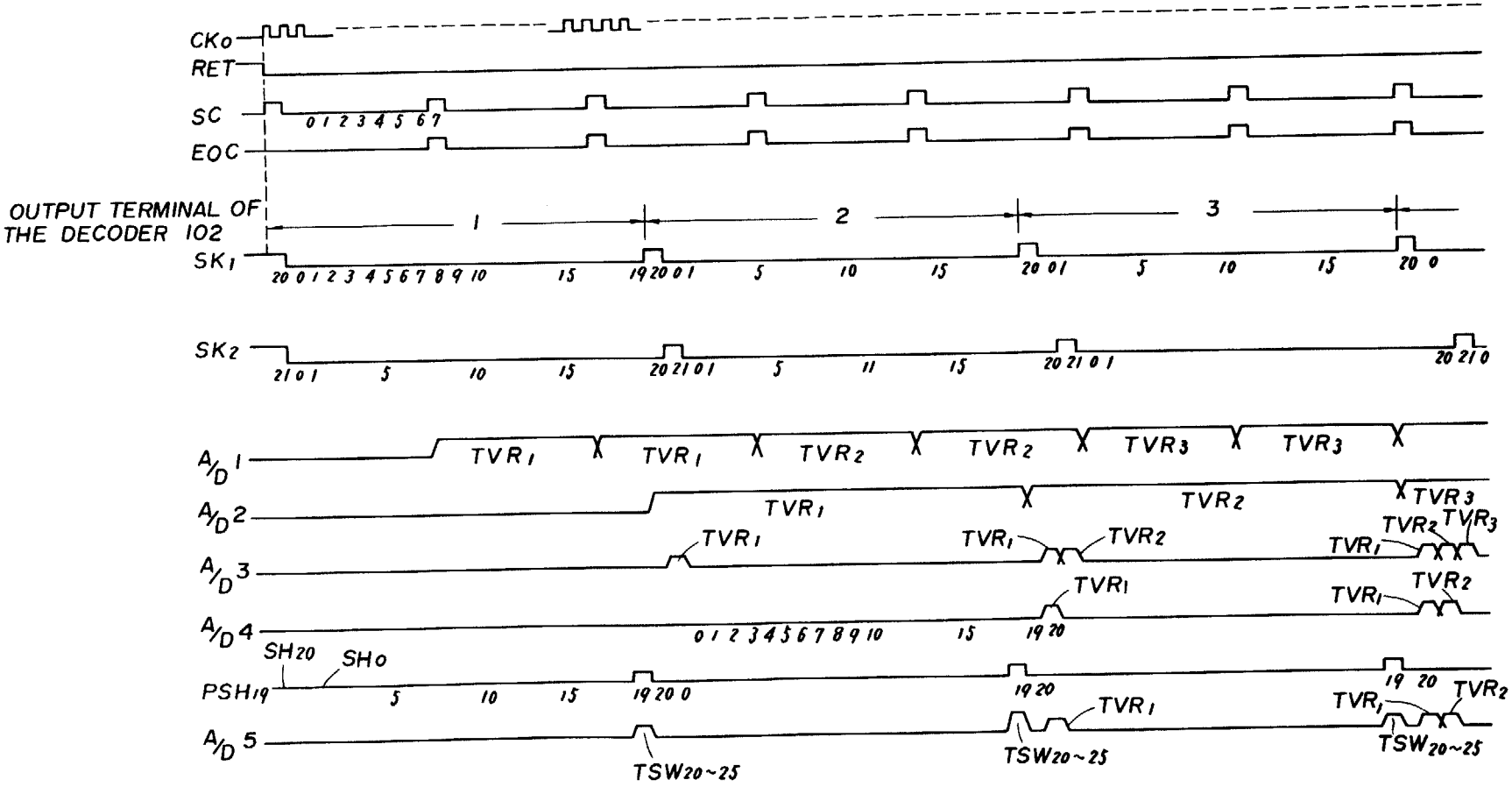
FIG. 15 and FIG. 16 show waveforms for a description of the operation of the A/D conversion device 17.
Figure 16:
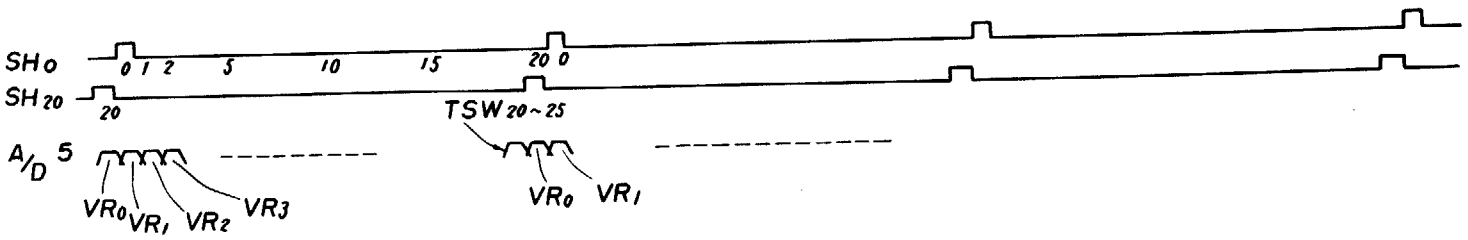

The operation of the circuitry shown in FIG. 14 will be described with reference to the time charts shown in FIGS. 15 and 16. In this circuitry, when the signal PR is outputted, or in the PR.$\overline{WT}$ mode or in the PR. WT mode, the inhibition of the operation of the delay circuit 123 is released by the above-described inhibition circuit and data application to the data bus $26_2$ is carried out. Prior to either of the above-described two modes, the aforementioned musical tone determining element control variable resistors $TVR_0$ through $TVR_{19}$ and musical tone determining element control switches $TSW_{20}$ through $TSW_{25}$ are set as required. First, upon operation of the reset switch 30, the contents of the 21-base counter 103, A/D converter 109, FF 111 and shift registers 116 and 117 are cleared. Upon clearance of the shift registers 116 and 117, "1" signals are applied to the 21st stage of the shift register 116 and the 22nd bit of the shift register 117. As soon as the reset signal RET is eliminated, outputting the system clock pulse $CK_0$ is started. When the first system clock pulse $CK_0$ is applied to the shift registers 116 and 117, the signals $SK_1$ and $SK_2$ are outputted thereby, respectively. In this connection, numerals 20 and 21 indicated below the signals $SK_1$ and $SK_2$ in FIG. 15 mean that the outputs are from the 20th and 21st stages of the shift registers 116 and 117, respectively. When the signal $SK_1$ is outputted, the contents of the counter 103 is changed from "0" to "1", and accordingly a signal is outputted only from the output terminal 1 of the decoder 102. As a result, the FET $101_1$ is rendered conductive, and the output of the variable resistor $TVR_1$ is introduced through the buffer amplifier 107 to the A/D converter 109. The signals $SK_1$ and $SK_2$ are inputted to the first bits of the two shift registers 116 and 117, and they are shifted right whenever the system clock pulse $CK_0$ is outputted. After they reaches the 21st bit and the 22nd bit, respectively, they are outputted as the signals $SK_1$ and $SK_2$ at the time of outputting the next system clock pulse $CK_0$. The output of the FF 111 is inverted with the aid of the reset signal RET applied thereto. The output thus inverted is applied to the input terminal SC of the A/D converter 109. The A/D converter 109, fetching the output of the tone property controlling variable resistor $TVR_1$, converts it into a digital signal, and the conversion is ended before the ninth system clock pulse $CK_0$ is provided. During the time interval which elapses from the instant that the 22nd system clock pulse $CK_0$ is outputted until the second signal $SK_1$ is outputted, two signals EOC are outputted by the A/D converter 109. Upon application of the first signal EOC to the latch circuit 112, the output data of the musical tone determining element control variable resistor $TVR_1$ which has been converted into a digital signal is outputted as a data A/D 1 by the latch circuit 112. Even after the second signal EOC is outputted, the output data A/D 1 of the latch circuit 112 remains as the output of the variable resistor $TVR_1$. However, when the second signal $SK_1$ is outputted, then the contents of the counter 103 is changed to "2", a signal is outputted only from the output terminal 2 of the decoder 102, and the output of the variable resistor $TVR_2$ is supplied to the A/D converter 109. With the aid of the second signal $SK_1$, the output data A/D 2 of the latch circuit 113 becomes the output of the variable resistor $TVR_1$. When the 23rd system clock pulse is outputted, the second signal $SK_2$ is outputted and simultaneously the data A/D 2, that is, the output of the variable resistor $TVR_1$ is outputted, as the data A/D 3, by the select gate 115, and is applied to the first stage of the shift registers in the shift register group 118. The data applied to the shift registers is shifted right whenever the system clock pulse $CK_0$ is outputted, and thereafter it is outputted, as a data A/D 4, by the shift register 118 upon application of the 22nd system clock pulse $CK_0$. This data A/D 4 of the musical tone determining element control variable resistor $TVR_1$ is applied to the input terminals $B_0$ through $B_7$ of the select gate 115 and to the input terminals $A_0$ through $A_7$ of the select gate 119. Furthermore, at the application of the 3rd and 4th signals EOC, the output of the musical tone determining element control variable resistor $TVR_2$ is outputted, as data A/D 1, by the latch circuit 112 and is supplied to the latch circuit 113. Thus, the data A/D 1 outputted by the latch circuit 113 upon application of the 3rd signal $SK_1$ is the output of the musical tone determining element control variable resistor $TVR_2$. After the 3rd signal $SK_1$ has been outputted, the output of the variable resistor $TVR_1$ is outputted, as data A/D 4, by the shift register 118 with a delay corresponding to one system clock pulse $CK_0$ and is applied to the input terminals $B_0$ through $B_7$ of the select gate 115. Therefore, before the 3rd signal $SK_2$ is outputted after the 3rd signal $SK_1$, the output of the inverter 114 is at "1", and the input data (or the output of the musical tone determining element control variable resistor $TVR_1$) to the input terminals $B_0$ through $B_7$ of the select gate 115 is selected and outputted as data A/D 3. Then, when the 3rd signal $SK_2$ is outputted, the output of the inverter 114 is switched to "0", the input data (or the output of the tone property controlling variable resistor $TVR_2$) is outputted, as data A/D 3, by the select gate 115. The above-described operation is repeatedly carried out. Accordingly, with respect to the data A/D 3, as indicated in FIG. 15, the outputs of the musical tone property controlling variable resistors $TVR_1$, $TVR_2$, . . . $TVR_{19}$ are successively outputted in the stated order with a delay corresponding to one system clock pulse $CK_0$.

Now, the operation of the select gate 119 will be described. Before the first musical tone determining element control variable resistor ($TVR_1$)'s data A/D 3 is applied thereto, no input data is applied to the input terminals $A_0$ through $A_7$ of the select gate 119, but the on-off information of the tone property effecting switches $TSW_{20}$ through $TSW_{25}$ is applied to the input terminals $B_0$ through $B_7$ only. Therefore, when the first timing signal $PSH_{19}$ is outputted after the reset signal RET is firstly outputted, the on-off information of the switches $TSW_{20}$ through $TSW_{25}$ is outputted, as data A/D 5, by the select gate 119. After the second timing signal $PSH_{19}$ is outputted, the output of the control variable resistor $TVR_1$ is inputted, as data A/D 4 to the input terminals $A_0$ through $A_7$ of the select gate 119. Accoringly, when the timing signal $PSH_{19}$ is eliminated and the output of the inverter 127 is raised to "1", the aforementioned data A/D 4 is outputted as data A/D 5.

In this manner, the content of the counter 103 is successively advanced, and when it reaches "21", it is reset by the output of the AND gate 104 to allow the counter to start counting from "0" again. In this case, as is apparent from the above description, the outputs of the variable resistors $TVR_0$ through $TVR_{19}$ are inputted to the input terminals $A_0$ through $A_7$ of the select gate 119 in synchronization with the successively outputted timing signals $SH_{20}$, $SH_0$, $SH_1$. . . $SH_{17}$ as is clear from the time chart shown in FIG. 16. These outputs are outputted, as data A/D 5, by the select gate 119 successively. When the timing signal $PSH_{19}$ is outputted, the outputs of the control switches $TSW_{20}$ through $TSW_{25}$ are outputted, as data A/D 5, by the select gate 119. Thereafter, the above-described operation is repeatedly carried out. The data A/D 5 is applied through the delay circuit 123 to the data bus $26_2$. Furthermore, as was described before, comparison of the data A/D 5 and the channel signal is carried out by the comparator 120.

(2-7) Detailed Description of the D/A Conversion Device 20 and the Sample Hold/Latch Circuit 21

Figure 17:
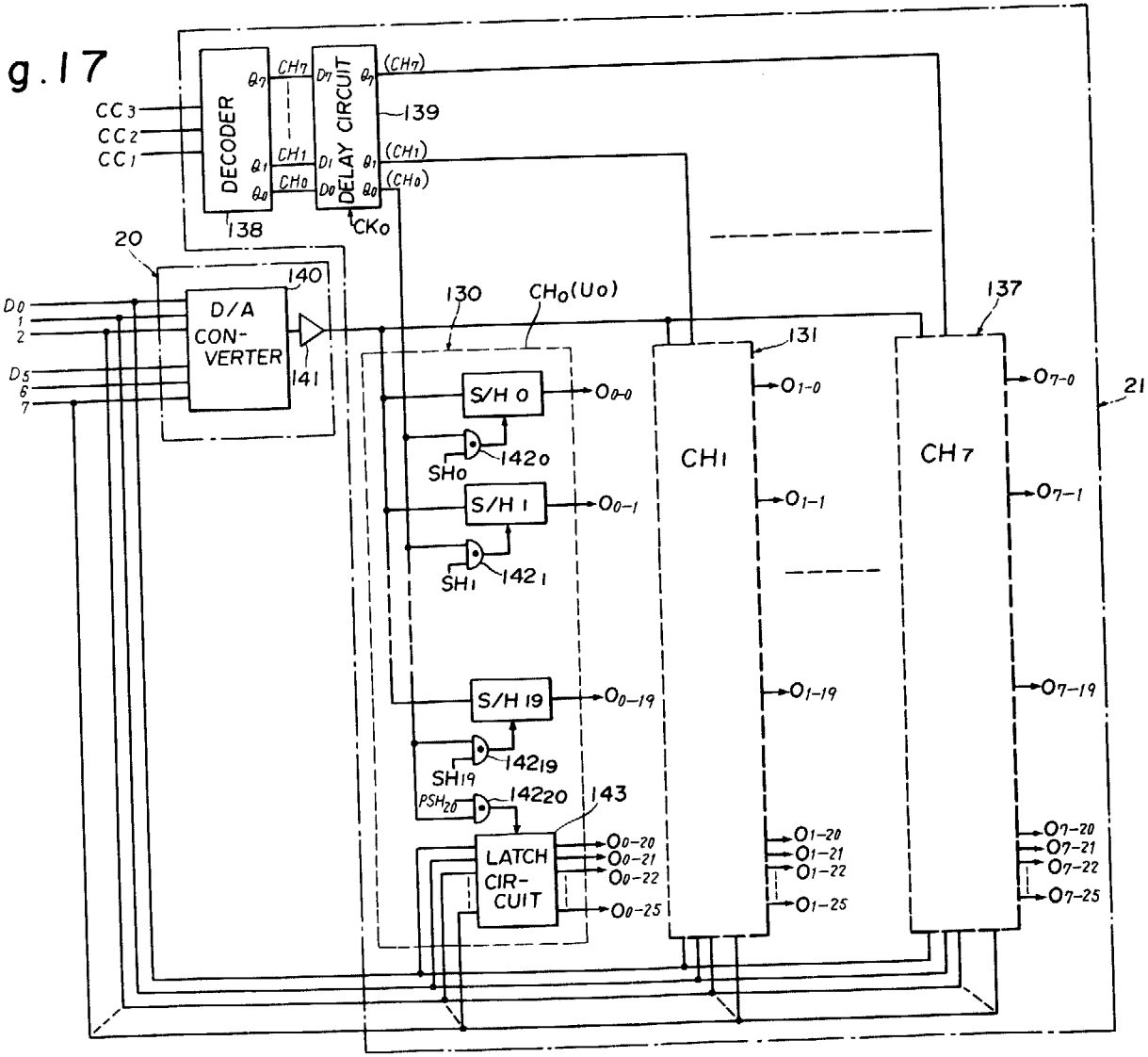
FIG. 17 is a schematic circuit diagram, partly as a block diagram, illustrating a D/A conversion device 20 and a sample hold/latch circuit 21 shown in FIG. 4.

The arrangements of the D/A conversion device 20, the sample hold circuit 21*a*, and the latch circuit 21*b* will be described with reference to FIG. 17.

In a decoder 138 receiving the channel codes $CC_1$–$CC_3$, the channel codes are decoded into the corresponding channel timing signals $CH_0$ through $CH_7$, which are delivered from the output terminals $Q_0$ through $Q_7$ to the input terminals $D_0$ through $D_7$ of a delay circuit 139 which is driven by the system clock pulse $CK_0$. In the delay circuit 139, the timing signals applied thereto are delayed as much as one bit and are successively outputted through the output terminals $Q_0$ through $Q_7$. These timing signals thus outputted are applied to sample hold/latch circuits 130 through 137, respectively. The data $D_0$ through $D_7$ supplied the data bus $26_2$ are the output data of the variable resistors $TVR_0$ through $TVR_{19}$, and the switches $TSW_{20}$ through $TSW_{25}$, or the data read out of the magnetic card, as was described before. Output of the data $D_0$ through $D_7$, the data which are utilized as analog information in the musical tone forming circuits $2_0$ through $2_7$ with respect to the outputs of the variable resistors $TVR_0$ through $TVR_{19}$ are applied to a D/A converter 140 where they are converted into alalog information, which is applied through a buffer amplifier 141 to the sample hold circuits in the sample hold/latch circuits 130 through 137 of the respective channels. Furthermore, out of the data $D_0$ through $D_7$, the data which are utilized as digital information in the musical tone forming circuits $2_0$ through $2_7$ with respect to the outputs of the switches $TSW_{20}$ through $TSW_{25}$ are applied to the latch circuits in the respective sample hold/latch circuits 130 through 137.

The arrangements of the sample hold/latch circuits 130 through 137 will be described. Since the sample hold/latch circuits 130 through 137 provided respectively for the 0-th channel to the 7th channel are equal in construction to one another, only the circuit 130 provided for the 0-th channel will be described as a typical one. In the circuit 130, twenty sample hold circuits S/H0 through S/H19 are provided in correspondence to the musical tone determining element control variable resistors $TVR_0$ through $TVR_{19}$, respectively, and the input terminals of these sample hold circuits are connected to the output terminal of the buffer amplifier 141. AND gates $142_0$ through $142_{19}$ are provided for the sample hold circuits S/H0 through S/H19, respectively, and the first input terminals of these AND gates are connected to the output terminal of the delay circuit 139. The sampling timing signals $SH_0$ through $SH_{19}$ are applied to the second input terminals of the AND gates $142_0$ through $142_{19}$ in correspondence to the variable resistors $TVR_0$ through $TVR_{19}$, respectively. Therefore, for instance in the case of the sample hold circuit S/HO, when the delay circuit 139 is outputting the channel timing signal $CH_0$ and the sampling timing signal $SH_0$ is being outputted, the AND gate $142_0$ is opened, by the output of which the sample hold circuit S/HO is released. During this period, the sample hold circuit S/HO outputs, as a signal $O_{0\text{-}0}$, the output voltage of the variable resistor $TVR_0$ stored therein. Similarly as in the above-described case, signals $O_{0\text{-}1}$ through $O_{0-19}$ are sequentially outputted by the sample hold circuits S/H1 through S/H19, respectively.

Further provided in the circuit 130 is a latch circuit 143 adapted to latch the outputs of the tone property effecting switches $TSW_{20}$ through $TSW_{25}$. When the latch circuit 143 is released by the output of an AND gate $142_{20}$ which receives the channel timing signal $CH_0$ and the sampling timing signal $PSH_{20}$, the outputs of the switches $TSW_{20}$ through $TSW_{25}$ are outputted, as signals $O_{0-20}$ through $O_{0-25}$, by the latch circuit 143.

Thus, the channel timing signals $CH_0$ through $CH_7$ are sequentially outputted by the decoder 138, the sample hold/latch circuits 130 through 137 are sequentially specified, and the signals $O_{0-0}$ through $O_{7-25}$ are outputted by the thus specified circuits 130 through 137 in response to the sampling timings signals $SH_0$ through $SH_{19}$ and $PSH_{20}$. These output signals are delivered to the respective musical tone forming circuits $2_0$ through $2_7$, as was described before.

(2-8) Detailed Description of Tone Selector 10 and Address Generator 11

Figure 18:
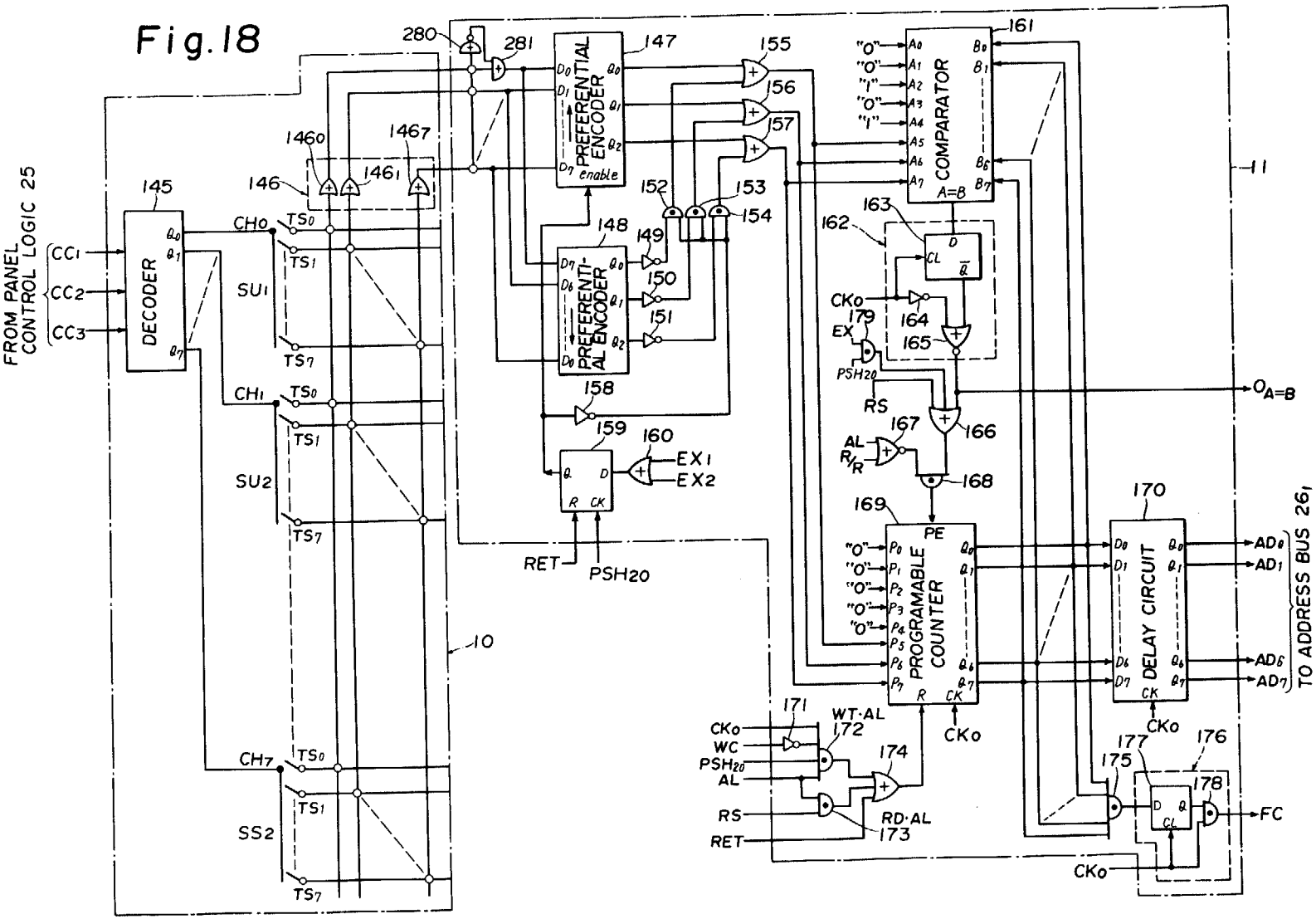
FIG. 18 is a schematic circuit diagram, partly as a block diagram, illustrating a tone selector 10 and an address generator 11 shown in FIG. 4.

The detailed constructions of the tone selector 10 and the address generator 11 will be described with reference to FIG. 18.

A decoder 145, receiving the channel codes $CC_1$–$CC_3$ as its input signals, outputs the channel timing signals $CH_0$ through $CH_7$ through its output terminals $Q_0$ through $Q_7$ sequentially, which are applied to the common input terminals of the respective channel switches $SU_1$, $SU_2$, . . . , $SS_2$. As was described before, eight (8) tone selector switches $TS_0$ through $TS_7$ are provided for each of the channel switches $SU_1$ . . . $SS_2$, and the output terminals of the tone selector switches $TS_0$ through $TS_7$ are connected to the input terminals of respective OR gates $146_0$ through $146_7$ in an OR gate group 146. In other words, the input terminal of the OR gate $146_0$, for instance, is connected to the tone selector switches $TS_0$ of the channel switches $SU_1$ through $SS_2$. The output terminals of the OR gates $146_0$ through $146_7$ are connected to the respective input terminals $D_0$, $D_1$ . . . $D_7$ of a preferential encoder 147 and to the respective input terminals $D_7$, $D_6$ . . . $D_0$ of a priority preferential encoder 148. When two tone selector switches are simultaneously depressed, in the preferential encoder 147 the tone selector having a smaller reference numeral takes precedence over the other; however, in the preferential encoder 148 the tone selector having a larger reference numeral takes precedence over the other.

The functions of these preferential encoders 147 and 148 are identical with those of the preferential encoders 71 and 72 described with reference to the panel control logic 25 shown in FIG. 7. The priority encoder 147 is operated only when a "1" control signal is applied to its control terminal "enable", so as to output encoded signals to OR gates 155, 156 and 157 through its output terminals $Q_0$, $Q_1$ and $Q_2$, respectively. On the other hand, the priority encoder 148 is maintained operable at all times to provide output signals through its output terminals $Q_0$, $Q_1$ and $Q_2$. The output signals are applied through inverters 149, 150, and 151 to the first input terminals of AND gates 152, 153 and 154, respectively. Applied to the second input terminals of the AND gates 152, 153 and 154 is a control signal which is obtained by inverting the set output of a Delayed-type FF 159 (described later) by means of an inverter 158. The outputs of the AND gates 152 through 154 are applied to OR gates 155, 156 and 157, respectively.

In the aforementioned D-type FF 159, the signal $EX_1$ or the signal $EX_2$ is applied through an OR gate 160 to the input terminal D, and is outputted through the set output terminal Q with a delay while the FF 159 is driven by the signal $PSH_{20}$. The set output of the FF 159 is applied to the control input terminal "enable" of the preferential encoder 147 as was described, and it is further applied to the AND gates 152 through 154 through the inverter 158. Upon application of the reset signal RET to the reset input terminal R, the FF 159 is reset.

The output terminals of the OR gates 155, 156 and 157 are connected to the input terminals $A_5$, $A_6$ and $A_7$ of a comparator 161 and to the input terminals $P_5$, $P_6$ and $P_7$ of a program counter 169, respectively. Signals "0", "0", "1", "0" and "1" are applied to the input terminals $A_0$, $A_1$, $A_2$, $A_3$ and $A_4$ of the comparator 161 at all times. Accordingly, the "A" side input terminals of the comparator 161 is set to "20 (decimal number)" at all times. This is to store the information for one tone color in the 0-th–20th, the 32nd–52nd, the 64th–84th, the 96th–116th, the 128th–148th, the 160th–180th, the 192nd–212th and the 224th–244the addresses (corresponding to the regions of the 0-th, 1st, . . . 7th blocks) of the aforementioned RAM 13 or ROM 14, as described later. In this case, the last address of each block is set at the "A" side input terminals $A_0$ through $A_7$ of the comparator 161. On the other hand, a signal representative of the contents of the program counter 169, that is, output signals from the output terminals $Q_0$, $Q_1$ . . . $Q_7$ thereof are applied to the "B" side input terminals $B_0$ through $B_7$. Both of the input signals are subjected to comparison in the comparator 161, when their contents coincide with each other, a coincidence signal is outputted at the output terminal A=B and is applied to a Delayed-type FF 163 in a signal $O_{A=B}$ forming circuit 162. The FF 163 is driven by the system clock pulse $CK_0$. The reset output from the terminal $\overline{Q}$ of the FF 163 together with a signal obtained by inverting the system clock pulse $CK_0$ by an inverter 164 is applied to an input terminal of a NOR gate 165. The output signal of the NOR gate 165 is referred to as the signal $O_{A=B}$. This signal $O_{A=B}$ is applied through an OR gate 166 to a first input terminal of an AND gate 168. Furthermore, the reset signal RS, and the output signal of an AND gate 179 receiving the signals EX and $PSH_{20}$ are applied through the OR gate 166 to the first input terminal of the AND gate 168. The output signal of a NOR gate 167 receiving the signal AL and the signal R/R is applied, as a control signal, to the second input terminal of the AND gate 168. The output of the AND gate 168 is applied, as an enable signal, to the control input terminal PE of the program counter 169. When the enable signal is applied to the control input terminal PE of the program counter 169, signals "0" are appled to the input terminals $P_0$ through $P_4$ of the programmable counter 169. As was described before, the tone select switch code signal has been applied to the input terminals $P_5$, $P_6$ and $P_7$ of the program counter 169. Accordingly, when, for instance, the tone selector switch $TS_1$ is closed, signals "1", "0" and "0" are applied to the input terminals $P_5$, $P_6$ and $P_7$. Therefore, after the input terminals $P_0$ through $P_4$ are set to "0" by the application of the signal to the control input terminal PE, whenever the system clock pulse $CK_0$ is applied to the programmable counter 169, the counter 169 is driven by the system clock pulse $CK_0$ and the contents "32" of the counter 169 is increased by one (+1).

Now, the reset circuit of the programmable counter 169 will be described. An AND gate 172 receives the system clock pulse $CK_0$, a signal obtained by inverting the signal WC by an inverter 171, the signal $PSH_{20}$, and the signal AL. The output of the AND gate 172 is applied through an OR gate 174 to the reset terminal R of the programable counter 169. Furthermore, the reset signal RET, and the output of an AND gate 173 receiving the signal AL and the signal RS are applied through the OR gate 174 to the reset input terminal R. The output of the programmable counter 169 is introduced to the input terminals $D_0$ through $D_7$ of a delay circuit 170. As the delay circuit 170 is driven by the system clock pulse $CK_0$, the output of the programable counter 169 is delayed by one bit and is then provided, as 8-bit address signals $AD_0$–$AD_7$ for specifying addresses in the RAM 13 and the ROM 14, at the output terminals $Q_0$–$Q_7$ of the delay circuit 170.

In this connection, a circuit 176 for forming a signal FC (finish code) will be described. The output signals from the output terminals $Q_0$–$Q_7$ of the progamable counter 169 are applied to an AND gate 175, the output of which is introduced to the input terminal D of a Delayed-type FF 177 in the signal FC forming circuit 176. The circuit 176 is driven by the system clock pulse $CK_0$. The system clock pulse $CK_0$ and the set output signal of the FF 177 are applied to an AND gate 178 to obtain the output signal of the AND gate 178. This output signal of the AND gate 178 is referred to as the signal FC.

The operation of the above-described circuitry is as follows: The channel timing signals $CH_0$, $CH_1$ . . . $CH_7$ are sequentially provided at the output terminals $Q_0$, $Q_1$ . . . $Q_7$ of the decoder 145 receiving the channel codes $CC_1$–$CC_3$, and are applied to the respective channel selecting switches $SU_1$, $SU_2$, . . . $SS_2$. In the case when one for each channel out of the tone select switches $TS_0$ through $TS_7$ included in each of the channel selecting switches $SU_1$, . . . $SS_2$, that is, for instance the switch $TS_7$ in the channel selecting switch $SU_1$ is operated in a mode other than the EX mode, the output signal "1" of this tone select switch $TS_7$ is applied through the OR gate $146_7$ to the priority encoder 148 while the channel timing signal $CH_0$ is being outputted. In this operation, the outputs of the other OR gates $146_0$ through $146_6$ are "0". In a mode other than the EX mode, no enable signal is applied to the control input terminal "enable" of the priority encoder 147, and therefore the latter 147 is not enabled. Accordingly, the signal "1" is applied only to the input terminal $D_0$ of the encoder 148, and therefore a signal "0 0 0" is provided at the output terminals $Q_0$, $Q_1$ and $Q_2$. This output signal "0 0 0" is inverted by the inverters 149, 150 and 151 into a signal "1 1 1" which is representative of the tone selector switch $TS_7$. As this signal "1 1 1" is outputted by the AND gates 152, 153 and 154 as the output of the inverter 158 is "1" is other than the EX mode. The signal is applied through the OR gates 155, 156 and 157 to the input terminals $A_5$, $A_6$ and $A_7$ of the comparator 161 and to the input terminals $P_5$, $P_6$ and $P_7$ of the programable counter 169; that is, the signals "1" are applied to these input terminals.

Similarly as in the above-described case, with the other channel selecting switches $SU_2$–$SS_2$ also, in response to the operations of the tone select switches therein the encoding operations are successively effected by the preferential encoder 148 if the channel timing signals $CH_1$–$CH_7$ are being outputted. In the case of the channel selecting switch $SU_1$ described above, when the output of the decoder 145 is changed from the preceding channel timing signal $CH_7$ to the channel timing signal $CH_0$, the contents of both of the inputs $A_0$–$A_7$ and $B_0$–$B_7$ of the comparator 161 coincide with each other, and the coincidence signal A=B is outputted at the output terminal A=B. Thus, in the signal $O_{A=B}$ forming circuit 162, after the coincidence signal A=B is outputted, the signal $O_{A=B}$ is outputted with a delay corresponding to a single system clock pulse $CK_0$. This signal $O_{A=B}$ is applied through the OR gate 166 to the AND gate 168. If, in this operation, the signals R/R and AL are not outputted (that is, the operation mode is not any one of the R/R mode, WT.AL mode and RD.AL mode), since the AND gate 168 has been released, the signal $O_{A=B}$ is applied to the control input terminal PE of the program counter 169 while the signals "0" are applied to the input terminals $P_0$ through $P_4$ of the programmable counter 169. Accordingly, the programmable counter 169 starts its counting operation from "224" (1 1 1 0 0 0 0). The outputs of the programable counter 169, being delayed as much as one bit time by the delay circuit 170, are introduced, as the address signals $AD_0$–$AD_7$, to the RAM and the ROM of the 0-th channel. The outputs of the programable counter 169 are applied also to the input terminals $B_0$–$B_7$ of the comparator 161 and to the AND gate 175. In the comparator 161, the "A" side input terminals are set to the content "244" (1 1 1 1 0 1 0 0). Therefore, when the contents of the programable counter 169 reaches "244", the coincidence signal A=B is outputted by the comparator 161 and is delivered to the signal $O_{A=B}$ forming circuit 162. Accordingly, when the signal $O_{A=B}$ is outputted as described above, the programable counter 169 starts a counting operation with respect to the channel switch $SU_2$. If, in this case, none of the tone select switches $TS_0$ through $TS_7$ of the channel selecting switch $SU_1$ are not operated, no output is provided by the OR gate group 146 when the channel timing signal $CH_0$ is outputted. However, the outputs of the OR gate group subjected to NOR logic operation, that is, the output of the NOR gate 280 and the output of the OR gate $146_0$ are subjected to OR logic operation in the OR gate 281, as a result of which a signal "1" is applied to the input terminal $D_7$ of the preferential encoder 148. Thus, signals "1" are provided at the output terminals $Q_0$, $Q_1$ and $Q_2$ of the preferential encoder 148, which leads to the application of signals "0" to the input terminals $A_5$, $A_6$ and $A_7$ of the comparator 161 and to the input terminals $P_5$, $P_6$ and $P_7$ of the programable counter 169. That is, in the programable counter 169, as soon as the output of the decoder 145 is changed from the channel timing signal $CH_7$ to the channel timing signal $CH_0$, the signals "0" are inputted to the input terminals $P_0$ through $P_7$ of the programable counter 169. Accordingly, the counting operation of the programable counter 169 is started from the contents "0", and when the contents reach "20" (1 0 1 0 0), the coincidence signal A=B is outputted by the comparator 161.

In the WT.AL mode, the RD.AL mode or the R/R mode (other than the EX mode), the NOR gate 167's output is lowered to "0", and the AND gate 168 is therefore closed, as a result of which no "enable" signal is applied to the program counter.

The operations of the programable counter 169 in the aformentioned three modes will be described.

Figure 19:
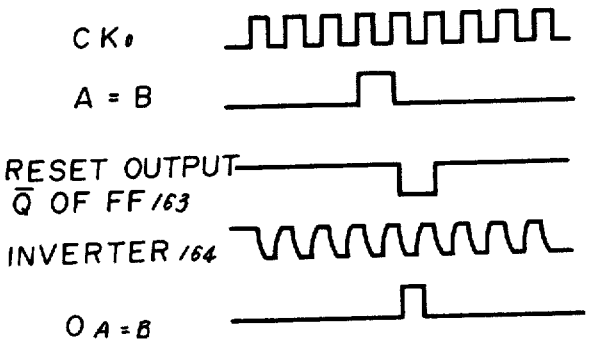
FIG. 19 shows waveforms for a description of the operation of a signal $O_{A=B}$ forming circuit 162 in the address generator 11 shown in FIG. 18.

First of all, in the R/R mode, the reset switch 30 is first operated (FIG. 3), and therefore its output signal RET is applied through the OR gate 174 to the reset input terminal R of the program counter 169, and the contents of the programable counter 169 are changed to "0". Subsequently, the programable counter 169 starts an operation for the 0-th channel, and the contents of the programable counter 169 is increased by "1" whenever the system clock pulse $CK_0$ is applied thereto. The contents of the counter 169 are outputted, as the signals $AD_0$ through $AD_7$, by the delay circuit 170. When the contents of the programable counter 169 reach "255" (1 1 1 1 1 1 1 1) and all of the output terminals $Q_0$–$Q_7$ have "1", the signal "1" is outputted by the AND gate 175. In this case, in the signal FC forming circuit 176 the operation is carried out as indicated in the time chart in FIG. 19 to form the signal FC. Thereafter, the programable counter 169 starts a counting operation for the 1st channel. Thus, the counting operation for all the channels are carried out.

In the WT.AL mode, the programable counter 169 is first reset by the output signal of the AND gate 172, as a result of which the contents thereof are changed to "0" for starting the counting operation. Similarly as in the above-described case, when the contents reach "255", the signal FC is outputted to complete this mode.

In the RD.AL mode, at the start of the operation the programable counter 169 is reset by the output signal of the AND gate 173 to "0", thereby start is counting operation. When the contents of the programable counter 169 reaches "255", the signal FC is outputted. Thus, the operation in this mode has been completed.

Figure 9:
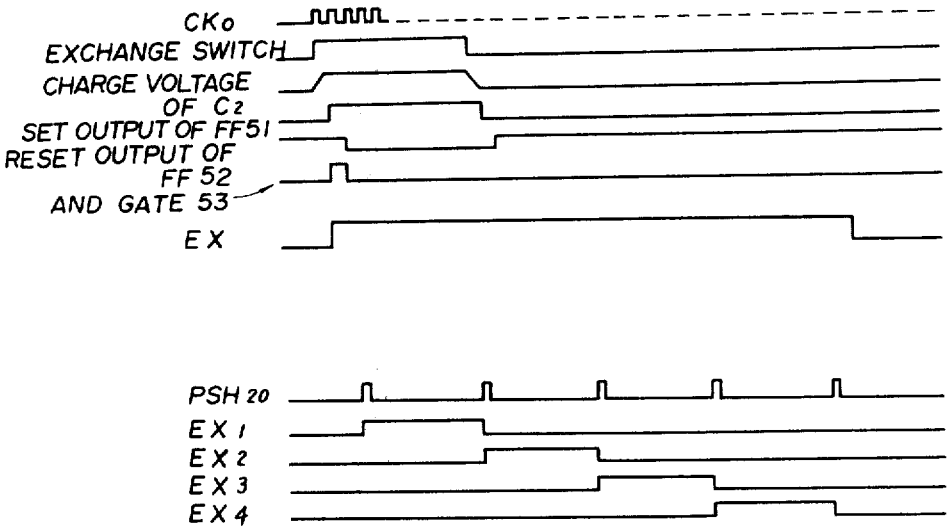
FIG. 9 shows waveforms for a description of the operation of a pulse forming circuit 50 in the panel control logic 25.

The operation in the EX mode will be described. In this case, two tone select switches in the same channel or in different channels have been turned on. For instance, in the case where the tone select switches $TS_1$ and $TS_7$ in the 0-th channel have been turned on, the output of the switch $TS_1$ is provided with priority by the preferential encoder 147, while the output of the switch $TS_7$ is provided with priority by the priority encoder 148. The preferential 147 is operated while the "enable" signal is being applied thereto. As indicated in the time chart in FIG. 21, the set output (or the enable signal) of the FF 159 is produced while the signals $EX_2$ and $EX_3$ are being outputted. (Refer to the time chart in FIG. 9). Accordingly, after the signal EX has been outputted in the EX mode, the first signal $PSH_{20}$ is outputted and the signal $EX_1$ is produced, whereupon signals corresponding to the tone select switch $TS_7$ are outputted by the priority encoder 148 and are applied to the input terminals $A_5$, $A_6$ and $A_7$ of the comparator 161 and to the input terminals $P_5$, $P_6$ and $P_7$ of the programable counter 169. At the same time, the output signal EX, $PSH_{20}$ of the AND gate 179 causes the programable enable signal to be applied to the input terminal PE of the programable counter 169, and the signals "0" are applied to the input terminals $P_0$ through $P_4$ of the programable counter 169. Accordingly, the programable counter 169 starts its counting operation at the content "224". When the content reaches "244", the coincidence signal A=B is outputted by the comparator 161, and the signal $O_{A=B}$ and the signal $EX.PSH_{20}$ are outputted at the same time.

When it becomes a time interval during which the signal $EX_2$ is outputted, the preferential encoder 147 becomes operable, as a result of which signals corresponding to the switch $TS_1$ are delivered to the comparator 161 and the programable counter 169. Thus, the programable counter 169 starts its counting operation at the content "0". When the content reaches "20", the coincidence signal A=B is outputted by the comparator 161.

Subsequently, when it becomes a time interval during which the signal $EX_3$ is outputted, the programable counter 169 carries out an operation similar to that in the signal $EX_2$ outputting time interval. Then, when it becomes a time interval during which the signal $EX_4$ is outputted, the programable counter 169 carries out an operation similar to that in the signal $EX_1$ outputting time interval. Upon completion of this operation, the EX mode is ended. As was described above, as the signals $EX_1$ through $EX_4$ are sequentially outputted, the programable counter 169 carries outs operations with respect to the tone select switches $TS_7$, $TS_1$, $TS_1$ and $TS_7$, respectively, as a result of which the contents of the blocks in the RAM specified by the switches $TS_1$ and $TS_7$ are exchanged for each other.

(2-9) Detailed Description of the Memory Device MEM

Figure 22:
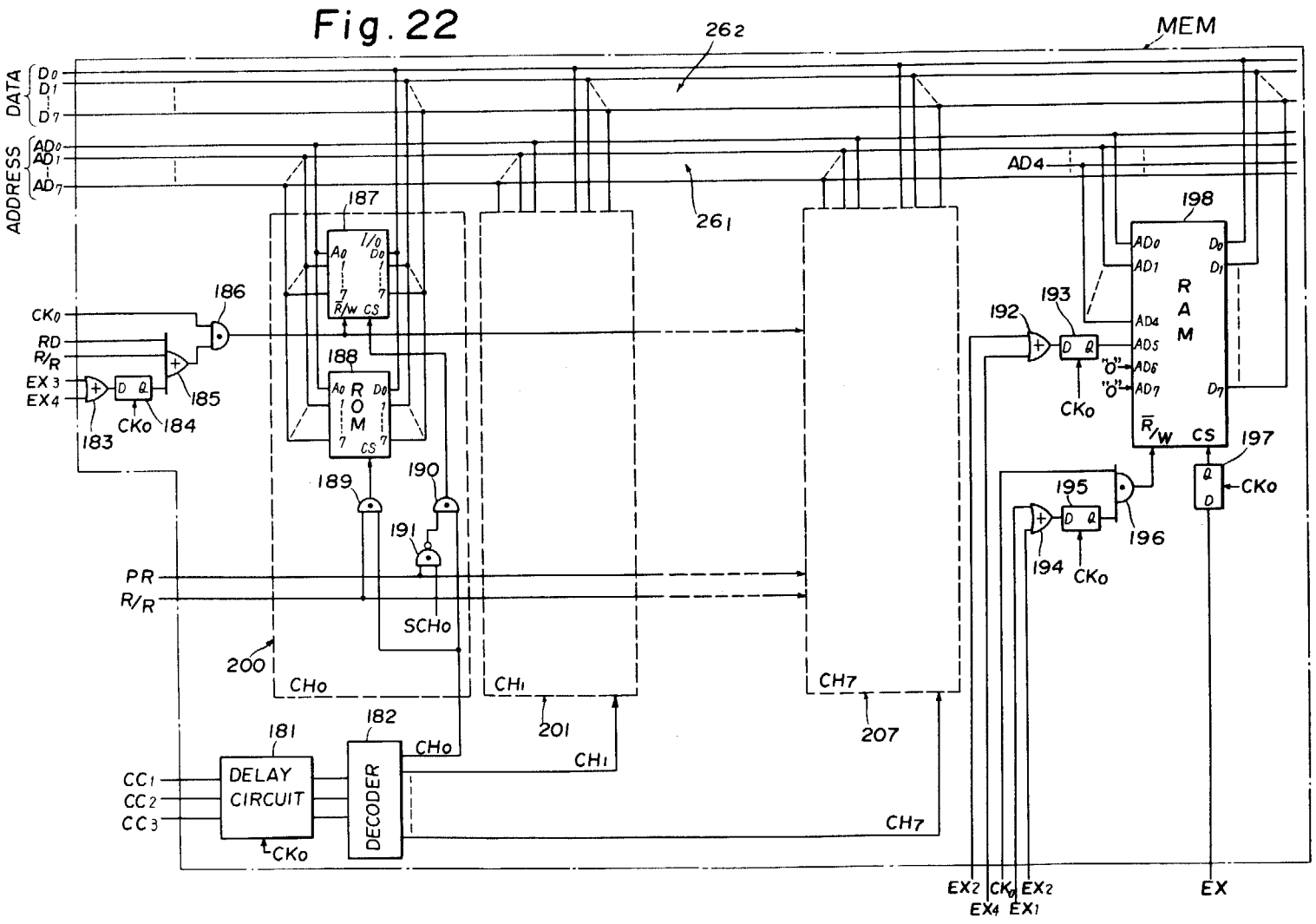
FIG. 22 is a schematic circuit diagram, partly as a block diagram, showing a memory device MEM and more specifically a memory control logic 12, a RAM 13, a ROM 14 and a RAM 15 forming the memory device MEM shown in FIG. 4.

The arrangement of the memory device MEM will be described with reference to FIG. 22. The memory device MEM comprises the memory control logic 12, and the memories 13, 14 and 15. In this embodiment, a pair of RAM 13 and ROM 14 are provided for each of the channels. Each of the RAM 13 and ROM 14 has a capacity of 256 words×8 bits (refer to FIG. 23). Memory blocks 200 through 207 provided for each channel are identical with one another. Therefore, as representative of all the memory blocks, the memory block 200 will be described. In this embodiment, the RAM and the ROM for each channel are formed in one chip respectively. Therefore, selection of the channels means selection of the chips. The 8-bit data $D_0$–$D_7$ delivered through the data bus $26_2$ are applied to the data input-output terminals $D_0$–$D_7$ of a RAM 187 of the memory block 200 where they are written in. The data $D_0$–$D_7$ in the RAM 187 are read out through the data input-output terminals $D_0$–$D_7$ and are applied to the data bus $26_2$. The data $D_0$–$D_7$ (standard tone property information) written in a ROM 188 are read out through the data output terminals $D_0$–$D_7$ and are written in the RAM 187. In writing the data $D_0$–$D_7$ in the RAM 187 or in reading the data out of the RAM 187 or in reading the data $D_0$–$D_7$ out of the ROM 188, the address signals $AD_0$–$AD_7$ from the address bus $26_1$ are delivered to the address input terminals $AD_0$–$AD_7$ of the RAM 187 and of the ROM 188, whereby the addresses where the data $D_0$–$D_7$ are or may be stored are specified. The output signal "1" of an AND gate 186 is applied, as a write instruction signal, to the read/write control terminal $\overline{R}/W$ of the RAM 187. The system clock pulse $CK_0$ is applied to a first input terminal of the AND gate 186, while the signals RD and R/R are applied through an OR gate 185 to a second input terminal of the AND gate 186. The signals $EX_3$ and $EX_4$ are introduced through an OR gate 183 to a Delayed-type FF 184, where a signal obtained by delaying the signal $EX_3$ or $EX_4$ by one bit is applied through the OR gate 185 to the second input terminal of the AND gate 186. In other words, in the R/R mode, the RD.AL mode, the RD.SL mode, or the EX mode, in the RAM 187 the output signal of the AND gate 186 is raised to "1", and the data read out of the ROM 188 or the magnetic card (not shown) are written therein with the aid of the system clock pulse $CK_0$ applied thereto. When the output signal of the AND gate 186 is at "0", the RAM 187 receives the read instruction. The FF 184 is driven by the system clock pulse $CK_0$.

In order to select the chip of the RAM 187 or the ROM 188 by designating a channel, selection signals outputted by AND gates 190 and 189 are applied to the chip select terminals CS of the RAM 187 and the ROM 188, respectively. The channel timing signal $CH_0$ is applied to first input terminals of the AND gates 190 and 189. The channel timing signal $CH_0$ is formed as follows: The channel codes $CC_1$–$CC_3$, after being delayed by one bit by a delay circuit 181 which is driven by the system clock pulse $CK_0$, are applied to a decoder 182, where the channel timing signal $CH_0$ together with the other channel timing signals $CH_1$ through $CH_7$ is formed. The channel timing signals $CH_1$ through $CH_7$ are, of course, applied to AND gates (not shown) in the memory blocks 201 through 207 of the channels, respectively. Applied to a second input terminal of the AND gate 190 is the output of a NAND gate 191 which receives the signal PR and the channel timing signal $SCH_0$. On the other hand, the signal R/R is applied to the second input terminal of the AND gate 189. In other words, while tone color information is formed by the tone color setting board 16 (that is, in the PR.$\overline{WT}$ mode or in the PR.WT mode), with the RAM 187 the output of the NAND gate 191 becomes "0" and no selection signal is provided by the AND gate 190, and therefore in this case rewriting the contents of the RAM 187 is inhibited. On the other hand, with the ROM 188, the selection signal is outputted by the AND gate 189 and is applied to the chip select terminal CS of the ROM 188, and therefore the contents of the ROM 188 are written in the RAM 187.

The completely same operation as that described above is carried out for the memory blocks 201 through 207 of the other channels $CH_1$ through $CH_7$. Accordingly, the channel timing signals $SCH_1$ through $SCH_7$ are applied to NAND gates (corresponding to the above-described NAND gate 191) of the memory blocks 201 through 207, respectively.

The RAM 198 for temporary memory used in the EX mode will be described. The arrangement of the RAM 198 is identical with that of the RAM 187 described above. As will be described later, in the EX mode, when the timing signals $EX_1$ and $EX_2$ are outputted, the data of two blocks intended to be exchanged are read out of the RAM in the memory block and are stored respectively in different regions in the RAM 198; and when the timing signals $EX_3$ and $EX_4$ are outputted, the data temporarily stored in the RAM 198 are read out, and the data thus read out, after being exchanged, are stored in the RAM's of the memory blocks. For this purpose, the address signals $AD_0$–$AD_4$ are applied to the address input terminals $AD_0$–$AD_4$ of the RAM 198. Applied to the address input terminal $AD_5$ of the RAM 198 is a signal obtained by delaying by a Delayed-type FF 193 the timing signal $EX_2$ or $EX_4$ applied thereto through an OR circuit 194. The FF 193 is driven by the system clock pulse $CK_0$. The address input terminals $AD_6$ and $AD_7$ are maintained at "0" at all times. Thus, data each having one block with twenty (20) words are written in different regions in the RAM 198 through the data input-output terminals $D_0$–$D_7$ thereof and are read out. Furthermore, in order that when the signals $EX_1$ and $EX_2$ are outputted, the write instruction signal "1" is applied to the read/write terminal $\overline{R}/W$ of the RAM 198, the system clock pulse $CK_0$ is applied to a first input terminal of an AND gate 196, while a signal obtained by delaying by a Delayed-type FF 195 the signal $EX_1$ or $EX_2$ applied thereto through an OR circuit 194 is applied to a second input terminal of the AND gate 196. Being driven by the system clock pulse $CK_0$, the FF 195 operates to delay the signals $EX_1$ and $EX_2$ by one bit. Thus, a signal is outputted, as the write instruction signal, by the AND circuit 196 in synchronization with the system clock pulse $CK_0$. Furthermore, a signal obtained by delaying the signal EX by one bit by a Delayed-type FF 197 is employed as a chip select signal for the RAM 198, and the signal is applied to the chip select terminal CS thereof.

The above-described signals EX, and $EX_1$ through $EX_4$ are delayed by one bit by the D-type FF's 184, 193, 195 and 197 as described above. This is to establish timing coincidence with the address signals $AD_0$–$AD_7$ which are delayed by one bit by the delay circuit 170 described with reference to FIG. 16.

Figure 23:
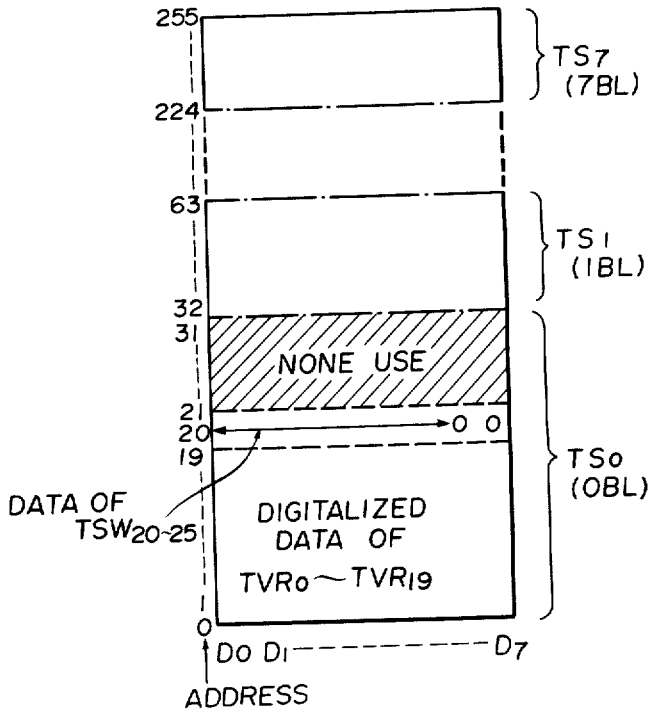
FIG. 23 is an explanatory diagram showing the memory region of the RAM 13 and the ROM 14 shown in FIG. 22.

Referring to FIG. 23, the RAM and ROM in each of the memory blocks and the RAM 198 for temporary memory will be further described. As was described before, each memory has a capacity of 256 words×8 bits. In addition, each memory is divided into eight (8) blocks: the 0-th block has addresses 0–31, the 1st block had addresses 32–63, and so forth, thus each block having 32 addresses. In each block, the first 21 addresses are employed for storing data for one tone color, and the remaining 11 addresses are not used. In addition, in each of the 0-th to 7th blocks, pieces of information obtained by subjecting the pieces of output information of the musical tone determining element control variable resistors $TVR_0$ through $TVR_{19}$ to analog-to-digital conversion are stored, as 8-bit data $D_0$–$D_7$ in the first 20 addresses, respectively. And the on-off information of the six (6) tone property effecting switches $TSW_{20}$ through $TSW_{25}$ is stored in the lower 6 bits ($D_0$–$D_5$) in the twenty-first (21st) address in each block. Segregation of the 0-th–7th blocks is carried out by using the higher three bits $AD_5$, $AD_6$ and $AD_7$ out of the 8-bit address signal $AD_0$–$AD_7$. The relationship between block and code is shown in Table 2 below:

TABLE 2

| Block | Address Signal | | |
|---|---|---|---|
| | $AD_5$ | $AD_6$ | $AD_7$ |
| 0 | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |
| 6 | 0 | 1 | 1 |
| 7 | 1 | 1 | 1 |

The operation of the above-described memory control logic will be described. In any operation mode, the outputted channel code $CC_1$–$CC_3$ is applied to the delay circuit 181, where it is delayed by one bit and is then delivered to the decoder 182. The channel signals $CH_0$–$CH_7$ are sequentially outputted by the decoder 182, and are applied to the memory blocks 200 through 2007, respectively. In the case of the R/R mode, the signal R/R has been outputted. The AND gate 186 is opened by this signal R/R, as a result of which a write instruction is inputted to the $\overline{R}/W$ terminals of the RAM's in the memory blocks 200 through 207. In the case of the memory block 200, for instance, during the production of the channel signal $CH_0$ the output signals of the AND gates 189 and 190 are applied to the terminals CS of the RAM 187 and the ROM 188 to perform chip selection. As a result, by the address signals $AD_0$–$AD_7$ the addresses (that is, the blocks) of the ROM 188 and the RAM 187 are successively specified, and the contents of the ROM 188 are transferred to the corresponding address of the RAM 187. Such an operation as described above is carried out for the other memory blocks 201 through 207 during the production of the channels signals $CH_1$ through $CH_7$, respectively.

During the write operation, that is, in the PR.WT mode or in the WT.AL mode, the AND gate 186 has been closed. Therefore, a signal "0" is applied, as a read instruction signal, to the $\overline{R}/W$ terminal of the RAM in each of the memory blocks 200 through 207. In the WT.AL mode, the data in the RAM of one of the memory blocks 200 through 207 which corresponds to an operated one of the channel selecting switches $SU_1$ through $SS_2$ is recorded in a magnetic card. In the PR.WT mode, the tone color information formed in the tone color setting board 16 is not written in the RAM, and instead it is written through a card logic 22 (described later) in a magnetic card, and therefore the RAM's in the memory blocks 200 through 207 are not selected, and signals "0" (the "0" output of the AND gate 190 in the case of the memory block 200) are applied to the terminals CS thereof. In the PR.$\overline{WT}$ mode, similarly as in the PR.WT mode, the tone color information formed in the tone color setting board 16 is not written in the RAM's, and input signals to the terminals CS of the RAM's are at "0".

During the read operation, that is, in the RD.SL mode or in the RD.AL mode, the signal RD is provided, and therefore a write instruction (or a signal "0") is applied to the $\overline{R}/W$ terminal of the RAM in each of the memory blocks 200 through 207. And a RAM corresponding to an operated one of the channel selecting switches $SU_1$ through $SS_2$ is selected during the production of a corresponding channel timing signal ($CH_0$–$CH_7$), and therefore the tone color information in the magnetic card is transferred to the RAM.

In the EX mode, two tone select switches, for instance the switches $TS_1$ and $TS_7$, in the same channel or in different channels are operated. In this case, the signal EX is first outputted, and it is applied to the terminal CS of the RAM 198 after being delayed by one bit by the FF 197. During the production of the signal $EX_1$ or $EX_2$, the output of the AND gate 186 is at "0", and therefore the read instruction signal is applied to the $\overline{R}/W$ terminal of the RAM in each of the memory blocks 200 through 207. Since the timing signals $EX_1$, $EX_2$, $EX_3$ and $EX_4$ are produced successively in the stated order, during the production of the signal $EX_1$ a signal "0" is, of course, applied to the address input terminal $AD_5$ of the RAM 198. In this connection, both input signals to the address input terminals $AD_6$ and $AD_7$ are at "0". In this case, the address of the RAM in a channel to which an operated tone select switch, for instance the switch $TS_1$, belongs is applied to the address input terminals $AD_0$–$AD_4$, for the lower five bits, of the RAM 198. Accordingly, data for one block in the RAM corresponding to the switch $TS_1$ are written in a region for one block in the RAM 198. When the signal $EX_2$ is next produced, the address of the RAM in a channel to which the other switch $TS_7$ belongs is specified for the RAM 198 with the aid of the address signals $AD_0$–$AD_5$. As a result, data for one block in the RAM corresponding to the switch $TS_7$ are written in a region, apart from the region relating the switch $TS_1$, in the RAM 198.

During the production of the signal $EX_1$ or $EX_2$, the output of the AND gate 196 is raised to "1", which is applied, as the write instruction signal, to the terminal $\overline{R}/W$ of the RAM 198. When the signals $EX_3$ and $EX_4$ are outputted subsequently, the output of the AND gate 196 is lowered to "0", and this signal "0" is applied, as the read instruction signal, to the terminal $\overline{R}/W$ of the RAM 198. During the production of the signals $EX_3$ and $EX_4$, the output of the AND gate 186 is raised to "1", and the write instruction signal is, therefore, applied to the terminal $\overline{R}/W$ of the RAM in each of the memory blocks 200 through 207. Accordingly, during the production of the signal $EX_3$, with the aid of the address signal applied to the address input terminals $AD_0$ through $AD_4$ of the RAM 198 the address which has been previously specified for the tone select switch $TS_1$ is specified, and the data for one block corresponding to the switch $TS_1$ is written from that block into the corresponding block in the RAM which has initially stored the data corresponding to the switch $TS_7$. Then, when the signal $EX_4$ is outputted, similarly as in the above-described case, with the aid of the address signal applied to the address input terminals $AD_0$–$AD_4$ of the RAM 198 the address which has been specified for the tone select switch $TS_7$ is specified, and the data for one block corresponding to the switch $TS_7$ is written from that block into the corresponding block in the RAM which has initially stored the data corresponding to the switch $TS_1$. As a result, the data in the RAM's specified by the two tone select switches are exchanged for each other, and the desired performance mode is obtained.

(2-10) Detailed Description of the Card Reader Control Logic 24

The arrangement of the card reader control logic 24 will be described with reference to FIG. 24.

Figure 3:
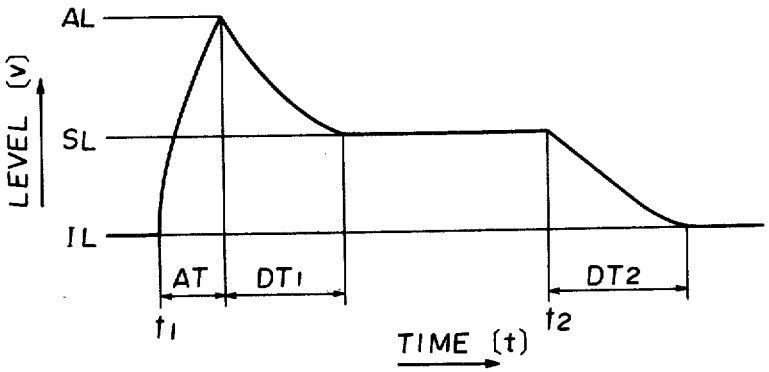
FIG. 3 shows a control voltage waveform for forming musical tones employed in an electronic musical instrument of a synthesizer type.

A card reader (or a magnetic card reader) 23 employed in this embodiment follows a procedure described below in writing data in a magnetic card or reading data out of it and outputs control signals WPS, SBO and RSS. Upon insertion of a magnetic card into the card inlet, the card transferring motor starts rotation in a forward direction, and the card is transferred passing through the position where the magnetic head is provided. During this card transferring operation, no data reading nor data writing is carried out. When the magnetic card passes through the magnetic head, the passage of the magnetic card is detected by a reverse switch, and the detection signal is applied to the card transferring motor. As a result, the rotation of the motor is reversed so that the magnetic card is returned to the card inlet. During the return of the card, reading data into the magnetic card or writing data in the magnetic card is carried out. During such a card transferring operation, except for the time instant immediately after the transferring of the card is started and the time instant immediately after the card returned to the card inlet by the reverse rotation of the motor is stopped, a card loading signal (or the signal SBO in FIG. 27) is outputted by the card reader 23. When the magnetic card is detected by the reverse switch as described before, a reverse switch signal (or the signal RSS in FIG. 27) is outputted by the card reader 23. Upon provision of the signal RSS, a write protect signal (or the signal WPS in FIG. 27) is outputted by the card reader 23. This signal WPS is effective when it is at "0", that is, after the signal WPS is outputted, a state where the writing operation can be performed is obtained. In the circuitry shown in FIG. 24, the signal WRS (write-read control signal) and reset signal RS are formed with the aid of the signals WPS, SBO and RSS. More specifically, the signal WPS is applied to an inverter 211 the output of which is connected through a resistor $R_{30}$ to a first input terminal of a NAND gate 212. This first input terminal of the NAND gate 212 is connected to one terminal of a capacitor $C_{10}$ the other terminal of which is grounded. A second input terminal of the NAND gate 212 is connected to one terminal of a resistor $R_{31}$ the other terminal of which is connected to the power supply providing a signal "1", and to the input terminal of the inverter 211. The output of the NAND gate 212 and a signal obtained by inverting the signal WT by an inverter 213 are applied to a NOR gate 215, the output of which is applied to a set input terminal S of an RS-type FF 216. A signal obtained by inverting the aforementioned signal SBO by an inverter 214 is applied to the reset input terminal R of the FF 216. The reset output of the FF 216 is referred to as the signal WRC, which is applied to the card I/O logic 22 (FIG. 3). The signal RSS is applied to a resistor $R_{33}$ to charge a capacitor $C_{11}$ a first terminal of which is connected to the output terminal of the resistor $R_{33}$, and a second terminal of which is grounded. The first terminal of the capacitor $C_{11}$ and accordingly the output terminal of the resistor $R_{33}$ are connected to the input terminal D of an Delayed-type FF 218. The input terminal of the resistor $R_{33}$ is connected through a resistor $R_{32}$ to the power supply providing a signal "1". The reset output of the FF 218 is connected to a NOR gate 217, a NOR gate 220 and the input terminal D of a Delayed-type FF 219. The reset output of the FF 219 is applied to the NOR gate 220, the output of which is in turn applied to one input terminal of an AND gate 222 to the other input terminal of which the signal RD is applied. The reset output (the signal WRC) of the FF 216 is applied to the NOR gate 217. The outputs of the NOR gate 217 and the AND gate 222 are applied to an OR gate 223, the output of which is employed as the signal RS. The FF's 218 and 219 are driven by a frequency 500 Hz clock pulse outputted by an oscillator 221.

Figure 25:
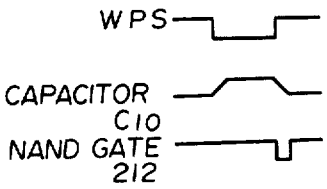
FIG. 25 and FIG. 26 are waveform charts for a description of the operation of a part of the card reader control logic 24.
Figure 26:
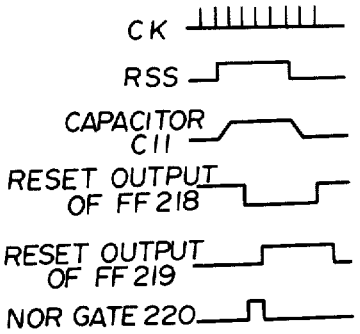
Figure 27:
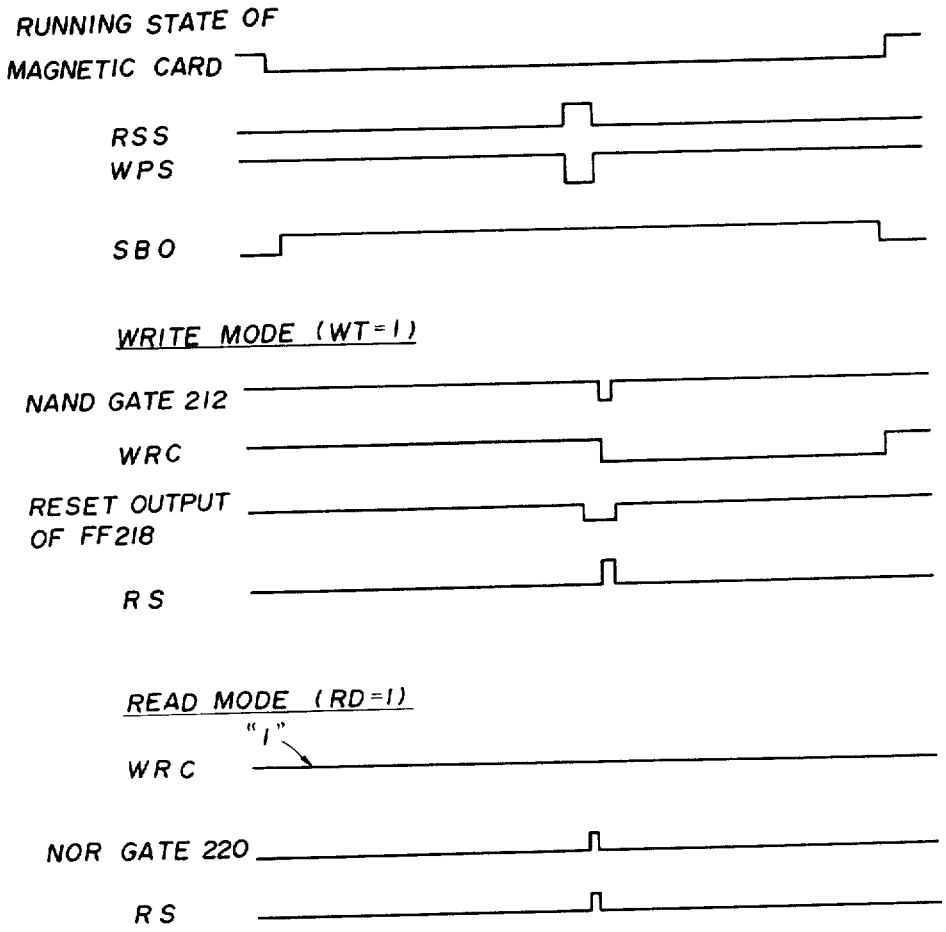
FIG. 27 is a waveform chart for a description of the operations of write mode and read mode of the card reader control logic 24.

The operation of the circuitry shown in FIG. 24 will be described with reference to the time charts shown in FIGS. 25 through 27.

First of all, in the writing operation, the signal WT has been outputted. Accordingly, the output of the inverter 213 is at "0". Upon insertion of a magnetic card into the card inlet of the card reader 23, the card transferring motor starts rotation in a forward direction, and the signal SBO is outputted and is raised to "1". When the magnetic card has been completely inserted, it is detected by a reverse switch. As a result, a "1" level signal, that is, the signal RSS is outputted (FIG. 27), whereupon the rotation of the motor is reversed. At the same time, the level of the signal WPS which is normally maintained at "1" is inverted into "0". When the signal WPS is switched to "0", the output of the inverter 211 is raised to "1", and therefore the capacitor $C_{10}$ is gradually charged to the "1" level.

When the signal WPS is eliminated and the "1" level is obtained, the capacitor $C_{10}$ starts discharging. However, while the potential of the capacitor $C_{10}$ is still at "1", both inputs to the NAND gate 212 are at "1", and therefore during this period the NAND gate 212 outputs a negative-going pulse. Accordingly, the Nor gate 215 outputs a positive-going pulse in synchronization with the negative-going pulse, as a result of which the FF 216 is placed in a set state. Accordingly, at that time, the reset signal of the FF 216, namely, the signal WRC is lowered to "0". (Refer to FIG. 27, in which all the data are provided on the same time axis (or horizontal axis).) Upon provision of the signal RSS, the capacitor $C_{11}$ is charged. The charge value of the capacitor $C_{11}$ reaches the "1" level, and then the level of the reset output of the FF 218 is switched to the "0" level as indicated in the time chart in FIG. 25. Thus, when both of the signal WRC and the reset output of FF 218 are at "0", as indicated in FIG. 27, the output of the NOR gate 217 is obtained and is outputted, as the reset signal RS, through the OR gate 223. This reset signal RS is applied to the card I/O logic 22, etc., whereby various circuits are reset so as to write data into a magnetic card.

In the reading operation, the signal RD is outputted and is maintained at the "1" level. In this case, as the signal WT is, of course, at the "0" level, the output of the inverter 213 is raised to "1". Therefore, the output of the NOR gate 215 is lowered to "0", and the set input of the FF 216 is maintained at the "0" level at all times. Upon insertion of a magnetic card into the card inlet, the card transferring motor starts rotation and the signal SBO is outputted. However, before the signal SBO is outputted, the reset input signal to the FF 216 is at the "1" level, and therefore the FF 216 is in a reset state, and the reset output signal, namely, the signal WRC is at the "1" level. Even if the reset input of the FF 216 is lowered to the "0" level by the production of the SBO, the set input "1" is not applied thereto, and therefore the reset output (the signal WRC) is maintained at the "1" level (FIG. 27). If this state is followed, the signal RSS is delivered to the NOR gate 220 after being delayed by the FF's 218 and 219 as is apparent from the time chart in FIG. 26. When the reset outputs of the FF's 218 and 219 are both at "0", a pulse signal "1" is outputted by the NOR gate 220 and is delivered to the AND gate 222. Therefore, the AND gate 222 outputs a signal synchronous with the aforementioned pulse signal, and this output signal is applied to the OR gate 223, which in turn outputs the reset signal RS.

As a result, after the reset signal RS has been outputted, data is read out of the magnetic card.

(2-11) Detailed Description of the Card I/O Logic 22

Figure 28:
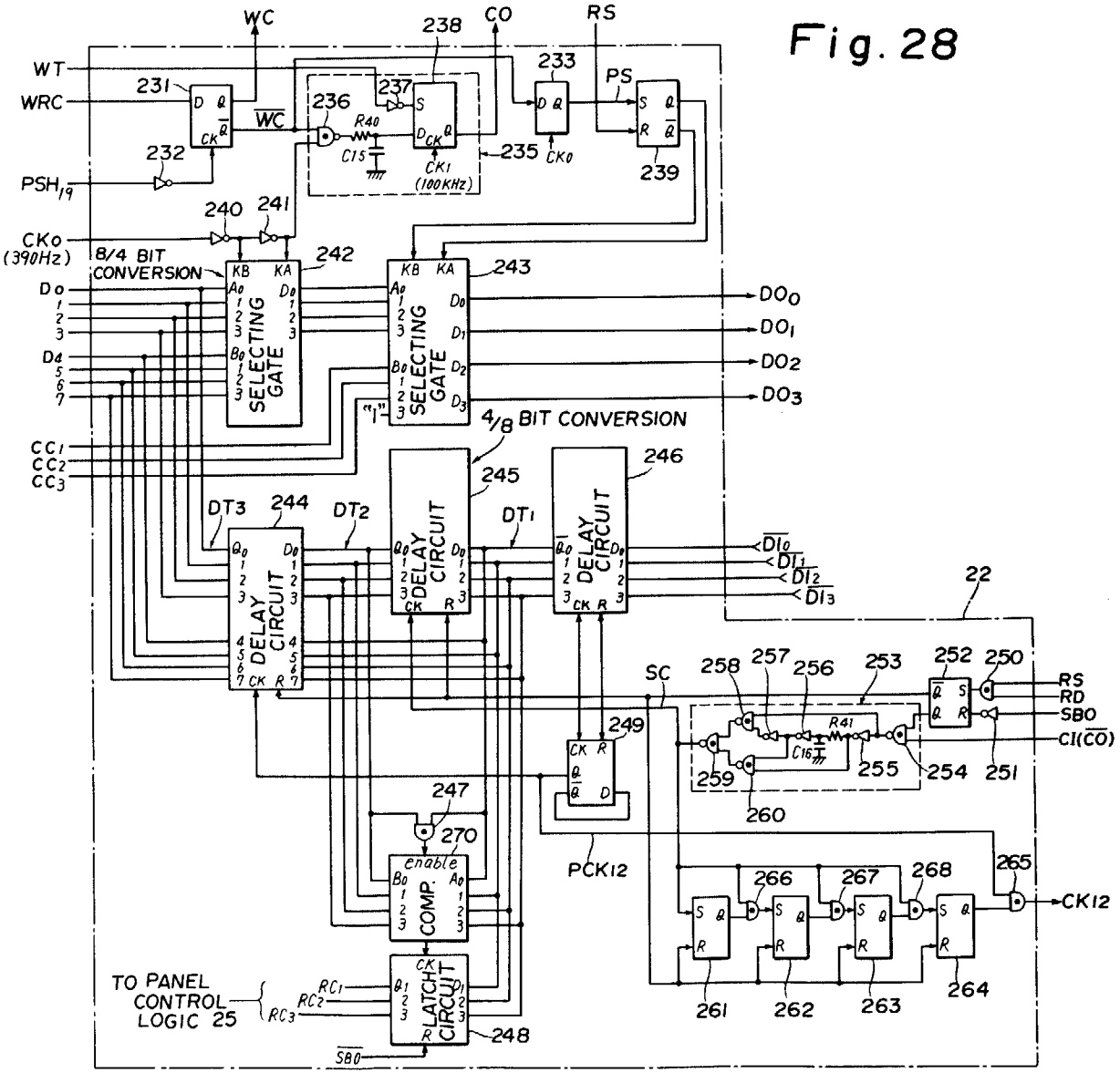
FIG. 28 is a schematic circuit diagram, partly as a block diagram, illustrating a card I/O logic 22 shown in FIG. 4.

Referring to FIG. 28, the arrangement of the card I/O logic 22 will be described. First, a writing control circuit will be described. The write-read control signal WRC is applied to the input terminal D of a Delayed-type FF 231 which is driven by a signal obtained by inverting the timing signal $PSH_{19}$ by an inverter 232. From the outputs of the FF 231 a write control signal WC and its inverted signal $\overline{WC}$ are obtained. The latter signal $\overline{WC}$ is applied to the input terminal D of a Delayed-type FF 233, the output of which is applied to the set input terminal S of an RS-type FF 239 to place the latter in a set state. The reset signal RS (FIG. 27) is applied to the reset input terminal R of the FF 239 to place the latter 239 in a reset state. The set output of the FF 239 and the reset output of the same are applied, as control signals, to the control input terminal KA of a select gate 243 and to the control input terminal KB of the same, respectively. The 8-bit data $D_0$–$D_7$ obtained from the RAM in each of the memory blocks 200 through 207 described reference to FIG. 22 or from the tone color setting board 16 is divided into the higher 4 bits and the lower 4 bits ($D_0$–$D_3$ and $D_4$–$D_7$) which are written in a magnetic card, in this embodiment. That is, the lower 4 bits $D_0$–$D_3$ are applied to the "A" side input terminals $A_0$ through $A_3$ of the select gate 242, respectively, while the higher 4 bits $D_4$–$D_7$ are applied to the "B" side input terminals $B_0$ through $B_3$, respectively. A signal obtained by inverting the system clock pulse $CK_0$ by inverters 240 and 241 (that is, the system clock pulse $CK_0$) and a signal obtained by inverting the system clock pulse $CK_0$ by inverter 240 are applied to the control input terminals KA and KB of the select gate 242, respectively. Accordingly, for the interval during which the system clock pulse $CK_0$ is applied to the control input terminal KA of the select gate 242, the lower 4 bits data $D_0$–$D_3$ are outputted at the output terminals $D_0$–$D_3$ thereof and are applied to the "A" side input terminals $A_0$–$A_3$ of the select gate 243. Similarly, for the interval during which the signal obtained by inverting the system clock pulse $CK_0$ is applied to the control input terminal KB of the select gate 242, the higher 4 bits data $D_4$–$D_7$ are provided at the output terminals $D_0$–$D_3$ thereof and are applied to the "A" side input terminals $A_0$–$A_3$ of the select gate 243. As is apparent from the above description, the select gate 242 is an 8/4 bit conversion element in which inputted 8 bits data are outputted as 4 bits data $D_0$–$D_3$ and $D_4$–$D_7$ with time delay. The channel codes $CC_1$–$CC_3$ relating to the data $D_0$–$D_3$ and $D_4$–$D_7$ applied to the input terminal $A_0$–$A_3$ of the select gate 243 are applied, as 3 bits data, to the "B" side input terminals $B_0$–$B_2$ of the select gate 243. The remaining "B" side input terminal $B_3$ is maintained at "1" at all times. Accordingly, for the period during which the "1" reset output of the FF 239 is applied to the control input terminal KB of the Select gate 243, the channel codes $CC_1$–$CC_3$ are provided, as data $DO_0$–$DO_3$ for writing in the magnetic card, at the output terminals $D_0$–$D_3$ of the select gate 243. On the other hand, for the period during which the "1" set output of the FF 239 is applied to the control input terminal KA of the select gate 243, and 4 bits data $D_0$–$D_3$ and $D_4$–$D_7$ are provided, as data $DO_0$–$DO_3$ for writing in the magnetic card, at the output terminal $D_0$–$D_3$.

The aforementioned data $D_0$–$D_7$, the channel codes $CC_1$–$CC_3$, and a clock pulse are simultaneously recorded in the magnetic card. In the reading operation, the data $D_0$–$D_7$ and the channel codes $CC_1$–$CC_3$ are read out of the magnetic card on the clock pulse. In this embodiment, the clock pulse recorded in the magnetic card will be referred to as "a writing clock pulse CO". In addition, a clock pulse is obtained by treating a clock pulse CI (this clock pulse CI is obtained by inverting the writing clock pulse CO) read out of the magnetic card and it is employed in the reading operation. This clock pulse will be referred to as "a reading clock pulse $CK_{12}$".

Now, a circuit for forming the aforementioned writing clock pulse CO will be described. The signal WRC is applied to the input terminal D of the D-type FF 231 which is driven by the signal obtained by inverting the timing signal $PSH_{19}$ by the inverter 232 as described before. The set output signal of the FF 231 is the signal WC which is applied to the address generator 11 (FIG. 18). The reset output signal $\overline{WC}$ of the FF 231 and the system clock pulse $CK_0$ are applied to a NAND gate 236 in the writing clock CO forming circuit 235. The output terminal of the NAND gate 236 is connected through a resistor $R_{40}$ to the input terminal D of a Delayed-type FF 238, and the input terminal D is grounded through a capacitor $C_{15}$.

The signal WT is applied through an inverter 237 to the input terminal S of the FF 238. The FF 238 is driven by the clock pulse $CK_1$ of frequency 100 KHz, whereby the writing clock pulse CO is outputted from its set output terminal Q. The system clock pulse $CK_0$ is a clock pulse whose frequency is 390 Hz. In the writing operation, data is written in a magnetic card at the rise (or decay) of the system clock pulse $CK_0$. Therefore, if the clock pulse CO recorded in the magnetic card is a clock pulse which is outputted with the same timing as that of the system clock pulse $CK_0$, then the following error may occur. That is, in the case where, in the writing operation, data has been recorded in the magnetic card with the timing of the system clock pulse $CK_0$ being shifted from that of the writing clock pulse for some reason, the data cannot be correctly read out in the reading operation. In this embodiment, the clock pulse CO is so formed that the rise (decay) thereof occurs between the rise (decay) and the decay (rise) of the system clock pulse $CK_0$. Therefore, the occurrence of such an error as described above can be positively prevented.

Figure 29:
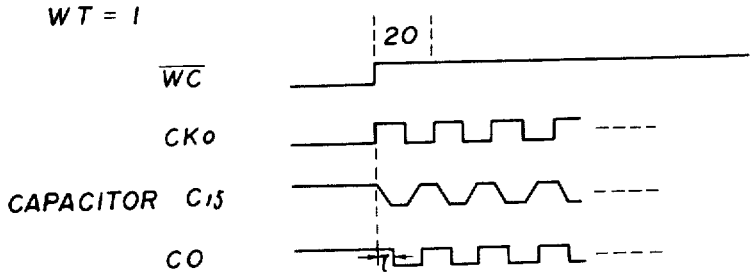
FIG. 29 is a waveform diagram for a description of the operation of a writing clock pulse CO forming circuit 235 in the card I/O logic 22 shown in FIG. 28.

The operation of the writing clock pulse CO forming circuit 235 will be described with reference to the time chart shown in FIG. 29. When the signal $PSH_{19}$ is outputted to raise the reset output (signal WC) of the FF 231 to "1" level, the NAND gate 236 provides a signal $\overline{CK_0}$ which is obtained by inverting the system clock $CK_0$. With the aid of this signal $\overline{CK_0}$, the capacitor $C_{15}$ is charged and discharged through the resistor $R_{40}$. On the other hand, a signal $\overline{WT}$ at "0" obtained by inverting the signal WT (at "1" level in this case) is applied to the input terminal S of the FF 238, while the voltage of the capacitor $C_{15}$ is applied to the input terminal D of the same. As is apparent from FIG. 29, the system clock pulse $CK_0$, being delayed by the time ($\tau$) is charging and discharging the capacitor $C_{15}$, is introduced to the input terminal D of the FF 238, and therefore the set output of the FF 238, namely, the writing clock pulse CO also is outputted with the delay time ($\tau$). As a result, the rise (decay) of the writing clock pulse CO is caused to occur between the rise (decay) and the decay (rise) of the system clock pulse $CK_0$.

Now, the arrangement of the reading control circuit will be described. The data $D_0$–$D_3$ and $D_4$–$D_7$ and the channel codes $CC_1$–$CC_3$ recorded in 4 bits state in the magnetic card as described before are, in this embodiment, read, as reverse polarity signals $\overline{DI_0}$–$\overline{DI_3}$, out of the card reader. These signals $\overline{DI_0}$–$\overline{DI_3}$ are inputted to the input terminals $D_0$–$D_3$ of a delay circuit 246, where they are delayed by one bit and are outputted from the inverted output terminals $\overline{Q_0}$–$\overline{Q_3}$ with the polarity inverted. The outputs of the delay circuit 246 are referred to as data $DT_1$. The data $DT_1$ is applied to the input terminald $D_4$–$D_7$ of a delay circuit 244 and to the input terminals $D_0$–$D_3$ of a delay circuit 245 where it, being delayed by one bit, is outputted. The output data $DT_2$ from the output terminals $Q_0$–$Q_3$ of the delay circuit 245 is applied to the input terminals $D_0$–$D_3$ of the delay circuit 244, where it, being delayed by one bit, is outputted. The output data $DT_3$ from the output terminals $Q_0$–$Q_7$ of the delay circuit 244 is applied, as 8-bits data $D_0$–$D_7$, to a data bus 262. Thus, the 4-bits data $\overline{DI_0}$–$\overline{DI_3}$ read out of the magnetic card, passing through the delay circuits 245 and 244, is outputted, as 8-bits data $D_0$–$D_7$, by the delay circuit 244. That is, the two delay circuits 245 and 244 form a 4/8 bit conversion element.

Circuits for forming clock pulses SC and $PCK_{12}$ driving the delay circuits 244 through 246, a reset signal R, and the clock pulse $CK_{12}$ mentioned above will be described.

The reset signal RS, and the control signal RD outputted in the reading operation are applied to an AND gate 250, the output of which is inputted to the set input terminal S of an RS-type FF 252. When a signal obtained by inverting the signal SBO by an inverter 251 is applied to the reset input terminal R of the FF 252, the latter 252 is placed in a reset state. This reset output signal is applied to the reset input terminals R of the above-described delay circuit 244 through 246 to reset the latter at the same time. The clock pulse CI ($\overline{CO}$: the clock pulse CI being opposite in polarity to the writing clock pulse CO) read out of the magnetic card, and the set output signal of the FF 252 are applied to a NAND gate 254 in a ×2 multiplier 253. The output of the NAND gate 254 is applied to a first input terminal of a NAND gate 258 and to an inverter 255. The output of the inverter 255 is applied to a first input terminal of a NAND gate 260, to a capacitor $C_{16}$ whose one terminal is grounded, and to an inverter 256. The output of the inverter 256 is applied to a second input terminal of a NAND gate 260 and to a second input terminal of a NAND gate 258 through an inverter 257. The outputs of the NAND gate 258 and 260 are applied to a NAND gate 259. The output of the NAND gate 259 is applied to the delay circuits 245 and 246 and to the clock pulse input terminal CK of a D-type FF 249 as a clock pulse SC. The input terminal D of the FF 249 is connected to the reset output terminal $\overline{Q}$ of the same 249. The set output, referred to as the signal $PCK_{12}$, of the FF 249 is applied to the clock input terminal CK of the delay circuit 244 and to a first input terminal of an AND gate 265. The aforementioned clock pulse SC is applied to the set input terminal S of an RS-type FF 261 and to first input terminals of AND gates 266, 267 and 268. Applied to second input terminals of the AND gates 266, 267, 268 and 265 are the set outputs of the FF's 261, 262, 263 and 264, respectively. The output signals of the AND gates 266, 267 and 268 are applied to the set input terminals S of the FF's 262, 263 and 264. The output signal of the AND gate 265 is the aforementioned reading clock pulse $CK_{12}$. The reset output signal of the FF 252 is applied to the reset input terminals R of the FF 249, 261, 262, 263 and 264 to reset the latter.

Figure 30:
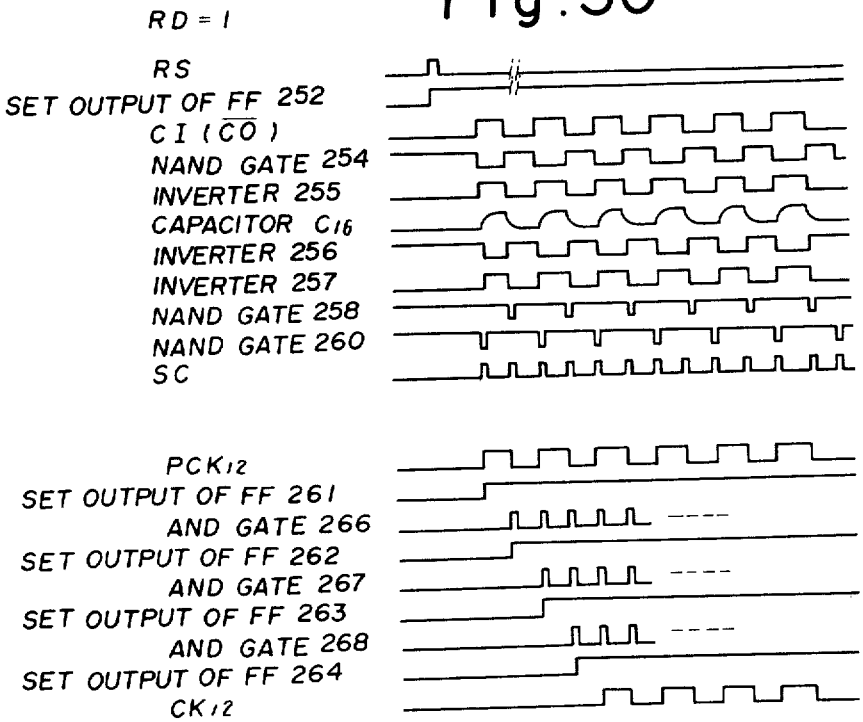
FIG. 30 shows waveforms for a description of the operations of a ×2 multiplier 253 and flip-flops 261 through 264 in the card I/O logic 22 shown in FIG. 28.

The operation of the circuits for forming the clock pulse SC and the reading clock pulse $CK_{12}$ will be described with reference to the time chart shown in FIG. 30. When the signal RD is at "1" and the reset signals RS ("1") is provided, a signal "1" synchronous with the reset signal RS is outputted by the AND gate 250, as a result of which the FF 252 is placed in set state, and its set output becomes "1". When, under this condition, the first clock pulse CI is read out of the magnetic card, the inverted signal of the clock pulse CI is outputted by the NAND gate 254. The output of the inverter 255 is a signal synchronous with the clock pulse CI, which is charged in the capacitor $C_{16}$. Since the RC circuit is a delay element, the output of the inverter 256 decays slightly later than the output signal of the inverter 255 rises, and it is applied to the NAND 258 through the inverter 257 and directly to the NAND gate 260. Accordingly, the output of the NAND gate 258 is maintained at "0" for the time interval which elapses from the instant that the output of the NAND gate 254 rises until the output of the inverter 257 falls, but it is at "1" for the other period of time. Similarly, the output of the NAND gate 260 is maintained at "0" for the time interval which elapses from the instant that the output of the inverter 255 rises until the output of the inverter 256 falls, but it is at "1" for the other period of time. Accordingly, the output of the NAND gate 259, namely, the signal SC becomes a "1" level signal when the outputs of the NAND gates 258 and 260 are at "1". Whenever each of the second, third, fourth . . . clock pulses CI is read out, two clock pulses SC are outputted. In other words, the clock pulse SC is outputted when the clock pulse CI rises and when the clock pulse CI falls. As all the FF 249 and 261 through 264 are reset at the start of the read operation, upon application of the first clock pulse SC the set output (the signal $PCK_{12}$) of the FF 249 is raised to "1", and simultaneously the input terminal D of the FF 249 is held at "0". Therefore when the second clock pulse SC is outputted, the set output (the signal $PCK_{12}$) of the FF 249 is lowered to "0". Accordingly, the signal $PCK_{12}$ becomes a signal having a waveform as indicated in FIG. 30 which is inverted whenever the signal SC is outputted. On the other hand, in the FF's 261 through 264, upon application of the first clock pulse SC the FF 261 is set, so that its set output is raised to "1" and thereafter maintained as it is. In addition, FF 262 is set by the second clock pulse SC, and the FF's 263 and 264 are set by the third and fourth clock pulses SC, respectively. Accordingly, after the fourth clock pulse SC is outputted to set the FF 264, the read clock pulse $CK_{12}$ is outputted in synchronization with the signal $PCK_{12}$. Thus, the read clock $CK_{12}$ is in timing with the output data $DT_3$ ($D_0$–$D_7$) of the delay circuit 244 by virtue of the operation of the four stage of FF's 261 through 264.

A detection circuit for detecting channels codes $RC_1$–$RC_3$ from the channel codes $CC_1$–$CC_3$ included in the data $\overline{DI_0}$–$\overline{DI_3}$ read out the magnetic card will be described. As was described with reference to FIG. 14, the channel signals $CH_0$–$CH_7$ in this embodiment have codes as indicated in Table 1. Accordingly, detection of the channel signals $CH_0$–$CH_7$ (that is, channel codes $RC_1$–$RC_3$) can be accomplished by subjecting equal digits, for instance the first and fifth digits or the second and sixth digits, to comparison. The lower 4 bits data $D_0$–$D_3$ and the higher 4 bits data $D_4$–$D_7$ out of the data $D_0$–$D_7$ are obtained as the output data $DT_2$ of the delay circuit 245 and the output data $DT_1$ of the delay circuit 246, respectively. In other words, the output (the data's fifth digit) at the output terminal $\overline{Q_0}$ of the delay circuit 246 and the output (the data's first digit) at the output terminal $Q_0$ of the delay circuit 245 are applied to an AND gate 247, the output of which is applied, as an enable signal, to the input terminal "enable" of a comparison circuit 270. The data $DT_1$ and $DT_2$ are applied to the input terminals $A_0$–$A_3$ and $B_0$–$B_3$ of the comparison circuit 270. The outputs (data's 5th–7th digits) from the outputter terminals $\overline{Q_1}$–$\overline{Q_3}$ of the delay circuit 246 are applied to the input terminals $DT_1$–$DT_3$ of a latch circuit 248. Upon application of a coincidence signal from the comparison circuit 270, the latch circuit 248 latches the inputted data to output the 3-bit channel code $RC_1$–$RC_3$ through its output terminals $Q_1$–$Q_3$. The latch circuit 248 is reset by a signal $\overline{SBO}$.

Figure 31:
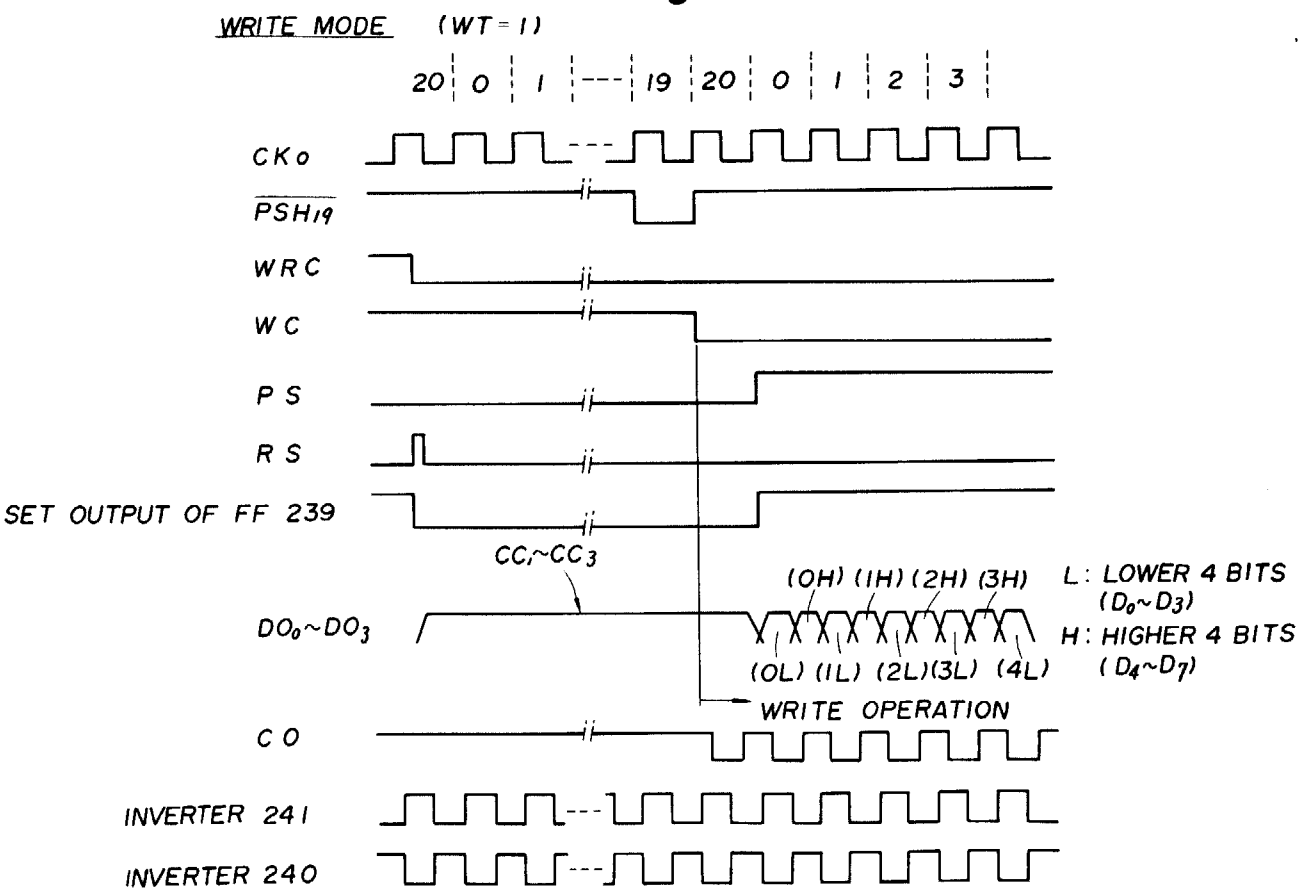
FIG. 31 shows waveforms for a description of the operation of the card I/O logic 22 in a write mode.

The writing and reading operation of the card I/O logic 22 thus organized will be described with reference to the time charts shown in FIGS. 29 and 30. First, the write mode will be described. In this mode, the signal WT is at "1". The system clock pulse $CK_0$ having a frequency of 390 Hz is applied to the card I/O logic 22. The reset signal RS is provided to reset the FF 239, etc. On the other hand, the signal WRC is inverted into "0", so that the writing operation may be effected. When under this condition the sampling timing signal $PSH_{19}$ is provided, the signal $PSH_{19}$ is inverted by the inverter 232 and is applied to the clock pulse input terminal of the FF 231. At the rise of this signal $\overline{PSH}_{19}$, the signal $\overline{WC}$ ("1") is provided at the output terminal $\overline{Q}$ of the FF 231, so as to be applied to the terminal D of the FF 233. Upon application of the clock pulses $CK_0$, the signal PS "1" is provided at the output of the FF 233. As a result, the set output of the FF 239 is switched to "1" level which is maintained unchanged thereafter. While the set output of the FF 239 is at "0", or the reset output of the same is at "1", the reset output of the FF 239 is applied to the control input terminal KB of the select gate 243. In this case, the input data to the "B" side input terminals of the select gate 243, namely, the channel code $CC_1$–$CC_3$ is outputted, as the data $DO_0$–$DO_0$ through the output terminals $D_0$–$D_3$, which are written in the top part of the magnetic card. When the signal $PSH_{19}$ is outputted to be applied through the inverter 232 to the clock input terminal CK of the FF 231, the set output signal (the signal WC) of the FF 231 is inverted into 37 0" level at the rise of the signal $PSH_{19}$, and simultaneously the signal $\overline{WC}$ is raised to "1" and is applied to the NAND gate 236. Starting from this time instant, the NAND gate 236 outputs the inverted signal of the system clock pulse $CK_0$ which is applied thereto through the inverters 240 and 241 so as to charge and discharge the capacitor $C_{15}$. Furthermore, as was described with reference to FIG. 29, the supply of the writing clock pulse CO is started at the provision of the signal $PSH_{20}$. Starting from this time instant, the select gate 242 alternately outputs the lower 4 bits data $D_0$–$D_3$ (L) and the higher 4 bits data $D_4$–$D_7$ (H) of the input data $D_0$–$D_7$ according to the input state of the system clock pulse $CK_0$ to supply them to the select gate 243. The select gate 243 outputs, as the output data $DO_0$–$DO_3$, the above-described data successively applied to the "A" side input terminals $A_0$–$A_3$ thereof. As indicated in FIG. 31, after the channel code $CC_1$–$CC_3$ is written in the top part of the magnetic card, the lower 4 bits data (OL) of the 0-th block of that channel, the higher 4 bits data (OH) of the 0-th block, the lower 4 bits data (IL) of the 1st block, and so on are written in the magnetic card in the stated order. Simultaneously, the writing clock pulses CO are also written together with the data (OL), (OH), (IL) and so on.

Figure 32:
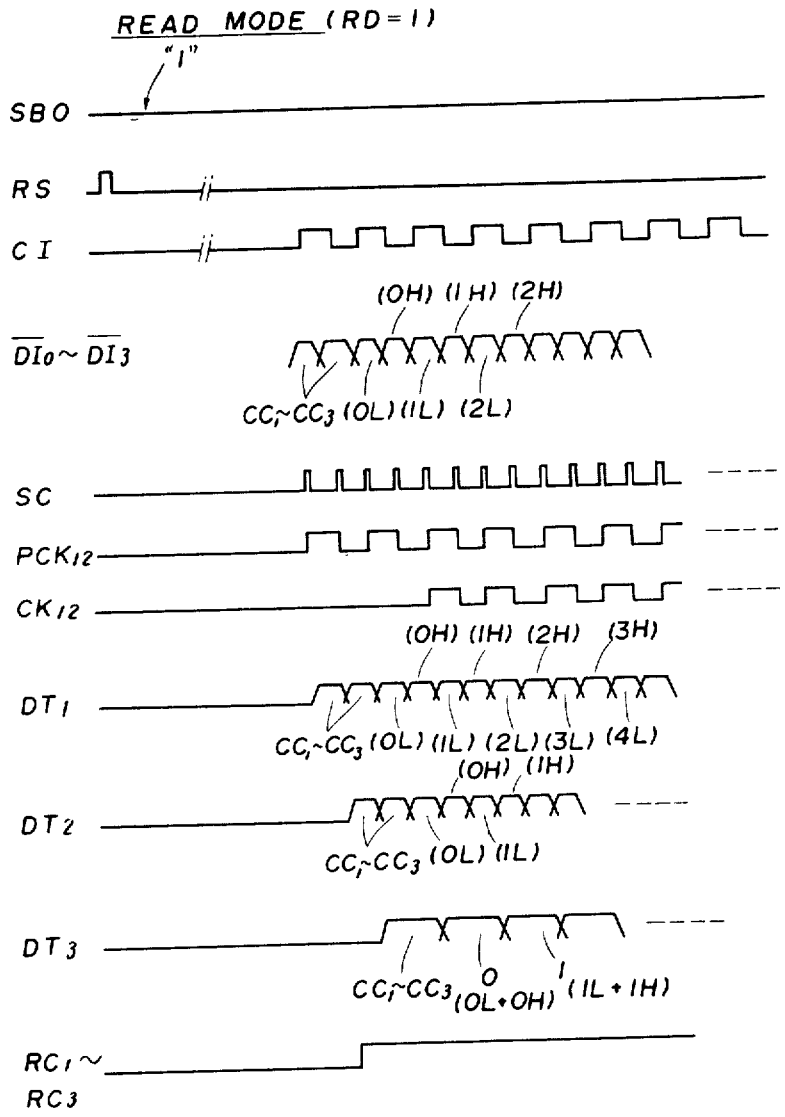
FIG. 32 shows waveforms for a description of the operation of the card I/O logic 22 in a read mode.

Now, the reading operation will be described. In this case, the signal RD is at "1". Prior to the reading operation, when the signal SBO is at "0", this signal is applied through the inverter 251 to the reset input terminal R of the FF 252 to reset the latter. Therefore, by the reset output "1" of the FF 252 the delay circuits 244 through 246 and the FF 249, and 261 through 264 have been reset. In the course of reading operation, when the reset signal RS is outputted, the AND gate 250 outputs a signal in synchronization of this rest signal RS to place the FF 252 in the set state. The set output "1" of the FF 252 together with the clock pulse CI read out of the magnetic card is applied to the NAND gate 254, as a result of which, as was described with reference to FIG. 29, the signal SC is formed. When outputting the signal SC is started, driving the delay circuits 245, 246 and the FF 249 is started with the aid of the signal SC. Therefore, the channel code $CC_1$–$CC_3$ and the data (OL), (OH), (IL), etc. of a channel read out of the magnetic card are sequentially inputted to the delay circuit 246 from which they are applied to the delay circuits 245 and 244. Accordingly, as shown in FIG. 32, the output data $DT_1$, $DT_2$ and $DT_3$ of the delay circuits 246, 245 and 244 are shifted by a single signal SC from one another. Then, when outputting the reading clock $CK_{12}$ is started, the data $DT_3$ ($D_0$–$D_7$) is outputted from the data of the 0-th block and is delivered to the data bus $26_2$. With respect to the detection of the channel code $CC_1$–$CC_3$, comparison of the data $DT_1$ and $DT_2$ is effected in the comparison circuit 270, and when the coincidence signal is outputted, that channel code $CC_1$–$CC_3$ is latched by the latch circuit 248 whereby it is outputted as the channel code $RC_1$–$RC_3$.

The arrangements and operations of the various elements in the embodiment of this invention are as described above.

(2-12) Detailed Description of the Operation Modes

The eight operation modes described before will be described in more detail with reference to the concerning drawings.

(1) R/R mode (ROM to RAM mode)

Figure 33:
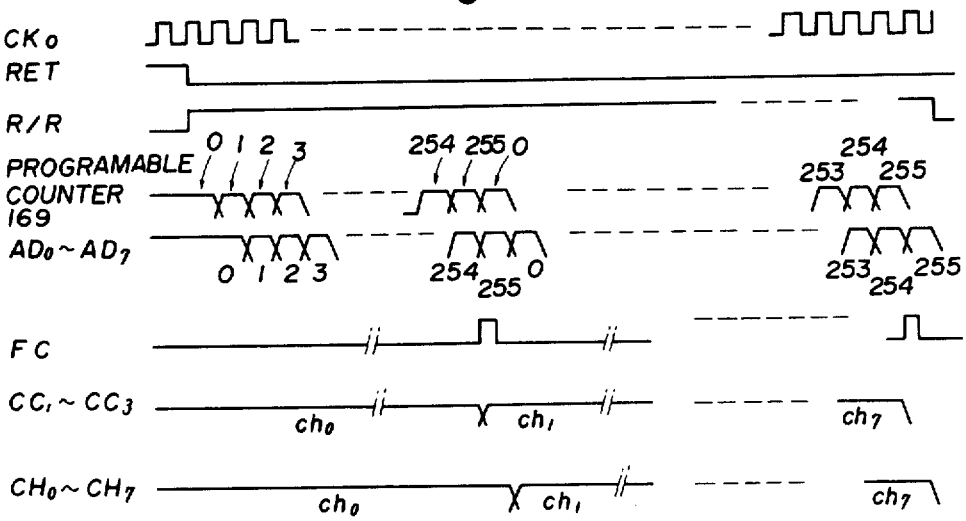
FIG. 33 shows waveforms for a description of the operation of the tone property control device in an R/R mode.

In this mode, the standard tone color information stored in the ROM 14 in advance is transferred immediately to the RAM 13 at the start of a performance so as to effect the performance. When the power switch (not shown) is turned on and then the reset switch 30 is depressed, the reset signal RET is outputted (FIG. 33). Referring to FIG. 11, both of the signals WT and RD are at "0", and therefore the NAND gates 87 and 89 are opened, and the clock pulse of a frequency of 100 KHz from the oscillator 85 is outputted as the system clock pulse $CK_0$. In FIG. 4, when the reset signal RET is eliminated, the signal R/R is outputted by the FF 40, and it is applied to the NOR gate 167 (FIG. 18). As a result, the output of the NOR gate 167 is lowered to "0" to close the AND gate 168, and the programable counter 169 is not program-enabled. The programable counter 169 is reset by the application of the reset signal RET, but is counting operation is started by being driven by the system clock pulse $CK_0$ thereafter. The output of the programable counter 169 is applied to the delay circuit 170, where it is delayed by one bit time and is applied, as the address signals $AD_0$–$AD_7$, to the address bus $26_1$. The output of the programable counter 169 is further applied to the signal FC forming circuit 176, and whenever the contents of the programable counter 169 reach the maximum count value "255", the signal FC is outputted thereby. On the other hand, the octal counter 69 (FIG. 7) is reset when the reset signal RET is outputted, as a result of which the contents of the counter 69 is reset to "0". The contents "0" are outputted, as the channel code $CC_2$–$CC_3$, through the gate circuit $G_2$. In this case, the channel code $CC_1$–$CC_3$ is representative of the 0-th channel ($CH_O$). Whenever the signal FC is outputted, the contents of the octal (3-bit binary) counter 69 increases by one (1), while the channel code $CC_1$–$CC_3$ represents the 1st, 2nd, . . . channels in the stated order. After being delayed by one bit time by the delay circuit 181 (FIG. 21), the channel codes $CC_2$–$CC_3$ are applied to the decoder 182 where they are decoded into the channel timing signals $CH_0$ through $CH_7$. The channel codes $CC_1$–$CC_3$ and the corresponding address signals $AD_0$–$AD_7$ are delayed by one bit time by the delay circuit 181 and the delay circuit 170, respectively. Therefore, they are coincident with each other in output timing as shown in FIG. 32. The address is specified for each channel in the above-described manner. Therefore, in each of the memory blocks 200 through 207 shown in FIG. 21, at its channel timing the RAM and ROM are tip-selected, and the write instruction signal is outputted at the control terminal $\overline{R}/W$ of the RAM. As a result, the contents of the ROM are copied in the respective positions in the RAM successively. Upon completion of the writing operation for the 7th channel, the eighth signal FC is outputted by the signal FC forming circuit 176. Furthermore, as the signal $CH_7$ is outputted by the AND gate 76 (FIG. 7) to open the AND gate 42 (FIG. 6), when the eighth signal FC is outputted, this signal FC, being delayed by one bit time by the delay circuit 43, is applied to the reset input terminal R of the FF 40 to rest the latter 40. As a result, the signal R/R is inverted to "0", and the chip select signals for the RAM's and ROM's in the memory blocks 200 through 207 are switched to "0". Thus, all the operations in the R/R mode have been completed.

As is apparent from the above description, if the power switch and the reset switch 30 are turned on at the start of a performance, the content of the ROMs which store standard tone color information for the channels, respectively, are automatically written in the RAM's immediately. Accordingly, a performance can be effected with desired standard tone property information while desired channel selecting switches $SU_1$, $SU_2$, . . . $SS_2$ and corresponding tone select switches $TS_0$–$TS_7$ being operated. In addition, if the operation in this R/R mode is carried out during the performance effected with desired tone color information in the PR.$\overline{WT}$ mode, the performance can be immediately returned to a performance according to the standard tone color information.

(2) Performance Mode

Figure 34:
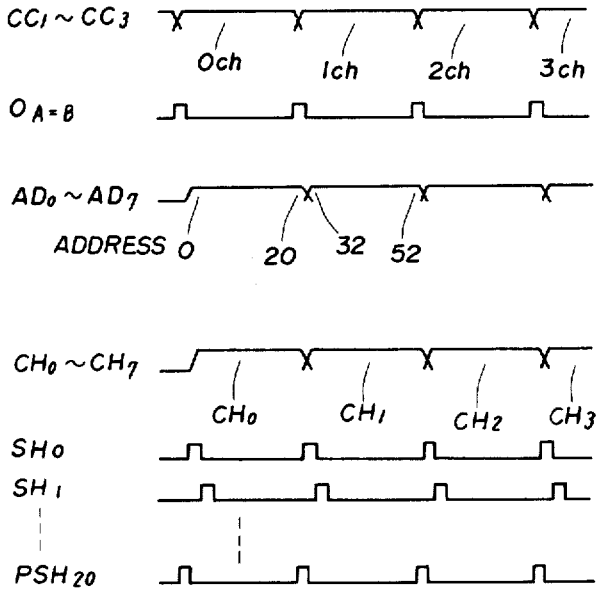
FIG. 34 shows waveforms for a description of the operation of the tone property control device in a performance mode.

The operating procedure in the performance mode and the operations of the associated circuits will be described with reference to FIG. 34, etc.

Figure 20:
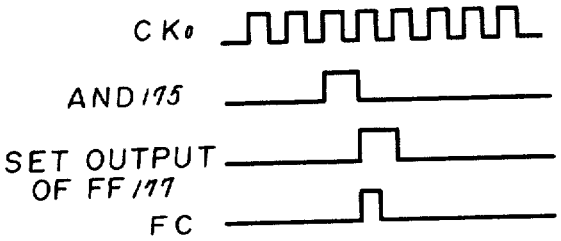
FIG. 20 shows waveforms for a description of the operation of a signal FC forming circuit 176 in the address generator 11 shown in FIG. 18.

In this performance mode, a channel switch and tone select switch belonging to the channel switch are operated, so that the tone color information stored in a designated block in a specified channel (corresponding to the RAM in each memory block 200–207 in this embodiment) in a RAM 13 (designated by 187 in FIG. 20) is outputted to the relevant channel in the sample hold/latch circuit 21 (FIGS. 4 and 17) at all times, thereby to be carried out the performance. Prior to the performance, the channel switch for a desired channel and a desired tone select switch belonging to the channel switch are operated. For instance, the channel switch $U_1$ of the 0-th channel ($CH_0$) and the tone select switch $TS_0$ relating to the channel switch $U_1$; similarly the switches $CH_1$ ($U_2$) and $TS_1$; the switches $CH_2$ ($L_1$) and $TS_2$, . . . , the switches $CH_7$ ($S_2$) and $TS_7$ are operated.

None of the signals WT, RD and EX have outputted yet, and therefore only the gate circuit $G_2$ in FIG. 7 is open. In addition, as the signal R/R is at "0", the AND gate 67 in the pulse generating circuit 64 has been opened, and from this AND gate 67 a signal synchronous with the sampling timing signal $PSH_{20}$ is outputted. This signal $PSH_{20}$ is applied through the OR gate 68 to the clock pulse input terminal CK of the counter 69 to drive the latter 69. If in this case the counter 69 is in its initial reset state, the contents of the counter 69 are successively increased by one (+1) starting at "0". Accordingly, the contents of the channel code $CC_1$–$CC_3$ are successively changed into contents corresponding to the channel timing signals $CH_0$–$CH_7$.

Figure 11:
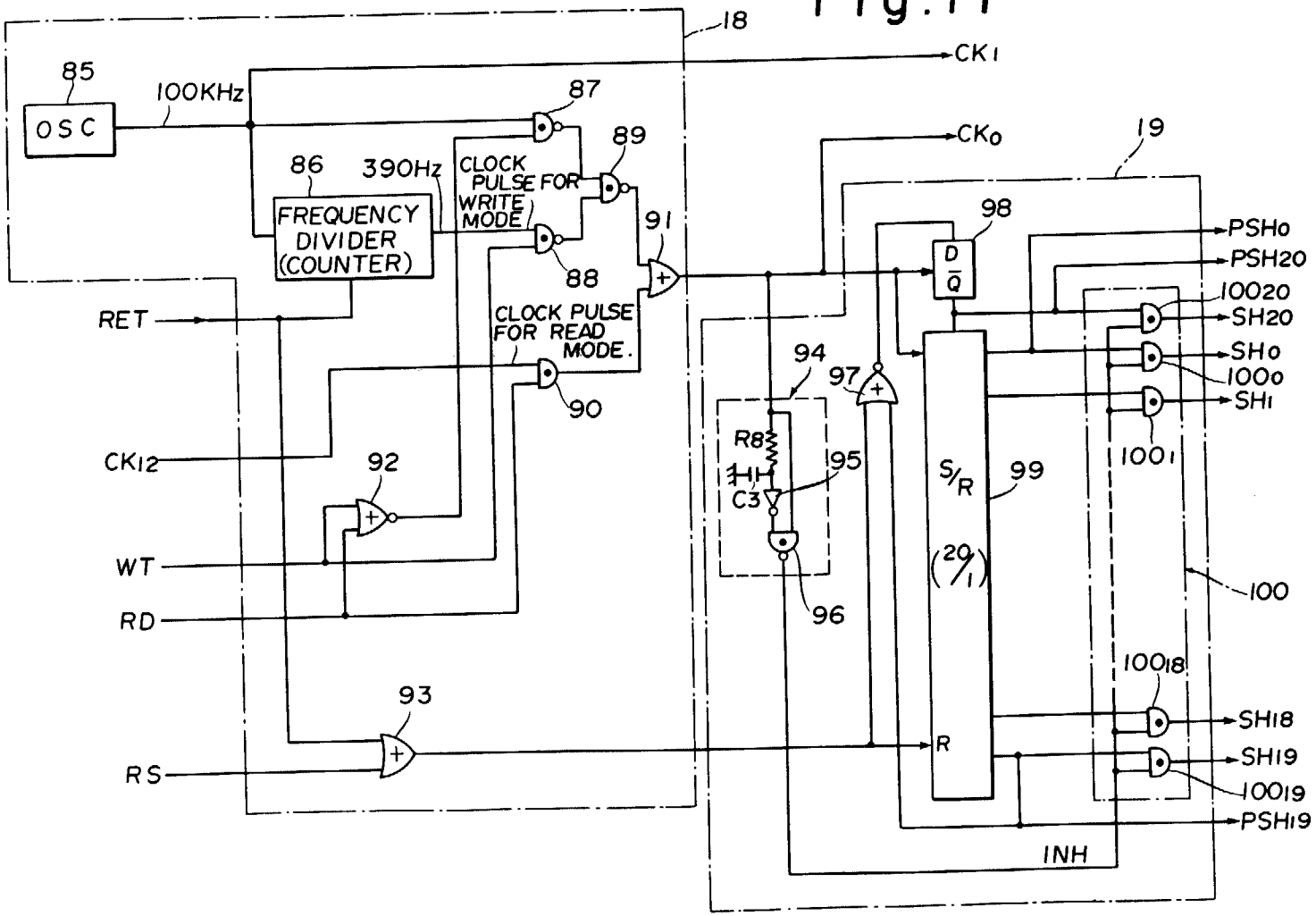
FIG. 11 is a schematic circuit diagram, partly as a block diagram, illustrating a clock pulse generator 18 and a timing pulse generator 19 in the tone property control device shown in FIG. 4.

Referring to FIG. 11, the output of the NOR gate 92 is at "1", and therefore the frequency 100 KHz pulse signal is outputted as the system clock pulse $CK_0$. The 20-stage/1-bit shift register 99 is driven by this system clock pulse $CK_0$ so as to sequentially output the aforementioned sampling timing signals $PSH_{20}$ and $SH_0$ through $SH_{19}$. In FIG. 18, the channel code $CC_1$–$CC_3$ is applied to the decoder 145 where it is decoded into the channel timing signals $CH_0$–$CH_7$ which are applied to the channel selecting switches $SU_1$ through $SS_2$. In the channel selecting switch $SU_1$, for instance, the tone select switch $TS_0$ is turned on. Therefore, when the signal $CH_0$ is outputted, the output of the switch $TS_0$ is applied through the OR gate group 146 to the priority encoder 148. The code signal "0 0 0" obtained by inverting by the inverters 149 through 151 the output of the priority encoder 148 is applied through the AND gates 152–154 and the OR gates 155–157 to the input terminals $P_5$–$P_7$ of the program counter 169 and to the input terminals $A_5$–$A_7$ of the comparator 161 (FIG. 18). In this case, or when the channel timing signal is changed from $CH_7$ to $CH_0$, the contents of both inputs to the comparator 161 coincide with each other, and the coincidence signal A=B is outputted. Therefore, the signal $O_{A=B}$ is outputted by the circuit 162 and is applied through the AND gate 168 to the control input terminal PE of the programmable counter 169. As a result, the programmable counter 169 is program-enabled, and the "0" signals are applied to the input terminals $P_0$–$P_4$ thereof. Therefore, all the inputs of the programmable counter 169 are at "0", and the contents of the programmable counter 169 becomes "0", as a result of which the address "0" in the 0-th block in the RAM 187 of the memory block 200 is specified. The contents of the programmable counter 169 is increased by one (+1) whenever the system clock pulse $CK_0$ is applied thereto. The contents of the program counter 169 are outputted as the address signals $AD_0$–$AD_7$ through the delay circuit 170, and are applied to the "B" side input terminals of the comparator 161. On the other hand, in FIG. 22, the channel code $CC_1$–$CC_3$ is applied to the decoder 182 through the delay circuit 181, and the channel timing signal $CH_0$ is applied to the memory block 200, and therefore the RAM 187 is chip-selected. The aforementioned address signals $AD_0$–$AD_7$ are applied to the address input terminals $A_0$–$A_7$ of the RAM 187, and the contents thereof are successively read out starting at the 0-th address, and are applied to the data bus $26_2$. In addition, the signal "0" is applied, as the read instruction signal, to the input terminal $\overline{R}/W$ of the RAM 187. In the sample hold/latch circuit in FIG. 17, the channel code $CC_1$–$CC_3$ is decoded by the decoder 138, and the channel timing signal $CH_0$ is inputted to the circuit 130 through the delay circuit 139. The data $D_0$–$D_7$ for the switch $TS_0$ which have been read out of the RAM 87 (in FIG. 22) are applied to the D/A converter 140 and the latch circuit 143 in FIG. 17, and the data $D_0$–$D_7$ stored in the 0-th to 20th addresses in the RAM 187 are sequentially stored in the sample hold circuits $S/H_0$–$S/H_{19}$ and the latch circuit 143. The output data $O_0$–$O_{25}$ thereof are supplied to the musical tone forming circuit $2_0$ of the 0-th channel ($CH_0$). When the operation with respect to the channel selecting switch $SU_1$ is accomplished in this manner and the contents of the programmable counter 169 reach "20", the contents of both inputs to the comparator 161 coincide with each other, and the coincidence signal A=B is outputted, and then the signal $O_{A=B}$ is outputted, as a result of which the programmable counter 169 is program-enabled. In this operation, the channel is switched to the 1st channel ($CH_1$), and the similar operation is started for the tone select switch $TS_1$ of the channel selecting switch $SU_2$. In this case, the address "32" is given, as the top address of the RAM in the memory block 201, to the program counter 169, while the last address "52" of the RAM is given to the "A" side input terminals of the comparator 161. When the contents of all the RAM's corresponding to the channel selecting switches $SU_1$ through $SS_2$ are stored in the sample hold/latch circuits 130 through 137, the performance can be effected with different tone colors by operating the keyboards corresponding to the channel selecting switches.

(3) PR.$\overline{WT}$ Mode

In this mode, the tone property controlling variable resistors $TVR_0$–$TVR_{19}$ and the tone property effecting switches $TSW_{20}$–$TSW_{25}$ in the tone property setting board 16 are operated while keyboard keys being operated, to effect a performance with a desire tone color. The outputs of the aforementioned variable resistors $TVR_0$–$TVR_{19}$ are converted into digital data by the A/D conversion device 17, which are applied to the data bus $26_2$. The digital data are converted into analog data by the D/A conversion device 20, which are stored in the sample hold circuit 21*a*. On the other hand, the outputs of the aforementioned switches $TSW_{20}$–$TSW_{25}$ are applied through the data bus $26_2$ to the latch circuit 21*b*, where they are latched.

Figure 10:
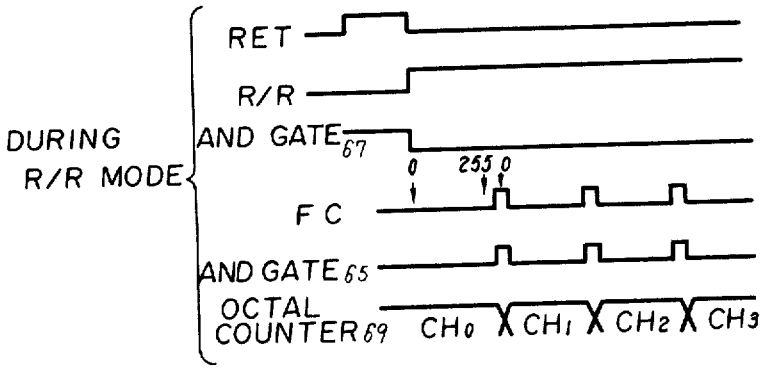
FIG. 10 shows waveforms for a description of the operation of a pulse forming circuit 64 in the panel control logic 25.
Figure 10:
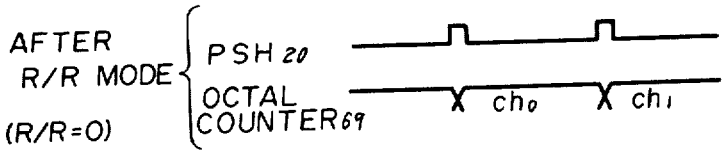

First, the produce switch 32 (in FIGS. 5 and 6) is operated. In this embodiment, it is assumed that the channel 1 ($U_2$) and the tone select switch $TS_1$ have been operated and a performance is played by operating the upper keyboard $1_1$ in FIG. 2. In this case, the all select switch 31 (FIGS. 5 and 6) is set to the SELECT side. As a result, the signals PR and SL are outputted and are raised to "1" (FIG. 6). As shown in FIG. 10 (B), the octal counter 69 (FIG. 7) is driven by the signal $PSH_{20}$ to carry out its counting operation. The contents of the counter 69 are outputted, as the channel code $CC_1$–$CC_3$, through the gate circuit $G_2$. In FIG. 11, none of the signals WT and RD have not been outputted, a clock pulse having a frequency of 100 KHz is outputted as the system clock pulse $CK_0$. Accordingly, the sampling timing signals $PSH_{20}$ and $SH_0$ through $SH_{19}$ are sequentially outputted and supplied to the sample hold-/latch circuit 21 (130–137) in FIG. 4 or 16. Since the channel selecting switch $SU_2$ has been operated, the output of this switch $SU_2$ is applied to the preferential encoder 71 (FIG. 7) and the NOR gate 70. As a result, the code signal corresponding to the channel selecting switch $SU_2$ is outputted by the preferential encoder 71 and is applied to the decoder 79. In this case, as the output "0" of the NOR gate 70 has been applied to the inhibit input terminal of the decoder 70 to release the inhibition, the channel timing signal $SCH_1$ corresponding to the channel selecting switch $SU_2$ is outputted by the decoder 79, which is raised to "1". As the signals are outputted as described above, the channel code $CC_1$–$CC_3$ is decoded by the decoder 138 (FIG. 17) and is delayed by one bit time by the delay circuit 139, and the channel timing signals $CH_0$–$CH_7$ are applied to the sample hold/latch circuits 130–137. Referring to FIG. 14, as was described before, the timing signals sequentially rendering the gates $101_0$ through $101_{19}$ in the gate group 101 conductive are outputted by the decoder 102 with the aid of the counting operating of the 21-base counter 103, and the output voltages of the tone property controlling variable resistors $TVR_0$–$TVR_{19}$ are sequentially applied through the buffer amplifier 107 to the A/D converter 109 where they are converted into the corresponding digital data. These data are transmitted through the latch circuits 112 and 113, the select gate 115 and the shift register group 118 to the "A" side input terminals $A_0$–$A_7$ of the select gate 119. On the other hand, the on-off information of the tone property effecting switches $TSW_{20}$–$TSW_{25}$ are applied directly to the "B" side input terminals $B_0$–$B_5$ of the select gate 119. From the select gate 119, the outputs of the variable resistors $TVR_0$–$TVR_{19}$ or the outputs of the switches $TSW_{20}$–$TSW_{25}$ are outputted as the data A/D5 according to the output condition of the timing signal $PSH_{19}$. The data A/D5 is compared with the channel code predetermined as indicated in Table 1 whether or not the data A/D5 coincides with the later by the comparator 120. When the data A/D5 is different from the channel code, it is transmitted, as the data $D_0$–$D_7$ to the data bus $26_2$ after being delayed by one bit time by the delay circuit 123, and when the channel signal $CH_1$ is outputted, it is delivered through the D/A converter 140 (FIG. 17) and the buffer amplifier 141 to the sample hold/latch circuit 131 or directly to the sample hold/latch circuit 131. If the data A/D5 shown in FIG. 14 should coincide with the channel code, the data would be applied to the delay circuit 123 after the first digit of the data A/D5 has been switched to "0". Thus, the coincidence with the channel code can be prevented.

At the control input terminal DIS of the delay circuit 123, the signal $SCH_1$ is at "1" at all times. Therefore, only when the channel signal $CH_1$ is outputted, the output of the AND gate $124_1$ is raised to "1". Furthermore, as the signal PR is also at "1", the output of the NAND gate 126 becomes "0" in synchronization with the output of the AND gate $124_1$, and is then applied to the aforementioned control input terminal DIS. Accordingly, the delay circuit 123 is released for the period during which the channel signal $CH_1$ is outputted, so as to apply the data D/A5, as the data $D_0$–$D_7$, to the data bus $26_2$. Furthermore, as the data $D_0$–$D_7$ and the channel timing signals $CH_0$–$CH_7$ are delayed by one bit time by the delay circuit 123 and the delay circuit 139, respectively, they are applied to the sample hold/latch circuits 130 through 137 with the same timing. Thus, in this embodiment, the output data of the variable resistors $TVR_0$–$TVR_{19}$ and the switches $TSW_{20}$–$TSW_{25}$ for the tone select switch $TS_1$ of the channel selecting switch $SU_2$ are supplied through the data bus $26_2$ to the sample hold/latch circuit 131 whenever the channel timing signal $CH_1$ is outputted. Accordingly, a performance can be played with the set tone color information by operating the upper keyboard $1_1$. It is apparent that whenever a tone property control variable resistor or a tone property effecting switch is operated simultaneously during the performance, the performance can be played with a different tone color (tone properties). Furthermore, it is obvious that if the number of channel selecting switches or tone select switches is increased, a performance can be effected with more intricate tone colors.

(4) PR.WT Mode

In this mode, the tone color information $D_0$–$D_7$ set in the aforementioned PR.$\overline{WT}$ mode is applied through the data bus $26_2$ to the card I/O logic 22, in which said 8-bit information is converted into 4-bit information and simultaneously a writing clock pulse which together with the 4-bit information is recorded in the magnetic card.

After the switching operation in the PR.$\overline{WT}$ mode, the magnetic card is set in the card reader 23. Thereafter, the write switch 28 is operated. As a result, the FF 47 in FIG. 6 is set by the output signal of the write switch 28, and the signal WT is raised to "1" by the set output of the FF 47. By this signal WT the NAND gate 88 in FIG. 11 is released, while the NAND gate 87 is closed. As a result, the system clock pulse $CK_0$ is switched to a clock pulse of 390 Hz employed in the PR.WT mode. As the shift register 99 and the FF 98 are driven by this system clock pulse $CK_0$, the sampling timing signals $SH_0$–$SH_{20}$, $PSH_0$–$PSH_{20}$ outputted by them are changed in frequency. The switching operation in the above-described PR.$\overline{WT}$ mode is maintained unchanged, and therefore the signals PR and SL are being outputted. In addition, the channel selecting switch $SU_1$ and the tone select switch $TS_1$ have been turned on. Furthermore, similarly as in the PR.$\overline{WT}$ mode, the output of the counter 69 in FIG. 7 is outputted as the channel code $CC_1$–$CC_3$ through the gate circuit $G_2$. The outputs of the variable resistors $TVR_0$–$TVR_{19}$ and the switches $TSW_{20}$–$TSW_{25}$ are outputted by the select gate 119 according to the output condition of the signal $PSH_{19}$, and are applied as data $D_0$–$D_7$ to the data bus $26_2$ after being delayed by one bit time by the delay circuit 123. The output of the tone select switch $TS_1$ of the 1st channel ($CH_1$) is applied to the priority encoder in FIG. 17, and the programmable counter 169 and comparator 161 are operated as described with reference to the PR.$\overline{WT}$ mode. The output of the programmable counter 169, after being delayed by one bit time by the delay circuit 170, is outputted, as the address data $AD_0$–$AD_7$, to the address bus $26_1$.

In this operation, in the card reader control logic 24 (FIG. 24) the signal WRC and the reset signal RS are formed with the aid of the control signals RSS, WPS and SBO provided by the card reader 23. In the card I/O logic in FIG. 27, the data $DO_0$–$DO_3$ representative of the 1st channel is outputted by the select gate 243 and is written in the magnetic card when the FF 239 is in reset state. Then, the FF 239 is set, whereupon the 8-bit data $D_0$–$D_8$ delivered by the data bus $26_2$ is outputted as the 4-bit data $D_0$–$D_3$ or $D_4$–$D_7$ according to the state "1" or "0" of the system clock pulse $CK_0$, and furthermore these data are outputted as the data $DO_0$–$DO_3$ by the select gate 243 and are written in the magnetic card. At the same time, the write clock pulse CO is formed by the circuit 235 and it is written in the magnetic card at the same time as the aforementioned data $DO_0$–$DO_3$ are written therein. When tone color data for one block, that is, 21 words with respect to the aforementioned tone select switch $TS_1$ is written in this manner, the coincidence signal A=B is outputted by the comparator 161 in FIG. 18, and therefore the signal $O_{A=B}$ is outputted. As a result, the output of the AND gate 44 in FIG. 6 is raised to "1", and this signal "1" is applied to the reset input terminal R of the FF 47 through the OR gates 45 and 46, to reset the FF 47. Therefore, the signal WT disappears, and the PR.WT mode with respect to the aforementioned tone select switch $TS_1$ is completed. Thus, the data for one tone color has been recorded in the magnetic card. If the above-described PR.$\overline{WT}$ mode and PR.$\overline{WT}$ are repeated many times, then a number of tone color information can be recorded in a number of magnetic cards. Accordingly, if a desired magnetic card is selected before a performance, the performance can be effected immediately by utilizing the tone color information recorded in the selected magnetic card. Furthermore, if the data in eight sheets of magnetic cards obtained as described above are sequentially written in the blocks in a channel according to the procedure in the RD.SL mode (described later), and then the data for eight tone colors is recorded in one magnetic card in the WT.AL mode (described later), it is more convenient in performance, and the number of magnetic cards can be reduced.

(5) RD.SL mode

In this mode, from a magnetic card in which information for one tone color has been recorded in the aforementioned PR.$\overline{WT}$ mode and PR.WT mode the information is written in a block of an optional channel so as to be utilized for a performance.

Figure 35:
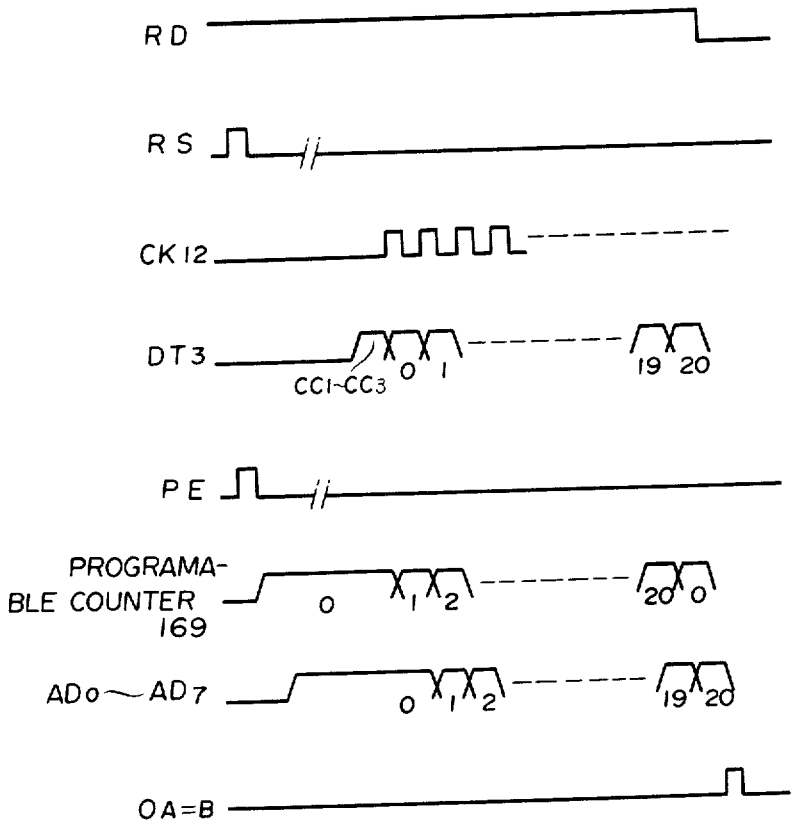
FIG. 35 shows waveforms for a description of the operation of the tone property control device in an RD.SL mode.

It is assumed that a number of magnetic cards each recording information for one tone color have been provided. First of all, the all select switch 31 shown in FIGS. 5 and 6 is set to the select (SL) side, and then a magnetic card storing information for one tone color is set in the card reader 23. Thereafter, the read switch 27 is operated, and one channel selecting switch and its tone select switch of a desired channel are operated. In this example, the channel selecting switch $SU_2$ and the tone select switch $TS_0$ are operated for instance. By the operation of these switches, the FF 49 is set (in FIG. 6), as a result of which the signal RD is raised to "1", and the signal SL is also raised to "1". Since the channel selecting switch $SU_2$ has been turned on in FIG. 7, its output is applied to the preferential encoder 71 and the NOR gate 70. As a result, the inhibition state of the decoder 79 is released, that is, it is placed in operation state, and the code signal of the channel selecting switch $SU_2$ is outputted by preferential encoder 71 to the decoder 79 and the gate circuit $G_3$. The gate circuit $G_3$ has been opened by the signal RD.SL provided by the OR gate 80. Accordingly, the channel code $CC_1$–$CC_3$ representative of the 1st channel is outputted by the gate circuit $G_3$, while the signal $SCH_1$ is produced by the decoder 79. Before the data is read out of the magnetic card, the reset signal RS is outputted by the card reader control logic 24 (FIG. 24). This reset signal RS is applied through the OR gate 166 and AND gate 168 to the control input terminal PE of the programable counter 169 (FIG. 18) to enable the latter 169 thereby to cause the signals "0" to be applied to its input terminals $P_0$–$P_4$. In this case, the code signal "0 0 0" of the tone select switch $TS_0$ outputted by the priority encoder 148 is applied to the input terminals $P_5$–$P_7$ of the programable counter 169. The code signal is also applied to the input terminals $A_5$–$A_7$ of the converter 161. Furthermore, the FF 252 in the card I/O logic (FIG. 28) is set by the reset signal RS. Then, reading the clock pulse CI together with the data $DI_0$–$DI_3$ out of the magnetic card is started. The reading clock pulse $CK_{12}$ is outputted 4-bit time later than the clock pulse CI (referring to FIG. 30). Therefore, during the period of time which elapses from the instant that the first clock pulse CI is read out until the first reading clock pulse $CK_{12}$ corresponding to this clock pulse CI is outputted, first the channel code $RC_1$-$RC_3$ is outputted by the latch circuit 248 in FIG. 28 (refer to FIGS. 32 and 35). Then, upon provision of the first reading clock pulse $CK_{12}$, the reading clock pulse $CK_{12}$ is outputted by the AND gate 90 (FIG. 11), and thereafter the reading clock pulse $CK_{12}$ is outputted as the system clock pulse $CK_0$. Accordingly, the FF 98 and the shift register 99 are driven by this system clock pulse $CK_0$, as a result of which the signals $SH_0$-$SH_{20}$ and $PSH_0$-$PSH_{20}$ are outputted, On the other hand, the program counter 169 is also driven by the system clock pulse $CK_0$ (FIG. 18), and its contents is increased one at a time (+1) starting at zero (0), and is applied, as the address signals $AD_0$-$AD_7$, to the address bus $26_1$. In this case, the RAM in the memory block 201 (FIG. 22) corresponding to the first channel has been chip-selected with the aid of the signals $CH_1$ and $SCH_1$, and the aforementioned address signals $AD_0$-$AD_7$ and the data $D_0$-$D_7$ read out of the magnetic card are inputted to the RAM. Furthermore, the write instruction "1" has been applied to the RAM from the AND gate 186. Therefore, the data $D_0$-$D_7$ are successively written in addresses 0-20 of the block in the RAM. Upon completion of the writing operation, the coincidence signal A=B is provided by the comparator 161 and then the signal $0_{A=B}$ is outputted, whereupon the signals SL. $0_{A=B}$ at "1" level are applied to the reset input terminal R of the FF's 47 and 49, thereby to reset the latter 47 and 49. Accordingly, the signals WT and RD are switched to "0". Through the above-described operations, all the information for one tone color in the magnetic card is written in the 0-th block in the RAM of the 1st channel specified.

If, as was described with reference to the PR.WT mode, the above-described RD.SL mode is repeated eight times for eight magnetic cards each storing different information for one tone color, the data for eight tone colors can be stored in all the blocks (0-th to 7th blocks) in the RAM of the 1st channel for instance. For this purpose, the channel selecting switch $SU_1$, and ones, corresponding to the 0-th to 7th blocks, out of the tone select switches $TS_0$-$TS_7$ are operated. The information for eight tone colors thus written in the RAM of the 1st channel can be written in one sheet of magnetic card through the operation in the following WT.AL mode.

Through the operation in the above-described RD.SL mode, certain tone color information can be written in optional blocks of an optional channel (in the embodiment, in optional blocks in the RAM of an optional channel). Thus, advantageously a performance can be effected while selecting the tone select switches in a system.

(6) WT.AL Mode

In this mode, the information for eight tone colors which is written in the RAM by repeating the above-described RD.SL mode is recorded in one sheet of magnetic card.

In this embodiment, it is assumed that the data in the RAM of the 1st channel is recorded in a magnetic card, for instance. First the channel selecting switch $SU_2$ is operated, and then the all select switch 31 is set to the ALL side. A magnetic card having a memory capacity corresponding to eight tone colors is set in the card reader 23. Finally, the write switch 28 is operated. As a result, the signals ALL and WT are raised to "1". Therefore, the NAND gate 87 (FIG. 11) is closed, while the NAND gate 88 is opened, and the system clock pulse $CK_0$ is switched to a 390 Hz writing clock pulse. With the aid of this system clock pulse $CK_0$, the sampling timing signals $SH_0$-$SH_{20}$ and $PSH_0$-$PSH_{20}$ are outputted. The channel code $CC_1$-$CC_3$ representative of the channel selecting switch $SU_2$ is outputted through the gate circuit $G_3$ in FIG. 7. In addition, the signal $SCH_1$ is outputted by the decoder 79.

Figure 24:
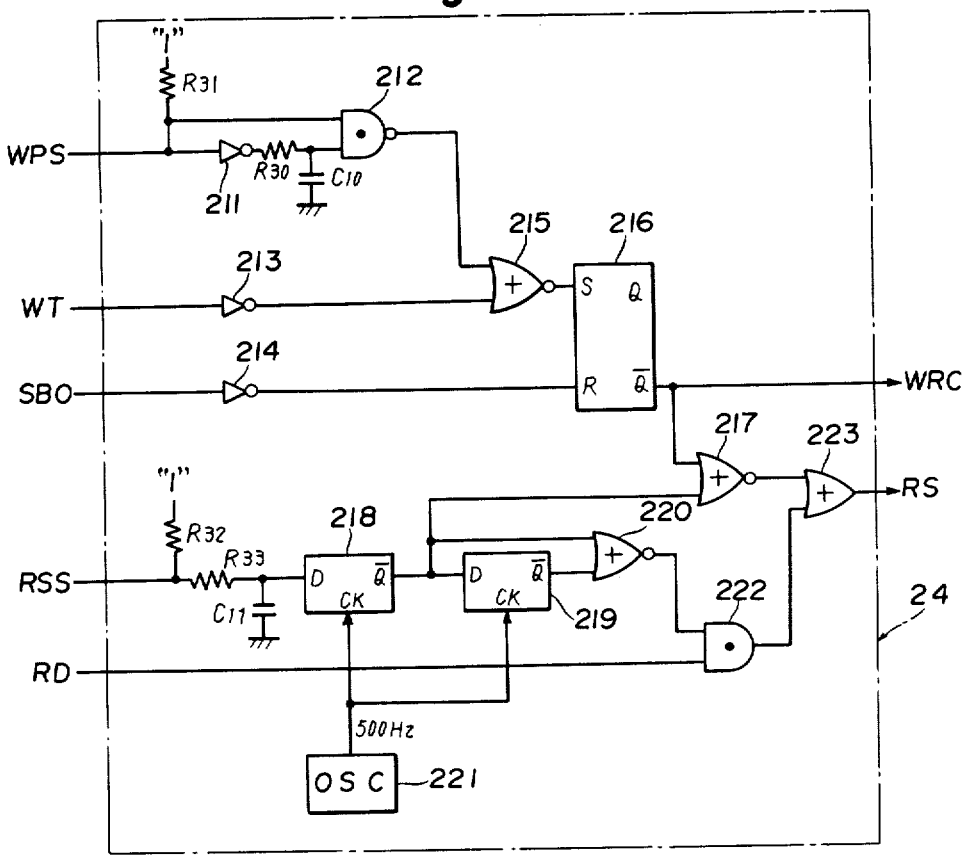
FIG. 24 is a schematic circuit diagram, partly as a block diagram, showing a card reader control logic 24 illustrated in FIG. 4.
Figure 36:
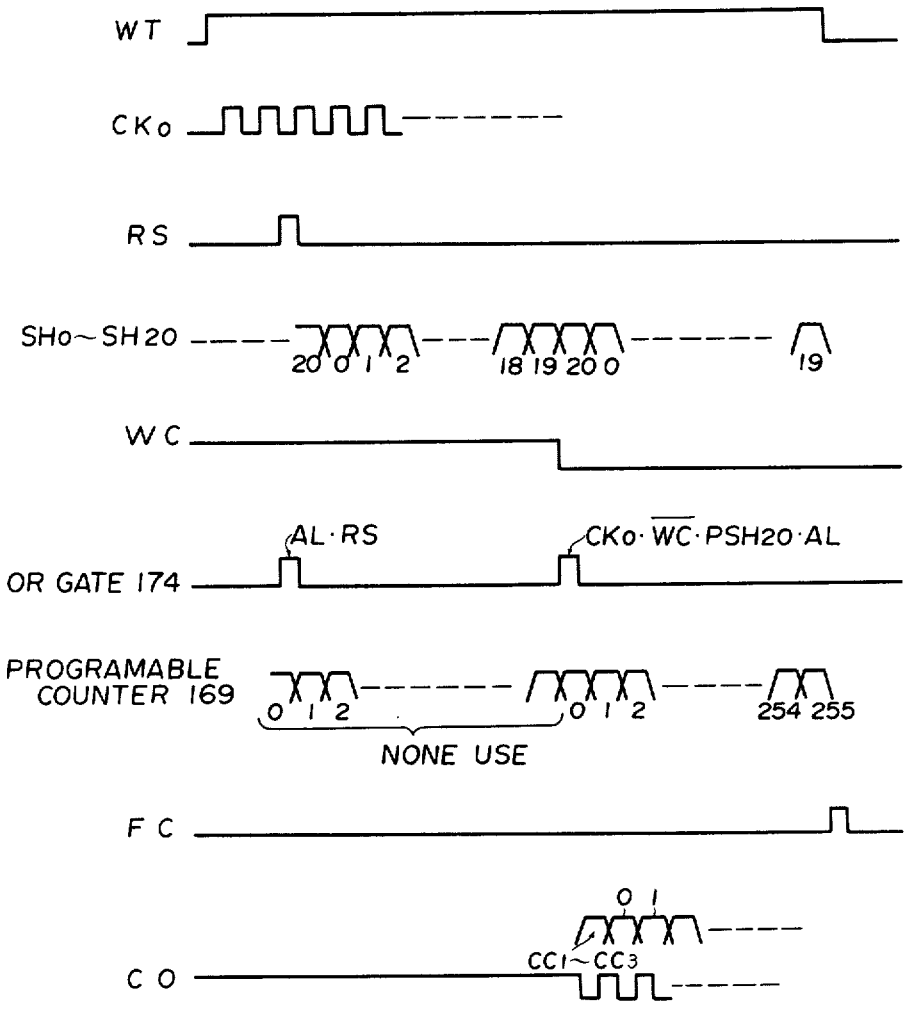
FIG. 36 shows waveforms for a description of the operation of the tone property control device in a WT.AL mode.

When the magnetic card is detected by the reverse switch and the reset signal RS is outputted by the card reader control logic 24 in FIG. 24, the FF 239 (FIG. 28) is reset by the reset signal, as a result of which its set output is switched to "0" and its reset output is raised to "1". At the same time, the output AL.RS of the AND gate 173 (FIG. 18) is raised to "1", and the programable counter 169 is reset, as a result of which the contents of the counter 169 is changed to zero (0). The contents of the programable counter 169 is increased by one (+1) whenever the system clock pulse $CK_0$ is outputted. As is apparent from the time chart shown in FIG. 36, when the contents of the program counter 169 reach twenty (20), at the next timing the output $CK_0.\overline{WC}.PSH_{20}$. AL of the AND gate 172 is raised to "1", as a result of which the program counter 169 is reset again to have the contents 0. This is because of the fact that when the signal $SH_{20}$ is provided after the signal $SH_{19}$ has been outputted, the signal WC is lowered to "0", as is apparent from the time chart in FIG. 30. During the period of time which elapses from the instant that the programable counter 169 is first reset until it is reset again, the reset output of the FF 239 described above is maintained at "1", and therefore the channel code $CC_1$-$CC_3$ applied to the "B" side input terminals $B_0$-$B_3$ of the select gate 243 is recorded in the magnetic card. On the other hand, the RAM in the memory block 201 (FIG. 21) has been chip-selected by the channel code $CC_1$-$CC_3$ and the signal $SCH_1$, and the read instruction has been applied to that RAM. Accordingly, as the content of the programable counter 169 is changed to zero (0) by resetting the programable counter 169 again and the content is successively increased by one at a time (+1), the contents are outputted as the address data $AD_0$-$AD_7$ to the aforementioned RAM of the memory block 201. In this case, as the set output of the FF 239 (FIG. 28) is at "1", the 8-bit data $D_0$-$D_7$ delivered from the RAM are outputted, as 4-bit data $DO_0$--$DO_3$, by the select gate 243 and are written in the magnetic card together with the writing clock pulse. Thus, beginning with the tone color information of the 0-th block, the tone color information is successively read out of the RAM and are written in the magnetic card. When the content of the programable counter 169 reaches "255", the signal FC is outputted by the circuit 176 (FIG. 18) and is applied through the OR circuits 45 and 46 (FIG. 6) to the reset input terminal R of the FF 47. Accordingly, the FF 47 is reset, the signal WT is lowered to "0", and the contents of all the blocks in the RAM of the first channel are recorded in one sheet of magnetic card.

The information for eight tone color is written in one sheet of magnetic card as described above. If a number of such magnetic cards are provided, as is apparent from the following description of the RD.AL mode it is possible that the contents of the magnetic cards are inputted in the RAM prior to a performance, and a number of pieces of color information can be set in the music synthesizer within a short period of time.

(7) RD.AL Mode

In this mode, out of one sheet of magnetic card in which the information for eight tone color has been written in the above-described WT.AL mode, the information for eight tone color is written in all the blocks in the RAM of an optional channel.

In this mode, there are two cases. In the first case, instead of the channel written in the top part of the magnetic card, a channel is specified by the channel switch, and the information for eight tone color is copied in the RAM of the channel thus specified. In the second case, the information is copied in the RAM of the channel written in the top part of the magnetic card.

Figure 37:
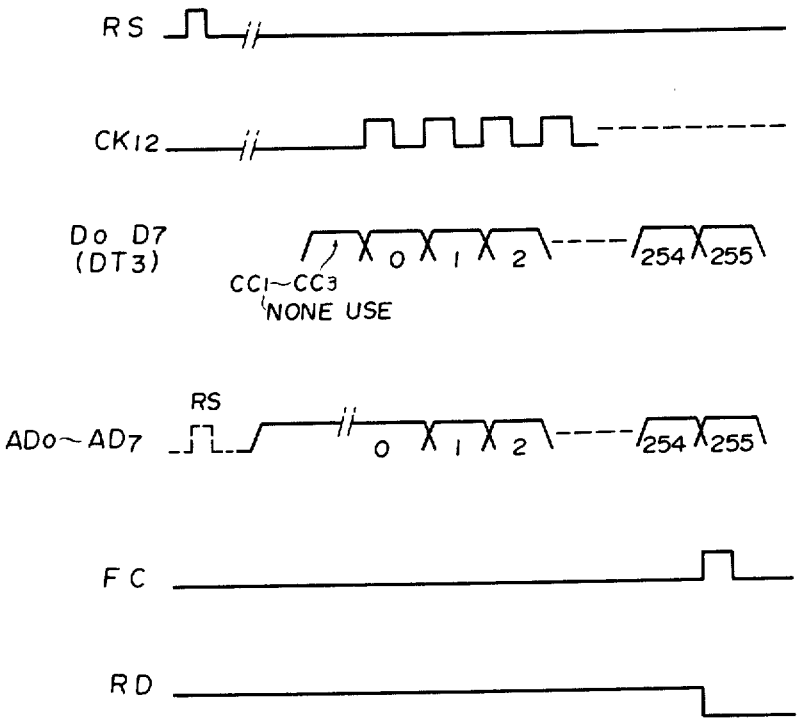
FIG. 37 shows waveforms for a description of the operation of the tone property control device in a RD.AL mode.

The operation in the first case where a channel is specified will be first described with reference to FIG. 37 and so forth.

The all select switch 31 (FIGS. 5 and 6) is set to the ALL side, and one sheet of magnetic card storing the information for eight tone colors is set in the card reader 23 (FIG. 4). Then, the read switch (READ) 27 is depressed, and finally one channel selecting switch, for instance $SU_2$ of the 1st channel, is depressed to specify a channel.

As a result, the signals ALL and RD are raised to "1". In FIG. 7, as the signal RD.AL is at "1", the gate circuit $G_3$ is open. As the channel selecting switch $SU_2$ has been turned on, the channel code $CC_1$–$CC_3$ representative of the 1st channel is outputted through the preferential encoder 71 and the gate circuit $G_3$. In addition, the channel timing signal $SCH_1$ is outputted by the decoder 79. As the signal AL is at "1", the output of the NOR gate 167 (FIG. 18) is switched to "0". Accordingly, the terminal PE of the programable counter 169 is maintained at "0" at all times, and the programable counter 169 is not enabled. When the magnetic card is detected by the reverse switch whereby the reset signal RS (FIG. 27) is outputted, the output AL.RS of the AND gate 173 is raised to "1". By this signal, the programable counter 169 is reset and the content thereof is cleared to zero (0). The RAM of the memory block 201 is chip-selected by the signals $CH_1$ and $SCH_1$, and the write instruction is applied to this RAM. As was described with reference to the RD.SL mode, the reading clock pulse $CK_{12}$ employed in this mode is outputted four-bit time after the clock pulse CI read out of the magnetic card. Therefore, the content of the programable counter 169 (FIG. 18) is maintained at zero (0) until the first reading clock pulse $CK_{12}$ is outputted, and accordingly the address signals $AD_0$–$AD_7$ represents zero (0). During this period, the channel code $CC_1$–$CC_3$ is read out of the magnetic card and is applied, as the data $\overline{DI_0}$–$\overline{DI_3}$, to the delay circuit 246 (FIG. 28), which is outputted, as the data $RC_1$–$RC_3$, by the latch circuit 248. However, referring to FIG. 6, the output of the NOR gate 70 is switched to "0" by the operation of the channel selecting switch $SU_2$, and therefore the output of the AND gate 77 is also switched to "0", and the gate circuit $G_1$ is closed. As a result, the aforementioned channel codes $RC_1$–$RC_3$ is not outputted by the gate circuit $G_1$, and therefore this channel is not used. That is, the 1st channel specified by the channel selecting switch $SU_2$ is used, but the channel written in the magnetic card is not used.

When outputting the reading clock pulse $CK_{12}$ is started, this reading clock pulse $CK_{12}$ becomes the system clock pulse $CK_0$ because of the closure of the NAND gates 87 and 88, and addition (+1) is effected successively in the programable counter 169, as a result of which the content of the programable counter 169 is changed. Accordingly, the address signals $AD_0$–$AD_7$ are outputted, the addresses in the RAM of the memory block 201 are successively specified, and the corresponding data $D_0$–$D_7$ which are read out of the magnetic card and converted into 8-bit data are written in the RAM. When the content of the programable counter 169 reaches "255", the signal FC is provided by the circuit 176. The FF 49 is reset by this signal FC, and therefore the signal RD is switched to "0". Thus, the operation of writing the information for eight tone colors in the RAM of the 1st channel specified is completed.

Now, the case where instead of specifying a channel by operating a channel selecting switch, in accordance with the channel written in the top part of the magnetic card, information for eight tone colors is written in the RAM of the channel, will be described. The procedure in this case is similar to that in the preceding case except that none of the channel selecting switches are operated. Since none of the channel selecting switches are operated, none of the signals $SCH_0$–$SCH_7$ are outputted. However, as the output of the NOR gate 70 is raised to "1", the output of the AND gate 77 is raised to "1". By this signal "1" the gate circuit $G_1$ instead of the gate circuit $G_3$ is opened. In this case, the operation of the circuitry is substantially similar to that in the above-described case. However, when the channel code $RC_1$–$RC_3$ is read out of the magnetic card, this channel code $RC_1$–$RC_3$ is outputted as the channel code $CC_1$–$CC_3$ by the gate circuit $G_1$. Accordingly, the RAM of that channel is chip-selected by the channel code $CC_1$–$CC_3$, and the information for eight tone color is written in all the blocks of this RAM.

As the copying is effected with the RAM of the channel storing the information for eight channel in the magnetic card, a performance can be freely effected with desired tone color by operating the tone select switches $TSW_0$–$TSW_7$.

(8) EX Mode

In this mode, the contents (tone color information) of blocks of one and same channel or of two different channel are exchanged for each other, and the RAM 15 for temporary memory is utilized.

Figure 38:
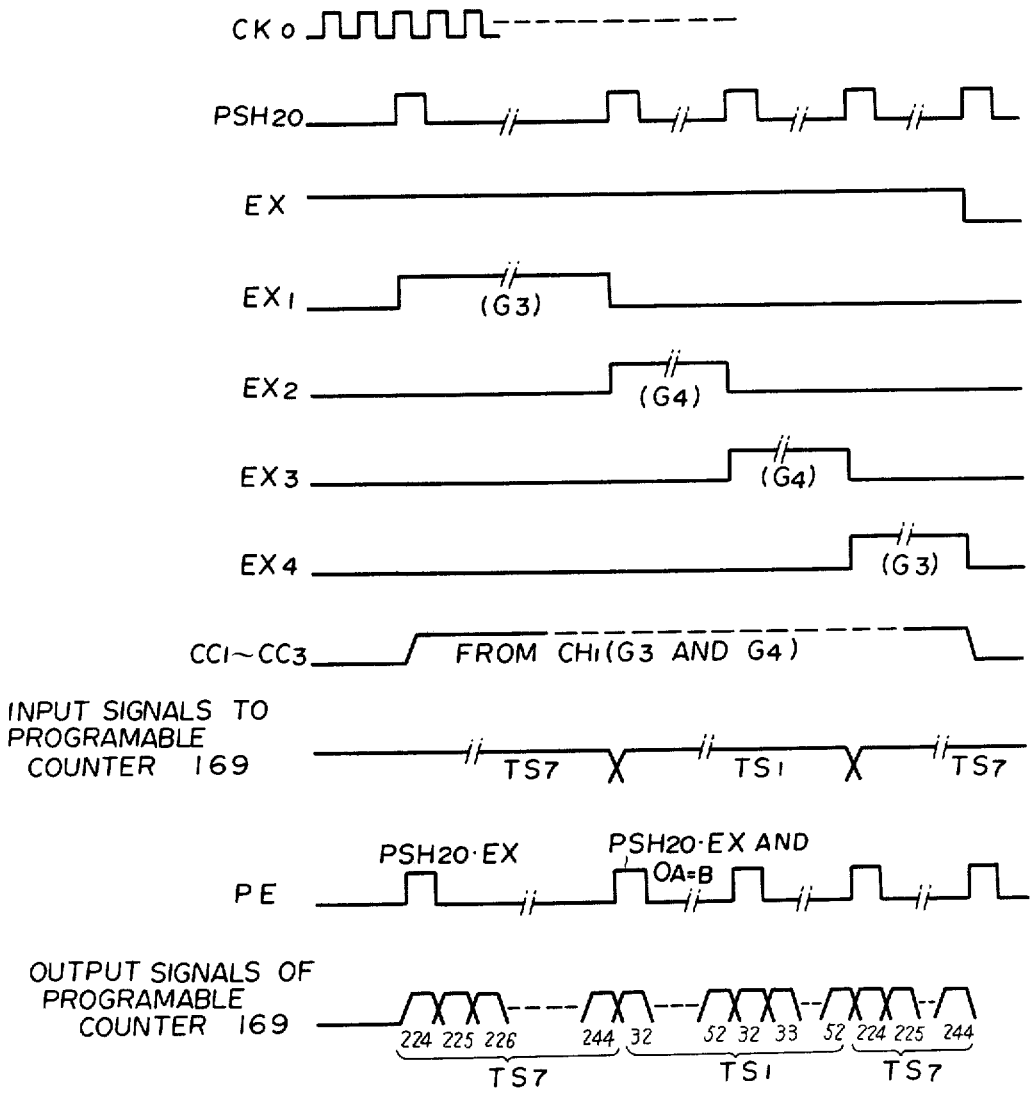
FIG. 38 shows waveforms for a description of the operation of the tone property control device in which the contents of blocks in one and the same channel are swapped with each other in an EX mode.
Figure 39:
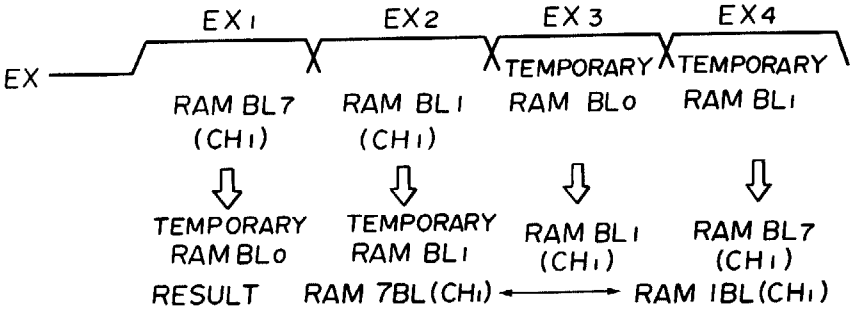
FIG. 39 is an explanatory diagram showing various states in the EX mode in FIG. 38.

First, the procedure and operation in the case where pieces of information stored in two blocks in the RAM of one and same channel will be described with reference to FIGS. 38 and 39, etc.

The all select switch 31 (FIG. 5 and FIG. 6) is set to the SELECT side. The channel selecting switch, for instance the switch $SU_2$ of the 1st channel, of a channel to which a RAM whose contents are to be exchanged is operated, and the tone select switches corresponding to blocks, whose contents are to be exchanged, in the RAM of the 1st channel, for instance, the tone select switches $TS_1$ and $TS_7$ are operated. Finally, the exchange switch 29 is operated. As a result, the signal SL is raised to "1". As the signals WT and RD are at "0", the NAND gate 87 (FIG. 11) is opened, and the system clock pulse $CK_0$ having a frequency of 100 KHz is provided. By this system clock pulse $CK_0$, the signals $SH_0$–$SH_{20}$, and $PSH_0$–$PSH_{20}$ are changed in frequency and are then outputted. In this case, as the FF 55 (FIG. 6) is in the reset state, the output of the inverter 56 is at "1", and the shift register 57 is in the reset state.

Upon operation of the exchange switch 29, the FF 55 (FIG. 6) is set. When the signal EX is raised to "1" by the set output signal of the FF 55, the reset state of the shift register 57 is released and the contents of the FF 57 are successively shifted by the signal $PSH_{20}$. When the signal $PSH_{20}$ is applied to the shift register 57, the latter 57 sucessively outputs the signals $EX_1$, $EX_2$, $EX_3$ and $EX_4$ one at a time. When the shift register outputs the signal $EX_5$, it is reset to its initial state.

Figure 21:
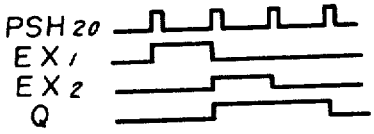
FIG. 21 shows waveforms for a description of the operation of a flip-flop 159 in the address generator 11 shown in FIG. 18.

The output of the channel selecting switch $SU_1$ is applied to the preferential encoders 71 and 72 (FIG. 7). The gate circuit $G_3$ is opened at the time of outputting the signals $EX_1$ and $EX_4$. The gate circuit $G_4$ is opened at the time of outputting the signals $EX_2$ and $EX_3$. Accordingly, from both of the gate circuits $G_3$ and $G_4$, the channel code $CC_1$–$CC_3$ representative of the 1st channel is outputted. The decoder 79 outputs the signal $SCH_0$. By this signal $SCH_0$ and the signal $CH_1$ (FIG. 22) obtained from the channel code $CC_1$–$CC_3$, the RAM in the memory block 201 has been chip-selected. When the signals $EX_3$ and $EX_4$ are outputted, the output "1" of the AND gate 186 is applied to the terminal $\overline{R}/W$ of the RAM, and the RAM receives the write instruction. When the signals $EX_1$ and $EX_2$ are outputted, the output "0" of the AND gate 186 is applied to the terminal $\overline{R}/W$ of the RAM, and the RAM receives the read instruction. In FIG. 17, the decoder 145 supplies the channel timing signal $CH_1$ to the channel selecting switch $SU_2$. Furthermore, as the tone select switches $TS_1$ and $TS_7$ have been turned on, the output of the switch $TS_1$ and the output of the switch $TS_7$ are transmitted through the priority encoder 147 and the priority encoder 148, respectively. As shown in FIG. 21, during the production of the signals $EX_1$ and $EX_2$ the priority encoder 147 is enabled to output the code signal "0 1 1" concerning the switch $TS_1$ to the input terminals $P_5$–$P_7$ of the program counter 169. Whenever the signal $PSH_{20}$ is outputted, the output $PSH_{20}$.EX of the AND gate 179 is raised to "1", and therefore the program counter 169 is program-enabled and the signals "0" are applied to the input terminals $P_0$–$P_4$. Although the RAM 198 for temporary memory (FIG. 22) has been chip-selected with the aid of the signal EX, it receives the write instruction at the time of outputting the signals $EX_1$ and $EX_2$, and receives the read instruction at the time of outputting the signals $EX_3$ and $EX_4$. Furthermore, when the signals $EX_2$ and $EX_4$ and outputted, the address input terminal $AD_5$ of the RAM 198 is held at the "1" level by these signals. As the various signals have been outputted as described above, when the first signal $PSH_{20}$ is outputted after the exchange switch 29 is turned on, the signal $EX_1$ is outputted, and it is maintained at "1" until the second signal $PSH_{20}$ is outputted. The program counter 169 is program-enabled by the first signal $PSH_{20}$, and the code signal "1 1 1" of the tone select switch $TS_7$, which is outputted by the priority encoder 148, is applied to the input terminals $P_5$–$P_7$ of the program counter 169. As a result, the content of the programable counter 169 becomes "224", the top address of the 7th block (BL7) of the RAM is given. Whenever the system clock pulse $CK_0$ is applied to the program counter 169, the content of the counter 169 is increased by one (+1). The content of the program counter 169 is applied as the address signals $AD_0$–$AD_7$ to the address input terminal of the memory block 201 and to the address input terminals $AD_0$–$AD_7$ of the RAM 198 for temporary memory. Accordingly, the information of the 7th block of the RAM in the memory block 201 is successively written in the 0-th block in the RAM 198 (because the signals "0" are applied to the address input terminals $AD_0$–$AD_7$ of the RAM 198 at the time of outputting the first signal $PSH_{20}$, thereafter it is increased by one (+1) together with the programable counter 169, and its content varies from address 0 to address 20, which means the 0-th block). This state is illustrated in FIG. 38. When the content of the programable counter 169 reaches "244", the writing operation is ended, and then the second signal $PSH_{20}$ is outputted. With the aid of this signal $PSH_{20}$, the signal $EX_2$ is outputted and the programable counter 169 is program-enabled. The signals "0" are applied to the input terminals $P_0$–$P_4$, and the code signal "0 0 1" of the switch $TS_1$, which is outputted by the priority encoder 147 is applied to the input terminals $P_5$–$P_7$ of the programable counter 169. As a result, the content of the programable counter 169 sets up the top address 32 of the first block of the RAM in the memory block 21, and is increased successively by one (+1) up to "42". When the second signal $PSH_{20}$ is outputted, only the input terminal $AD_5$ out of the address input terminals $AD_0$–$AD_5$ of the RAM 198 for temporary memory is raised to "1", and the address 32 is set up for the address input terminals $AD_0$–$AD_7$. This is the top address of the first block in the RAM 198. Therefore, during the provision of the signal $EX_2$, the content of the first block of the RAM in the memory block 201 is written in the first block of the RAM 198 for temporary memory. When the content of the programable counter 169 reaches "52", this writing operation is completed. Thereafter, the third signal $PSH_{20}$ is outputted, and the signal $EX_3$ is raised to "1". Similarly as in the above-described case, the programable counter 169 is program-enabled, and the code signal "0 0 1" of the switch $TS_1$ is applied to the input terminals $P_5$–$P_7$, as a result of which the content of the program counter 169 becomes "32" again. On the other hand, all the address inputs to the RAM 198 are lowered to "0", as a result of which the 0-th block of the RAM 198 is specified. At that instant, the read instruction is applied to the RAM 198, while the write instruction is applied to the RAM in the memory block 201. Therefore, the information which has been written in the 0-th block of the RAM 198 (that is, the information stored in the 7th block of the RAM in the memory block 201 at the beginning) is written in the first block of the RAM in the memory block 201. Upon completion of this operation, the fourth signal $PSH_{20}$ is outputted, and simultaneously the signal $EX_4$ is outputted. In this case, the content of the programable counter 169 is set to "224", while the RAM 198 is set to "32". Therefore, the information of the first block in the RAM 198 (that is, the information stored in the first block of the RAM in the memory block 201 at the beginning) is written in the seventh block of the RAM in the memory block 201. Upon completion of this operation, the signal EX is lowered to "0", and all the operations are accomplished. As a result, the contents of the first block and the seventh block of the RAM in the memory block 201 are exchanged for each other.

Figure 40:
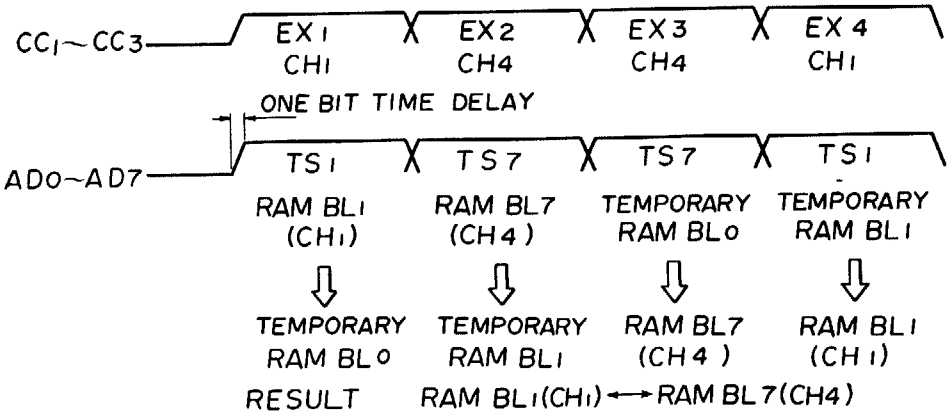
FIG. 40 is also an explanatory diagram showing the case where the contents of blocks in different channels are swapped with each other.

The case where with respect to two channels, the information of one block in one of the two channels and the information of one block in the other channel are exchanged for each other, will be described. In this example, the information of the tone select switch $TS_1$ (the first block of the RAM in the memory block 201) of the first channel 1 and the information of the tone select switch $TS_7$ (the seventh block of the RAM in the memory block 203) of the fourth channel are exchanged for each other, for instance. In this case, the all select switch 31 is set to the SELECT side, and furthermore the channel selecting switches $SU_2$ and $SL_2$ and the tone select switches $TS_1$ and $TS_7$ are operated. Finally, the exchange switch 29 is operated. The operation in this case is substantially similar to that in the case of exchanging information in one on the same channel, and therefore its detailed description will be omitted. This operation is indicated in FIG. 40. Referring to FIG. 7, the output of the channel selecting switch $SU_2$ is applied to the priority encoder 71, and the output of the channel selecting switch $SL_2$ is applied to the priority encoder 72. Therefore, the channel code $CC_1$–$CC_3$ outputted when the signal $EX_1$ or $EX_4$ is outputted, specifies the first channel ($CH_1$), while the channel code $CC_1$–$CC_3$ outputted when the signal $EX_2$ or $EX_3$ is outputted, specifies the fourth channel ($CH_4$). Thus, the memory blocks 201 and 203 in FIG. 21 are specified by the channel codes $CC_1$–$CC_3$, whereby the information change with the RAM 198 for temporary memory is carried out. As a result, the information of the first and seventh block in the RAM of the first channel and the information of the first and seventh block in the RAM of the fourth channel are exchanged for each other.

In the above description, the technical concept of this invention is applied to the music synthesizer; however, it is apparent that it can be applied to other similar electronic musical instruments such as for instance an electronic organ.

Furthermore, in the above-described embodiment, the magnetic card is employed as the external memory means; however, it goes without saying that it can be replaced by other recording means such as for instance a magnetic tape, and in this case the card I/O logic 22, the card reader 23 and the card reader control logic 24 may be modified according to the recording means employed.

(3) Effects of the Invention (3-1) As is apparent from the above description, the tone color control device in the electronic musical instrument is provided according to the invention, which comprises the tone property setting device for outputting a plurality of tone property information in the form of analog data and a plurality of first tone property information in the form of digital words for controlling the tone colors of musical tones, the A/D conversion device for converting the plurality of tone property information in the form of analog data into a plurality of second tone property information in the form of digital words, and the control device for selectively taking the plurality of second tone property information in the form of digital data in the predetermined order out of the tone property setting device and for simultaneously taking the first tone property information in the form of digital words out of the same tone property setting device, and which further comprises the D/A conversion device for converting the plurality of second tone property information in the form of digital words into a plurality of tone property information in the form of analog data, the sample hold circuit for storing the plurality of tone property information in the form of analog data, and the latch circuit for latching the plurality of first tone property information in the form of digital data. Therefore, the analog tone property information outputted by the tone property setting device is converted into the digital words, and accordingly the digital process thereof can be readily achieved, and the error in this case is much less than that in the case of the analog process. Furthermore, the tone property control device is advantageous in that the digital tone property information outputted by the tone property setting device and the analog tone property information can be processed completely equivalently. In addition, as is apparent from the above-described embodiment, the plurality of tone property information in the form of digital data can be processed similarly as in the case of information for one tone color (one set of properties) in the form of analog data, and therefore the capacities of the memories for storing these pieces of tone property information can be smaller. This is another merit of the tone property control device according to the invention.

(3-2) In addition, the tone property control device in the electronic musical instrument according to the invention comprises; the tone property setting device, the A/D conversion device, the external memory device for storing the tone property information in the form of digital data; and the internal memory device for storing the tone property information stored in the external memory device when it is transmitted thereto and for using the tone property information during a performance when it is read out, and which further comprises the D/A conversion device, and the sample hold circuit. Accordingly, the musical tone information used as analog information during a performance can be readily stored as digital information in the external memory such as a magnetic card, and furthermore the musical tone information stored in the magnetic card prior to a performance can be stored in the internal memory (ROM), and therefore the performance can be effected with the musical tone information immediately. It can be understood that judging from the recent development of this art, recording the musical tone information, as digital information, in a magnetic card or the like is simpler, and lower in cost than recording it as analog information.

If a number of such magnetic cards are provided, it is advantageous in that the cards can be taken to any place to play a performance, since the cards are light and small.

(3-3) Furthermore, the tone control device in the electronic musical instrument is provided by the invention, which comprises: the tone property setting device; the A/D conversion device; the channel code detection device for detecting the same information as the channel code representative of the musical tone forming circuit out of the tone color information in the form of digital data; the A/D output conversion device for converting the contents of an optional bit of the same information as the channel code detected by the channel code detection device. Therefore, even if the tone property information should coincide with the channel code, it is immediately detected and converted into other information. Therefore, no error is caused, and accordingly the performance can be correctly carried out. This is another merit of the invention.

Furthermore, in the invention, the A/D output conversion device operates to conver the contents of the least significant bit of the same information as the channel code. Therefore, the tone property information before the conversion is similar to that after the conversion, which is preferable for the performance.

In addition, the tone property control device in the electronic musical instrument, according to the invention, comprises: the data input device which receives the tone property information obtained by converting the analog tone color information into digital tone property information, and the channel code representing the musical tone forming circuit, and stores the digital tone color information and the channel code; the channel code detection device which receives the output of the data input device to detect the channel code and stores the channel code; and the data output device which receives the output of the data input device to detect the digital tone color information and outputs this digital tone property information. Therefore, it is possible to simultaneously record the tone property information and the channel code in the external memory such as a magnetic card, and it is possible to separately read the tone property information and the channel code out of the external memory. Accordingly, the tone property control device according to the invention is advantageous in that the performance can be effected with the correct information.

(3-4) The tone property control device in the electronic musical instrument is provided according to the invention, which comprises: the first memory device for storing a plurality of tone property information to control the tone colors of musical tones; the second memory device for temporarily storing the tone property information transferred from the first memory device; the control device which operates to transfer the plurality of tone property information in the first memory device to the second memory device so that the plurality of tone property information are temporarily stored in the second memory device, and to transfer the plurality of tone property information to the first memory device so that the plurality of tone property information are stored in the regions in the first memory device which are different from the regions where the plurality of tone property information has been stored before transferred to the second memory device. Therefore, in the above-described embodiment, it is possible that two pieces of tone property information stored in two blocks in the first memory are swapped with each other merely by operating the channel switches and the tone select switches, and accordingly the performance relations between the keyboards corresponding to the blocks can be exchanged for each other. For instance, the performance in flute tone property effected with the upper keyboard can be done with the pedal keyboard, merely by operating the switches such as the channel switches and the tone select switches. This is, the corresponding relationships between the tone property information and the keyboards, or the arrangements of tone property information with respect to the tone select switches, can be changed as desired merely by operating the switches. Accordingly, it is possible that while the performance is being given with one hand, the aforementioned arrangement can be changed with the other hand. This is considerably convenient for a performance.

(3-5) Furthermore, as is clear from the above description, according to this invention, the tone property control device in the electronic musical instrument has been provided which comprises: the read only memory (ROM) for storing a plurality of sets of tone property information for controlling the tone properties of musical tones; the random access memory (ROM) in which the pieces of tone property information stored in the ROM are transferred to be stored in the corresponding regions therein; and the control device which operates to transfer the sets of tone property information stored in the ROM to the respective regions in the RAM so as to be stored therein when the power switch, etc. are turned on, and to make it possible to carry out a performance with the tone property information stored in the RAM. Therefore, when the power switch and the reset switch of the electronic musical instrument are turned on, the standard tone property information stored in the ROM is transferred into the corresponding regions in the RAM. By turning on the power switch and by operating the tone select switch, the tone property information corresponding to that tone select switch is read out of the RAM and is applied to the musical tone generating circuit, as a result of which the musical tone generating circuit is controlled by the aforementioned tone property information, whereby the performance can be carried out without delay. In addition, in the case where tone property information set by the performer has been stored in the RAM, the tone property information stored in the RAM can be converted into standard tone property information merely by one switch operation. Therefore, this is very effective.

What is claimed is:

1. An electronic musical instrument comprising:

a musical tone forming circuit including a plurality of musical tone forming channels each for producing a musical tone signal having tone properties;

means for delivering, in a time division multiplexed fashion, digital signals designating the tone properties of the musical tone signals to be produced in said musical tone forming channels;

a random access memory storing digital signals for each of said musical tone forming channels and connected to said delivering means for storing said digital signals;

an external memory;

external memory input/output means connected to said random access memory and said external memory for transferring the stored contents in said random access memory to said external memory and the stored contents in said external memory to said random access memory;

control means connected to said random access memory and said external memory input/output means for controlling said transferring operation in a manner that when said control means transfers the stored contents of said random access memory to said external memory, tone property information along with a corresponding channel code for a given channel is stored at an arbitrary location in said external memory, and when said control means designates tone property information to be read out, a digital word is transferred to the external input/output means indicating the tone property information by a channel code, said information being identified in the external memory by its channel code only;

a digital to analog converter for converting said digital signals into a time division multiplexed analog signal; and a demultiplexer for converting said time division multiplexed analog signal into parallel analog signals;

said demultiplexer being connected to said musical tone forming circuit and establishing the tone properties of the musical tone signals produced in the respective channels in accordance with said parallel analog signals.

2. An electronic musical instrument according to claim 1, wherein said external memory input/output means includes a channel code detecting means to detect said digital word indicating the channel from among the read out signals from said external memory when transferring the contents from said external memory to said random access memory thereby to designate the address in said random access memory to write in said contents from said external memory.

3. An electronic musical instrument according to claim 1, wherein said musical tone forming channels are respectively given names represented by particular words, and wherein said means for delivering digital signals comprises:

tone property setting means for delivering second analog signals designating the properties of the musical tone signals to be produced in said musical tone forming circuit;

a multiplexer connected to said tone property setting means, for converting said second analog signals into a second time division multiplexed analog signal;

an analog to digital converter for converting said second time division multiplexed analog signal into a time division multiplexed digital signal including digital words;

a channel code detecting means to detect from among said digital words a word which is identical with one of said particular words which are respectively representing the names of the respective musical tone forming channels; and means to deliver said digital words as said digital signals without modification when said detecting means does not detect said identicalness but by modifying, when said detecting means detects said identicalness, the digital word to another word which is not identical with any of said particular words.

4. An electronic musical instrument comprising:

a musical tone forming circuit for producing musical tone signals having tone properties;

a random access memory for storing digital words designating the properties of the musical tone signals to be produced in said musical tone forming circuit;

tone property establishing means connected to said random access memory and said musical tone forming circuit for reading out said digital words and establishing the properties of the musical tone signals according to said digital words;

a semiconductor read only memory storing predetermined digital words representing standard properties for the musical tone signals;

control means connected to said read only memory and said random access memory for commanding the transfer and writing of said digital words in said read only memory in substantially unmodified form into said random access memory; and switch means for triggering said control means to command said transfer and writing.

5. An electronic musical instrument according to claim 4, wherein said switch means operates upon turning on of the power of the instrument.

6. An electronic musical instrument according to claim 4, wherein said switching means includes a manual switch to render the switching means operative.

7. An electronic musical instrument comprising:

a musical tone forming circuit for producing musical tone signals having tone properties;

a first random access memory for storing digital words designating the properties of the musical tone signals to be produced in said musical tone forming circuit;

tone property establishing means connected to said first random access memory and said musical tone forming circuit for reading out said digital words and establishing the properties of the musical tone signals according to said digital words;

a second random access memory;

control means connected to said first and second random access memory for carrying out the exchange of a first digital word at a first address with a second digital word at a second address in said first random access memory by moving said first and second digital words to separate addresses in said second random access memory and then moving back said first digital word to said second address and said second digital word to said first address; and switch means for triggering said control means to command said exchange.

* * * * *